US010433664B2

(12) United States Patent
Brannock

(10) Patent No.: US 10,433,664 B2
(45) Date of Patent: Oct. 8, 2019

(54) LID FOR CONTAINER

(71) Applicant: Harl-Bella Holdings, LLC, San Juan Capistrano, CA (US)

(72) Inventor: Samuel Lincoln Brannock, San Juan Capistrano, CA (US)

(73) Assignee: Harl-Bella Holdings, LLC, San Juan Capistrano, CA (US)

( * ) Notice: Subject to any disclaimer, the term of this patent is extended or adjusted under 35 U.S.C. 154(b) by 0 days.

(21) Appl. No.: 15/232,751

(22) Filed: Aug. 9, 2016

(65) Prior Publication Data

US 2016/0345762 A1 Dec. 1, 2016

Related U.S. Application Data

(60) Continuation-in-part of application No. 14/948,031, filed on Nov. 20, 2015, now Pat. No. 9,751,666, (Continued)

(51) Int. Cl.
*A47G 19/22* (2006.01)
*B65D 47/06* (2006.01)
(Continued)

(52) U.S. Cl.
CPC ..... *A47G 19/2272* (2013.01); *B65D 43/02* (2013.01); *B65D 43/0212* (2013.01);
(Continued)

(58) Field of Classification Search
USPC ..... 215/386, 387; 220/265, 266, 268, 703, 220/711, 712, 713, 716, 717, 718
See application file for complete search history.

(56) References Cited

U.S. PATENT DOCUMENTS 2,600,479 A 6/1952 Campomar
2,753,049 A 7/1956 Gaines et al.
(Continued)

FOREIGN PATENT DOCUMENTS

AU 2007100927 A4 11/2007
CA 1236426 5/1988
(Continued)

OTHER PUBLICATIONS

International Preliminary Report on Patentability dated Sep. 4, 2015 for International Application No. PCT/US2014/050422, 12 pages.
(Continued)

*Primary Examiner* — James N Smalley
*Assistant Examiner* — Madison L Poos
(74) *Attorney, Agent, or Firm* — Fish IP Law, LLP

(57) ABSTRACT

A lid for a container is described. The lid has a basin that is designed to enhance the user's olfactory experience when drinking a beverage from the container and lid. As the user tilts the container and lid to take a drink, the beverage pours through an opening on the basin valley and flows across a sipping surface area to the user's mouth, thus allowing the beverage to aerate, evaporate, and cool. The basin is sized and dimensioned to channel and concentrate the vapor rising from the beverage towards the user's nose as the user sips the beverage. The basin and the opening are sized and dimensioned to provide a comfortable and secure feeling when drinking hot beverages. In this manner, the lid enhances the drinker's olfactory experience and provides better controllability of the flow of a hot beverage to prevent burn injuries.

25 Claims, 29 Drawing Sheets

Related U.S. Application Data which is a continuation-in-part of application No. 14/454,426, filed on Aug. 7, 2014, which is a division of application No. 13/962,878, filed on Aug. 8, 2013, now Pat. No. 8,881,938.

(60) Provisional application No. 61/833,864, filed on Jun. 11, 2013, provisional application No. 61/763,393, filed on Feb. 11, 2013, provisional application No. 61/706,487, filed on Sep. 27, 2012, provisional application No. 61/681,017, filed on Aug. 8, 2012.

(51) Int. Cl.

| | |
|---|---|
| ***B65D 47/36*** | (2006.01) |
| ***B65D 43/02*** | (2006.01) |
| ***B65D 43/06*** | (2006.01) |
| ***B65D 51/16*** | (2006.01) |
| ***B65D 47/20*** | (2006.01) |

(52) U.S. Cl.

CPC ..... *B65D 43/06* (2013.01); *B65D 47/06* (2013.01); *B65D 47/20* (2013.01); *B65D 47/36* (2013.01); *B65D 51/16* (2013.01); *B65D 2203/12* (2013.01); *B65D 2205/02* (2013.01); *B65D 2543/00046* (2013.01); *B65D 2543/00092* (2013.01); *B65D 2543/00509* (2013.01); *B65D 2543/00537* (2013.01); *B65D 2543/00731* (2013.01); *B65D 2543/00796* (2013.01)

(56) References Cited

U.S. PATENT DOCUMENTS

| | | | | |
|---|---|---|---|---|
| 3,090,542 | A | 5/1963 | Miller | |
| 3,341,062 | A | 9/1967 | Phillips | |
| 3,727,808 | A | 4/1973 | Fitzgerald | |
| 3,730,399 | A | 5/1973 | Dibrell et al. | |
| 3,777,968 | A | 12/1973 | Law | |
| 3,800,999 | A | 4/1974 | Serritella | |
| 3,806,023 | A | 4/1974 | Bamett | |
| 3,920,146 | A | 11/1975 | Baller | |
| 3,977,559 | A | 8/1976 | Lombardi | |
| 3,977,562 | A | 8/1976 | Wedzik | |
| 3,994,411 | A | 11/1976 | Elfelt et al. | |
| 4,056,210 | A | 11/1977 | Boyle | |
| 4,090,660 | A | 5/1978 | Schram et al. | |
| 4,202,459 | A | 5/1980 | DeParales et al. | |
| 4,210,272 | A | 7/1980 | Sequin | |
| D259,403 | S | 6/1981 | Frazier, Jr. | |
| 4,322,014 | A | 3/1982 | Philip | |
| 4,322,015 | A | 3/1982 | Bailey | |
| 4,350,260 | A | 9/1982 | Prueher | |
| 4,361,249 | A | 11/1982 | Tuneski et al. | |
| D267,633 | S | 1/1983 | Christian | |
| 4,412,629 | A | 11/1983 | Dart et al. | |
| 4,438,865 | A | 3/1984 | Scattaregia | |
| D274,502 | S | 7/1984 | Little | |
| 4,473,167 | A | 9/1984 | Bailey | |
| 4,489,848 | A | 12/1984 | Braude | |
| 4,566,605 | A | 1/1986 | Rogers | |
| 4,738,373 | A | 4/1988 | DeParales | |
| 4,753,365 | A | 6/1988 | Seppala | |
| 4,760,934 | A | 8/1988 | Netsch | |
| 4,949,865 | A | 8/1990 | Turner | |
| 5,090,584 | A | 2/1992 | Roberts et al. | |
| 5,197,624 | A | 3/1993 | Dodaro | |
| 5,392,949 | A | 2/1995 | McKenna | |
| 5,431,276 | A | 7/1995 | Lialin | |
| 5,490,609 | A | 2/1996 | Lane et al. | |
| 5,503,289 | A | 4/1996 | Fox | |
| 5,540,350 | A | 7/1996 | Lansky | |
| 5,613,619 | A | 3/1997 | Van Melle | |
| 5,699,927 | A | 12/1997 | Lane et al. | |
| 5,911,331 | A | 6/1999 | Boller | |
| 5,947,323 | A | 9/1999 | Freek et al. | |
| 6,089,397 | A * | 7/2000 | Van Melle | B65D 43/0268 220/254.7 |
| 6,419,105 | B1 * | 7/2002 | Bruce | B65D 47/06 220/266 |
| 6,505,753 | B1 | 1/2003 | Freek et al. | |
| 6,948,633 | B2 | 9/2005 | Freek et al. | |
| D570,685 | S | 6/2008 | Koennecke | |
| 8,113,379 | B2 | 2/2012 | Cai et al. | |
| 8,302,798 | B2 | 11/2012 | Moss | |
| 2002/0100757 | A1 | 8/2002 | Shih | |
| 2003/0102312 | A1 | 6/2003 | Horner | |
| 2003/0116568 | A1 | 6/2003 | Clarke et al. | |
| 2004/0195239 | A1 | 10/2004 | Rush et al. | |
| 2004/0232154 | A1 | 11/2004 | Smith | |
| 2005/0230403 | A1 | 10/2005 | Dark | |
| 2006/0255043 | A1 | 11/2006 | Tedford, Jr. | |
| 2007/0012709 | A1 | 1/2007 | Durdon | |
| 2007/0075079 | A1 | 4/2007 | Stokes | |
| 2008/0000921 | A1 | 1/2008 | Leon | |
| 2009/0026219 | A1 | 1/2009 | Bal | |
| 2011/0049171 | A1 | 3/2011 | Morgan | |
| 2011/0100854 | A1 | 5/2011 | Chapin | |
| 2011/0114655 | A1 | 5/2011 | Bailey | |
| 2012/0000923 | A1 | 1/2012 | Powell | |
| 2012/0024871 | A1 * | 2/2012 | Hundley | B65D 43/0212 220/715 |
| 2012/0152968 | A1 | 6/2012 | Bailey | |
| 2012/0205390 | A1 | 8/2012 | Portman | |
| 2012/0261417 | A1 | 10/2012 | Tabor et al. | |
| 2012/0312827 | A1 | 12/2012 | Zuares et al. | |
| 2014/0042178 | A1 | 2/2014 | Brannock | |
| 2014/0183198 | A1 | 7/2014 | Slack | |

FOREIGN PATENT DOCUMENTS

| | | | |
|---|---|---|---|
| CA | 2031703 | | 6/1992 |
| CA | 1324342 | | 11/1993 |
| CN | 101024433 | A | 2/2006 |
| CN | 201079228 | Y | 7/2007 |
| GB | 2473041 | A | 3/2011 |
| GB | 2473043 | A | 3/2011 |
| JP | 4-20302 | A | 1/1992 |
| JP | 9-99946 | A | 4/1997 |
| JP | 2600723 | Y2 | 10/1999 |
| JP | 2000-25806 | A | 1/2000 |
| JP | 2000-287808 | A | 10/2000 |
| JP | 2006103782 | A | 4/2006 |
| KR | 2002-0021950 | A | 3/2002 |
| KR | 2003-0065958 | A | 8/2003 |
| TW | 317272 | | 10/1997 |
| TW | 465326 | | 11/2001 |
| TW | M323449 | | 12/2007 |
| WO | 01/56899 | A1 | 8/2001 |
| WO | 2008/018798 | A1 | 2/2008 |
| WO | 2009126555 | A3 | 3/2010 |
| WO | 2011082333 | A3 | 10/2011 |
| WO | 2012104385 | A1 | 8/2012 |

OTHER PUBLICATIONS

Office action dated Aug. 11, 2016 in U.S. Appl. No. 14/948,031, 12 pages.

Office action dated Nov. 17, 2016 in U.S. Appl. No. 14/948,085, 19 pages.

Office action dated Jun. 15, 2017 in U.S. Appl. No. 14/948,085, 21 pages.

Office action dated Jul. 26, 2017 in U.S. Appl. No. 14/948,123, 9 pages.

Office action dated Jul. 26, 2017 in U.S. Appl. No. 14/948,135, 15 pages.

Office action dated Nov. 16, 2017 in U.S. Appl. No. 14/948,085, 11 pages.

Office action dated Feb. 15, 2018 in U.S. Appl. No. 14/948,123, 11 pages.

(56) References Cited

OTHER PUBLICATIONS

Office action dated Sep. 27, 2017 for Canadian Patent Application No. 2954254, 7 pages.
Office action dated Nov. 3, 2017 for Canadian Patent Application No. 2949166, 4 pages.
Office action dated Nov. 3, 2017 for Canadian Patent Application No. 2949168, 4 pages.

* cited by examiner

FIG. 1
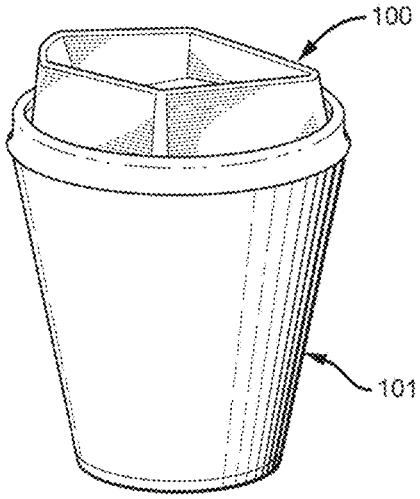
FIG. 2
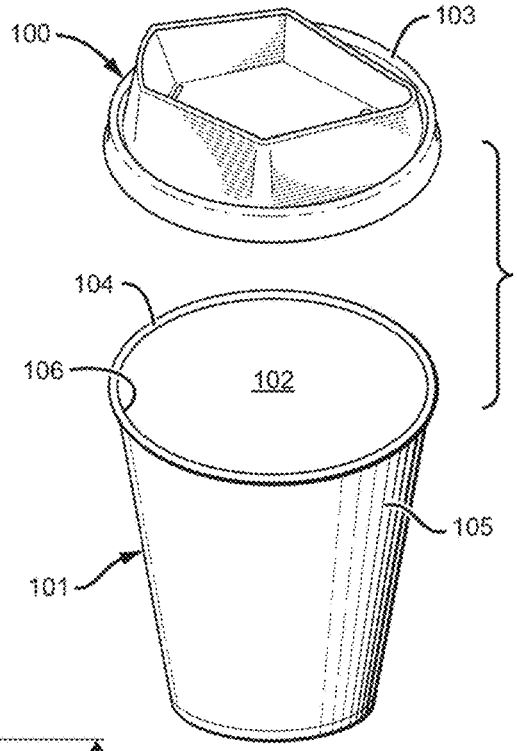
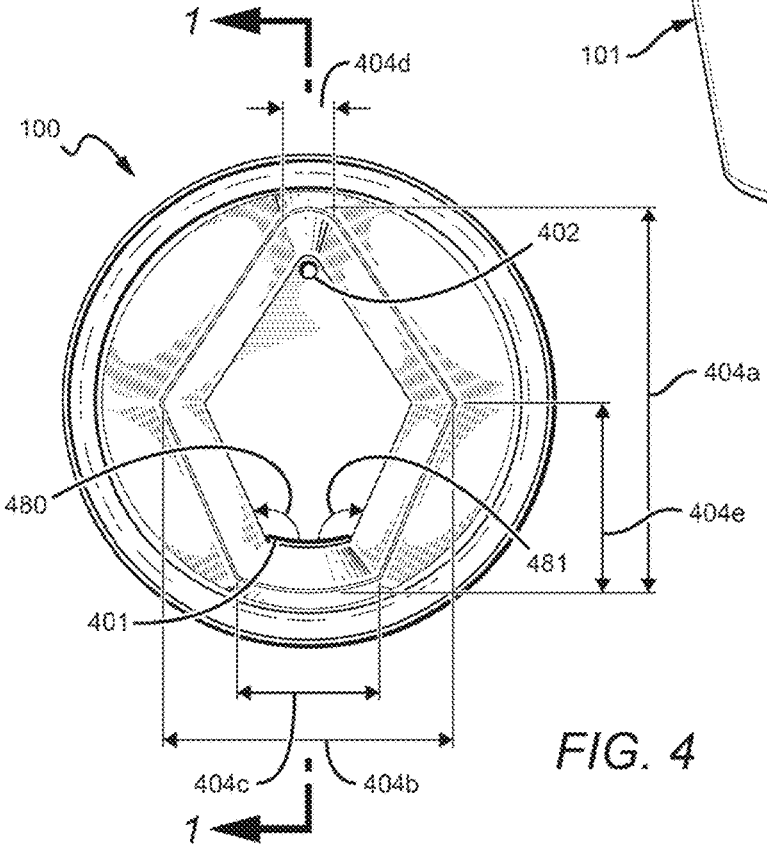
FIG. 4

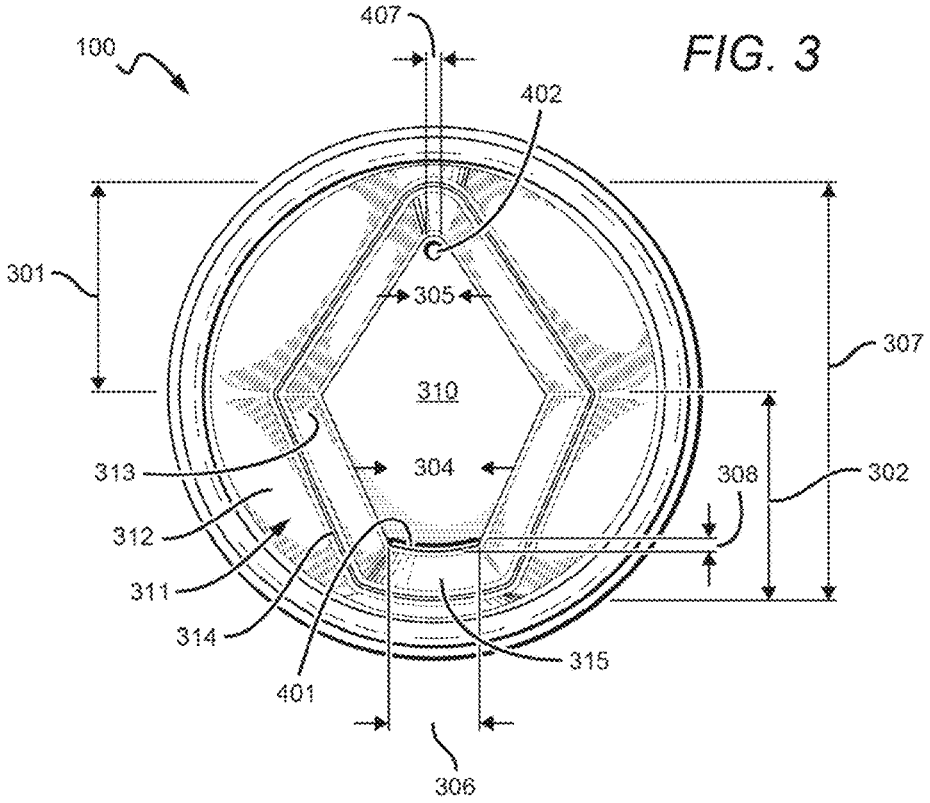
FIG. 3
FIG. 5A
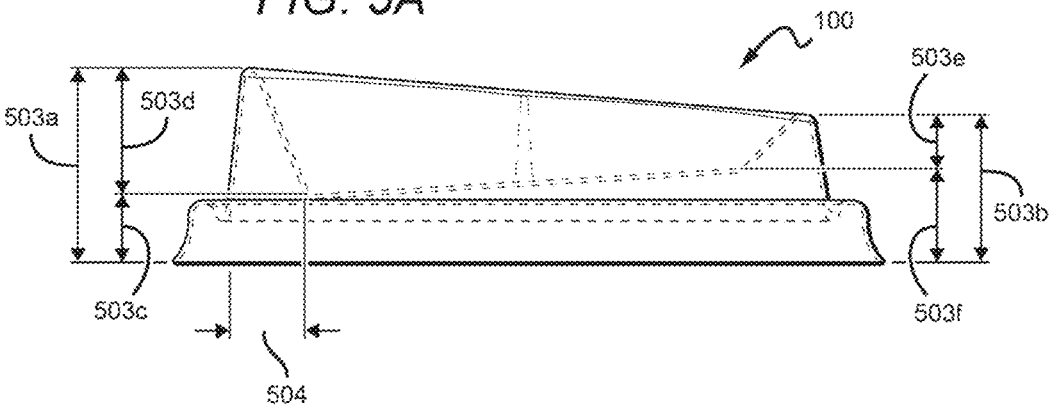

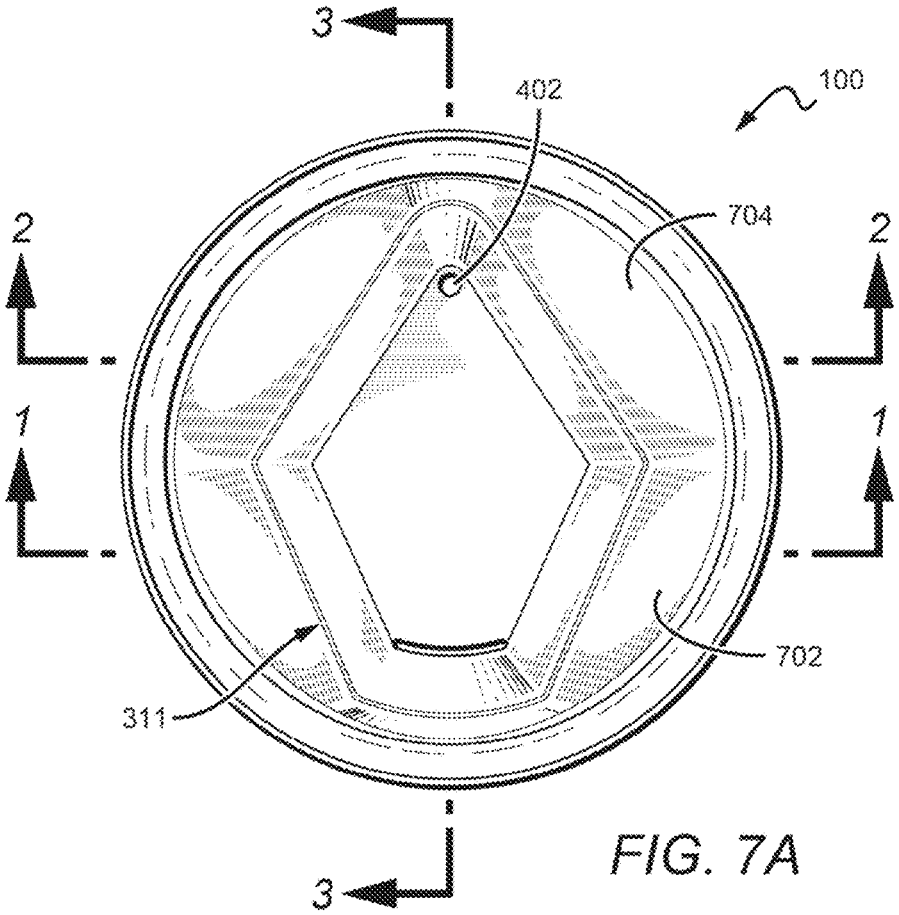
FIG. 7A
FIG. 7B
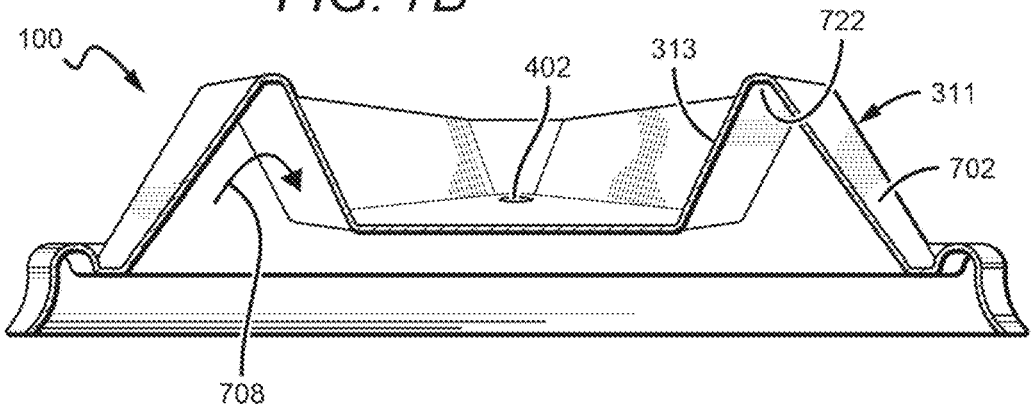

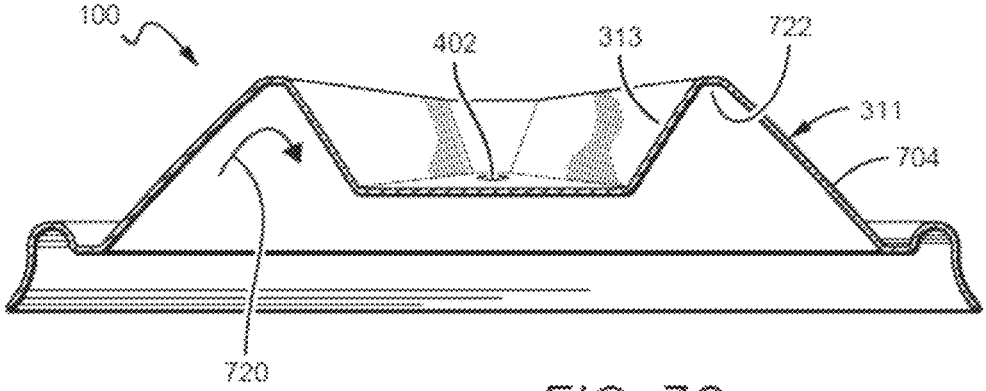
FIG. 7C
FIG. 7D
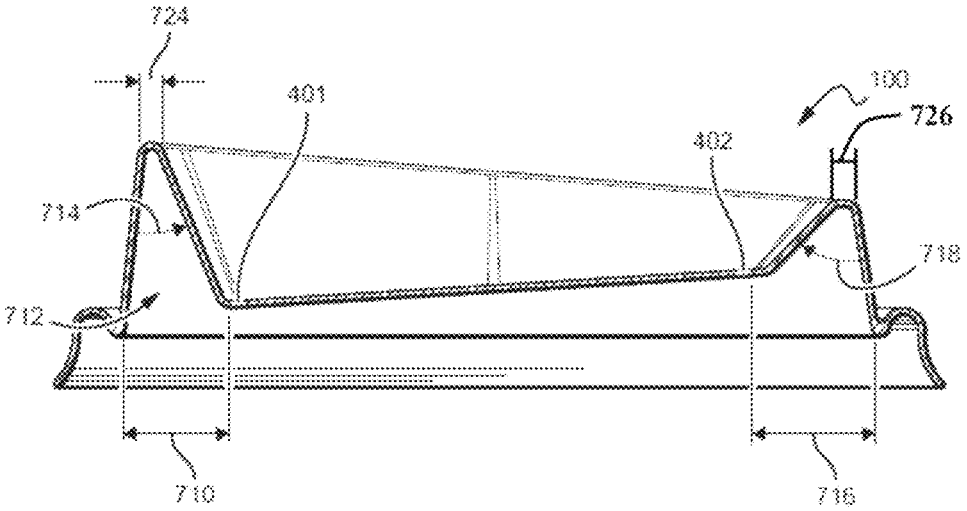

FIG. 17A
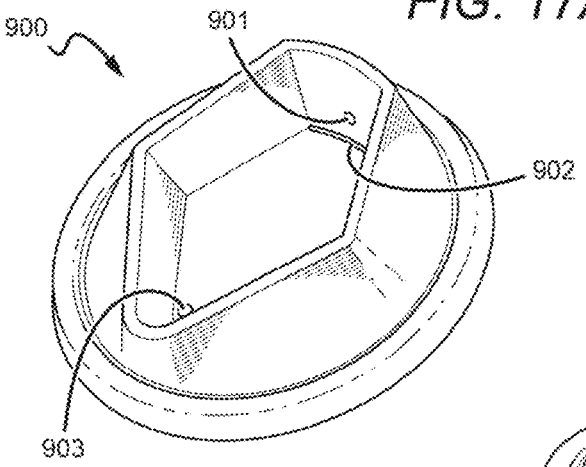
FIG. 17B
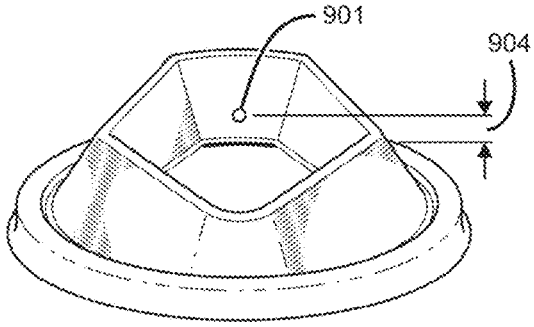
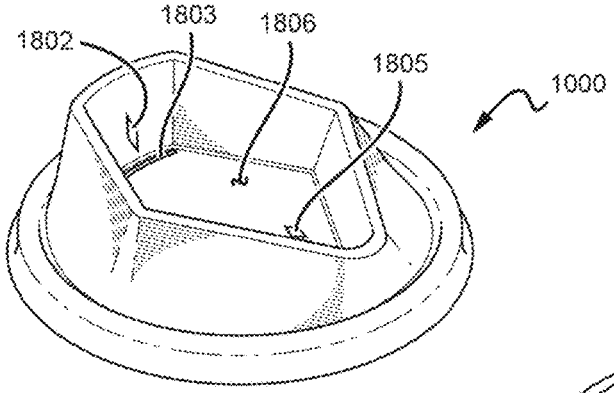
FIG. 18A
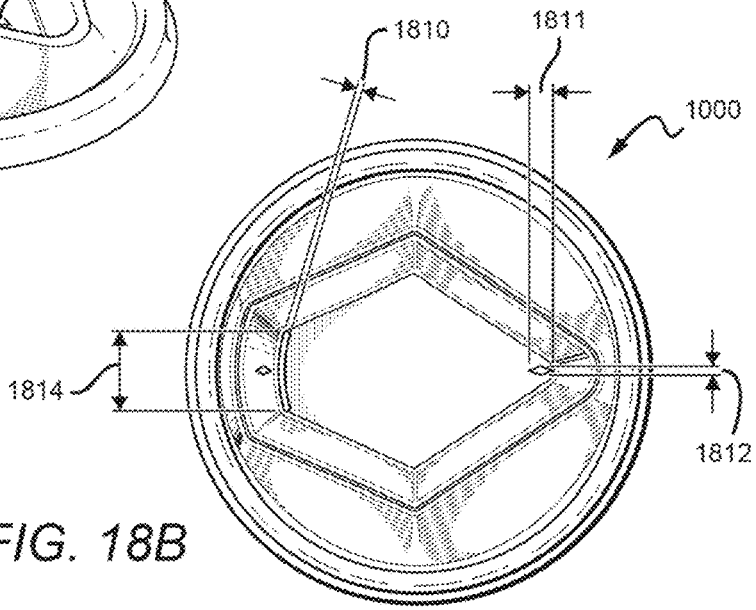
FIG. 18B

FIG. 23A
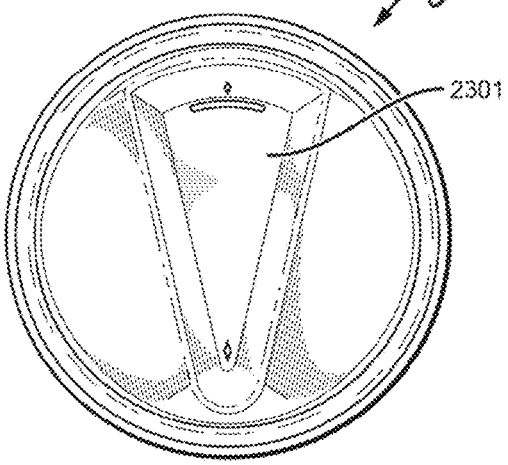
FIG. 23B
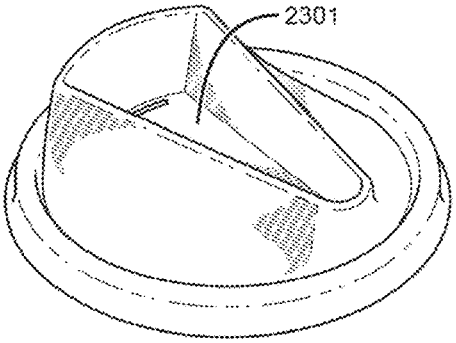
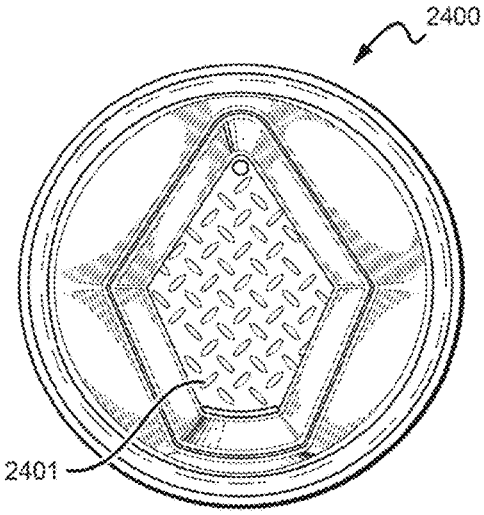
FIG. 24
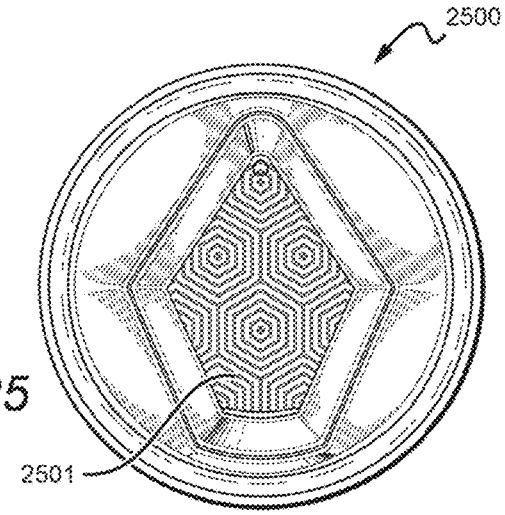
FIG. 25

FIG. 26A
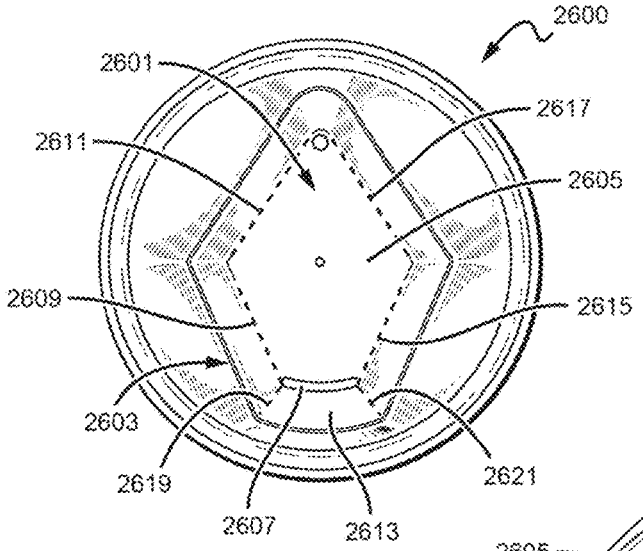
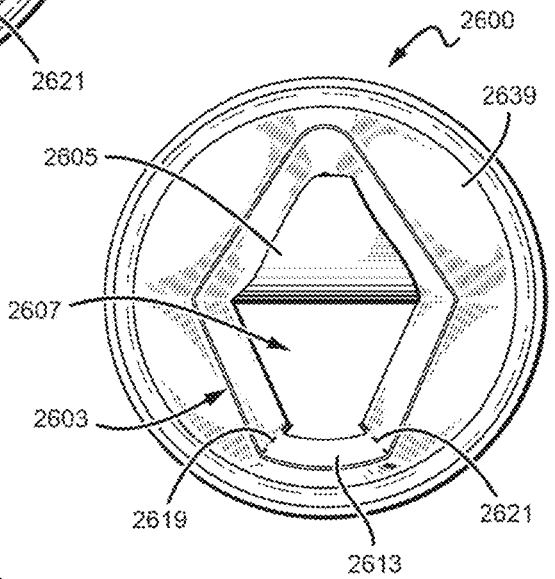
FIG. 26B
FIG. 26C
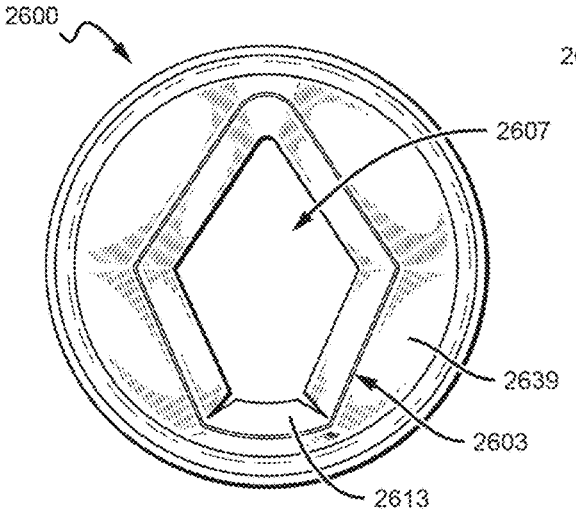

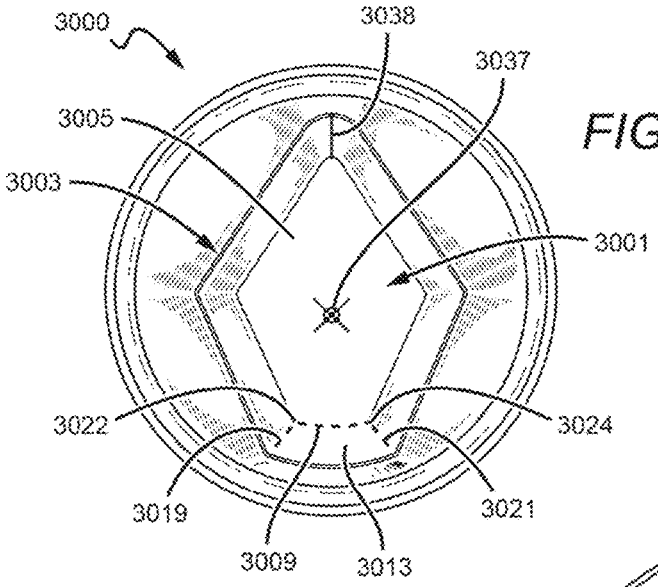
FIG. 30
FIG. 31
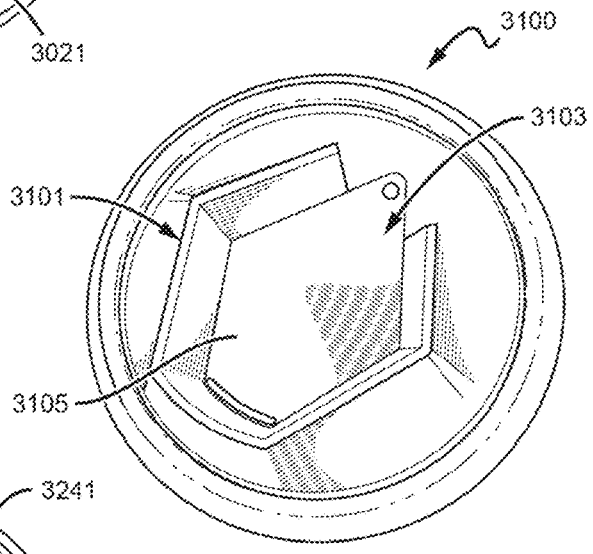
FIG. 32
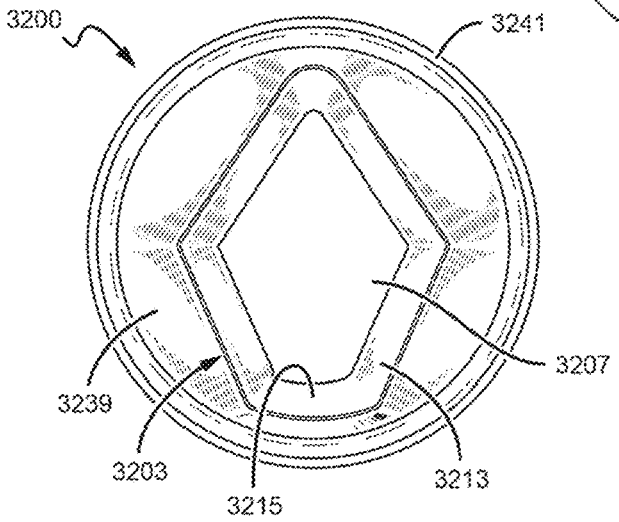

FIG. 43A
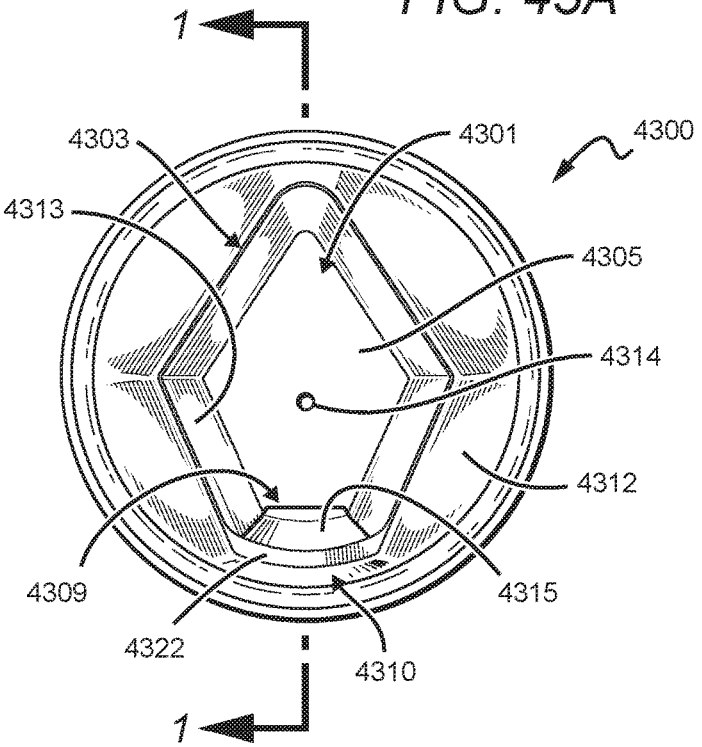
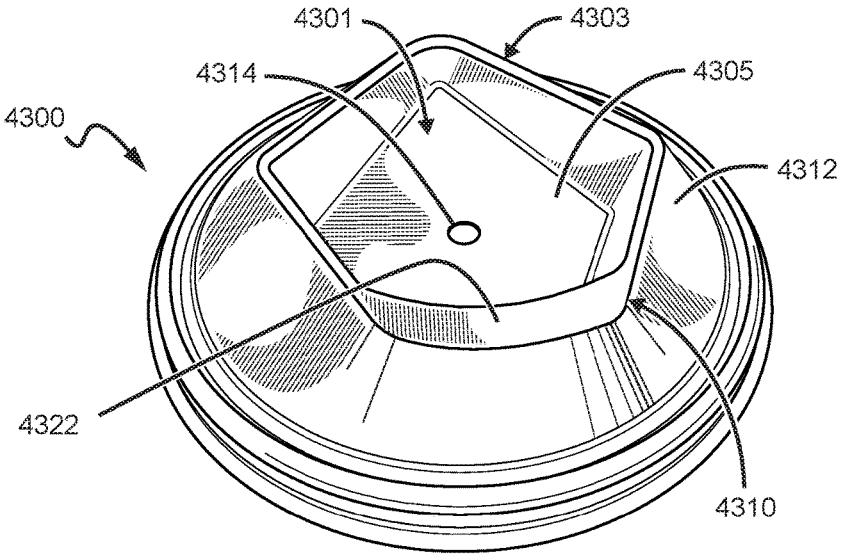
FIG. 43B

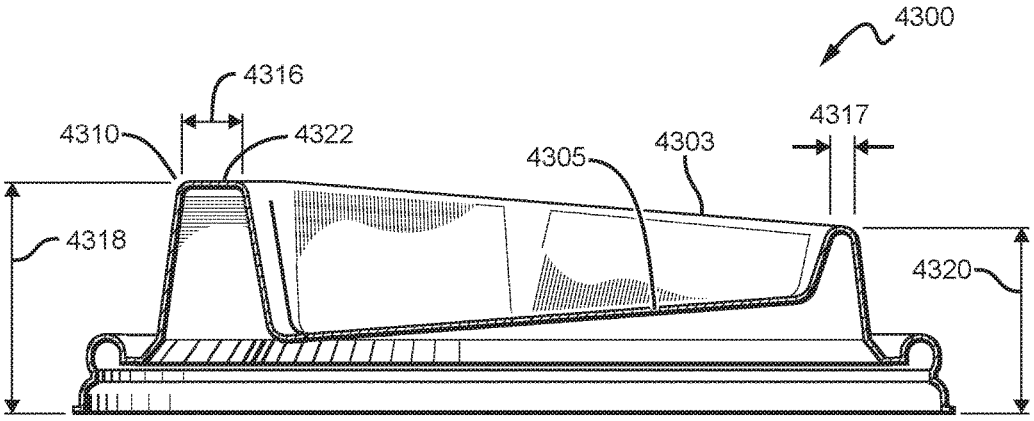
FIG. 43E
FIG. 43F
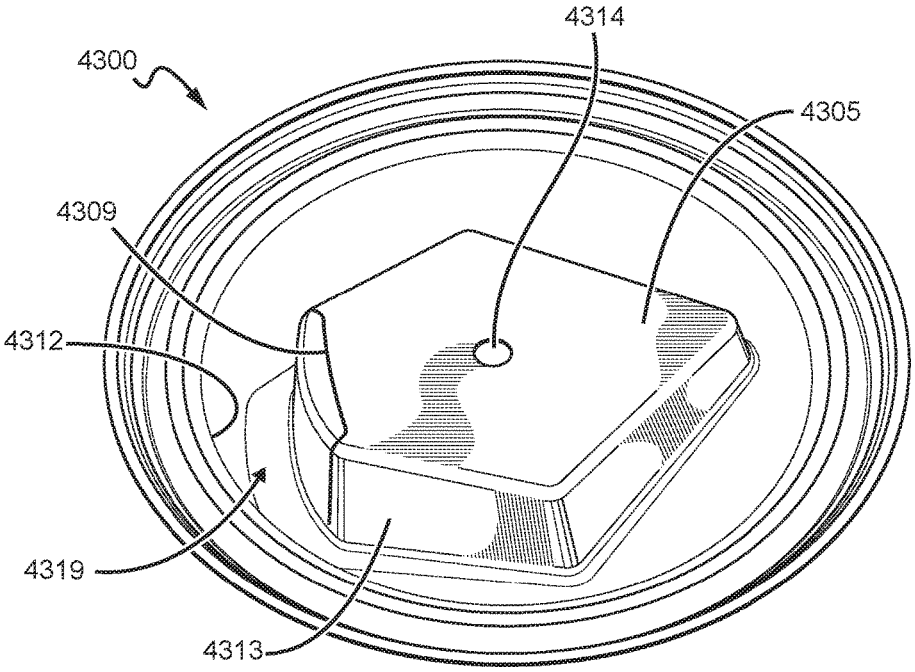

LID FOR CONTAINER

This application is a continuation-in-part of, and claims priority to, U.S. application Ser. No. 14/948,031, filed on Nov. 20, 2015, which is a continuation-in-part of, and claims priority to, U.S. application Ser. No. 14/454,426, filed on Aug. 7, 2014, which is a divisional application of, and claims priority to, U.S. application Ser. No. 13/962,878, filed on Aug. 8, 2013, issued as U.S. Pat. No. 8,881,938 on Nov. 11, 2014, which claims priority to U.S. Provisional Patent Application No. 61/833,864 filed Jun. 11, 2013; U.S. Provisional Patent Application No. 61/763,393 filed Feb. 11, 2013; U.S. Provisional Patent Application No. 61/706,487 filed Sep. 27, 2012; U.S. Provisional Patent Application No. 61/681,017 filed Aug. 8, 2012, each of which is incorporated herein by reference in its entirety.

FIELD OF THE INVENTION

The field of the invention is lids, and more specifically, lids for enhancing the comfort, safety, and olfactory experience when drinking beverages and consuming solid food from a container.

BACKGROUND

The following description includes information that may be useful in understanding the present invention. It is not an admission that any of the information provided herein is prior art or relevant to the presently claimed invention, or that any publication specifically or implicitly referenced is prior art.

The olfactory perception of consumers is an important factor to consider when developing a certain beverage and/or food product. Through the sense of smell, consumers can gauge the freshness of a product and can sometimes determine whether they will like the product before consuming. As such, a pleasant aroma can induce consumers into trying the product and the overall experience can be enhanced by consuming a product with the combination of a pleasant smell and taste. Unfortunately, many consumers on the go are deprived of this olfactory experience because a majority of containers (e.g., beverage containers, soup containers, etc.) have lids that fail to provide a means of smelling the aroma of the beverage.

Some have recognized this flaw and have attempted to remedy the problem. One example of such is WO 2011/082333 to Sprunger, which discloses a beverage lid that has a pod (e.g., compartment) filled with aromatic material (e.g., coffee grind). The lid allows vapor rising from a hot beverage to pass through the aroma pod and to the user's nose. Unfortunately, this approach can be problematic if the aromatic material is accidentally wetted while filling the beverage container or drinking from the beverage container. In addition, the lid is relatively large and expensive since it requires a pod with an aromatic material.

A similar approach is described in WO 2009/126555 to Kaufman, which discloses a beverage lid that has a compartment for holding a sample of fresh beverage material. The compartment is placed near the user's nose, allowing the user to smell the beverage material when drinking from the lid. While the Kaufman lid can provide a pleasant aroma of fresh material, this approach is troublesome for those consumers that desire repeated use.

In another approach, GB 2473041 and GB 2473042 to Brown disclose a cup lid having a curved rim surface that is higher at the drinking aperture. The beverage flows through a liquid guide trough, which exposes the liquid to the air adjacent to the user's nose. Unfortunately, a user may run the risk of burning his/her upper lip because the lid's curved rim surface places the user's upper lip into the flow of the beverage in the guide trough. (In fact, Brown states that the user may desire to use their upper lip to test whether the beverage is too hot to drink. See Brown at page 25, lines 14-20.) Brown also fails to provide a controlled beverage flow rate and a comfortable/secure feeling for drinking hot beverages. Furthermore, Brown fails to contain and redirect the aroma to a concentrated point near the user's nose.

Finally, US 2011/0114655 to Bailey provides a cup lid that has a scent aperture positioned near the user's nose to allow aroma from the beverage to reach the user. Unfortunately, this approach increases the risk of spilling via the additional aperture. This approach also fails to allow the beverage to aerate outside of the container as it flows to the user's mouth.

As seen above, lids have evolved in an attempt to improve olfactory experience. Other modifications to lids that address other issues include the following: AU 2007100927 to Wall (a coffee lid that contains an advertisement); U.S. Pat. No. 3,806,023 to Barnett (a lid that has a concave main body portion that allows hot liquid to cool); US 2007/0012709 to Durdon (a lid having a drink-through opening and a stopper, which can be used to plug drink-through opening); US 2007/0075079 to Stokes (a lid having a beverage spout through which a primary liquid can flow and a sip hole through which a flavoring can flow); US 2008/0000921 to Leon (a lid having a spout and openings that allow liquid and vapor to pass through); US 2011/0100854 to Chapin (a can top shaped with grooves that reduces a build-up of debris); US 2012/0152968 to Bailey; U.S. Pat. No. 4,056,210 to Boyle; U.S. Pat. No. 4,350,260 to Prueher; U.S. Pat. No. 4,438,865 to Scattaregia; U.S. Pat. No. 4,738,373 to DeParales; U.S. Pat. No. 8,302,798 to Moss; US 20040232154 to Smith; US 20110049171 to Morgan; US 20120205390 to Portman; and WO2012104385 to Elias.

All publications cited herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, there is still a need for improved lids that can be used to comfortably consume beverages and/or solid food products, and that enhance the olfactory experience of drinking an aromatic beverage while providing better comfort and protection when drinking hot beverages.

SUMMARY OF THE INVENTION

The inventive subject matter provides apparatus, systems, and methods in which a lid for a container can enhance a user's olfactory experience while providing a comfortable design that is customizable according to the preferences of the user. A lid is contemplated that comprises a ridge having an inward-facing wall and an outward-facing wall that extend to a top surface. The lid comprises a first width of the top surface at a first portion of the ridge, and a second width of the top surface at a second portion of the ridge. Typically, the first width is greater than the second width. An opening can be disposed proximal to the first portion on the ridge, and at least a portion of the ridge can be disposed above the opening. It should be appreciated that the opening can be enlarged by pinching the inward-facing wall and the outward-facing wall near the opening to increase the flow rate of a beverage and/or to provide a better ratio of foam to liquid when consuming a foam drink (e.g., a cappuccino, a latte, a macchiato, a beer, etc.) than typically provided in conventional lids. Additionally, the opening can be further enlarged by pinching the top surface and the outward-facing wall.

In another aspect, a lid for a container is contemplated. The lid comprises a ridge having an inward-facing wall and an outward-facing wall. A first crease and a second crease are typically disposed on the inward-facing wall. The ridge partially surrounds a valley. An opening is disposed on the valley that extends along the first crease and the second crease. It is contemplated that the opening forms a "U"-shape as it extends from the valley along the first and second creases. Additionally, or alternatively, the opening can be enlarged by pinching together (i) the inward-facing wall disposed between the first and second creases and (ii) the outward-facing wall. The opening can be enlarged even further by tearing a portion of the ridge near the first and second creases via pinching together a top of the inward-facing wall and the outward-facing wall to extend the opening along the first and second crease. It should be appreciated that the opening provides controlled flow of a beverage, but can be customized via pinching to a preferred configuration by a user to increase the flow of beverage and/or to provide a desired ratio between foam to liquid in a foam drink.

In yet another aspect, the lid has a basin with a valley and a ridge surrounding the valley. The valley has an opening (e.g., spout) for allowing the beverage to pass through. The valley may optionally include a second opening (e.g., air hole) that allows for the exchange of air between the interior of the container and the surrounding environment, thus preventing a vacuum from forming within the container.

It is contemplated that the basin has an elongated shape that gradually becomes narrower across the length of the basin (e.g., the basin's ridges become closer together). The wider end of the basin is the drinking portion of the basin (i.e., the proximal portion) and the narrower end is the aroma portion (i.e., the distal portion). When the lid is placed on a container and the container is tilted, the liquid beverage passes through the opening near the drinking portion of the basin, which allows the liquid to aerate, cool, and evaporate. Vapor rising from the liquid is channeled to, and concentrated at, the user's nose due to the design of the lid.

In some embodiments, the basin has a drinking portion defined by the shape of the ridge as seen from a top view. More specifically, the ridge has an inward-facing surface and a first portion of the inward facing surface, referred to herein as the sipping surface, (i) intersects a second portion of the inward-facing wall at a first angle (at one end of the first portion) and (ii) intersects a third portion of the inward-facing wall at a second angle (at the other end of the first portion). The first and second angles are between 90 and 135 degrees and face one another in a mirrored fashion to form a controlled and contained sipping area.

In such embodiments, the distance between the second and third portions (i.e., the length of the first portion) and the height of the second and third portions can be sized and dimensioned to push the user's upper lip away from the sipping surface to reduce the likelihood of spills and burns and to provide a more comfortable and secure feeling when drinking hot beverages. In another aspect of such embodiments, the first and second angles form first and second creases in the inward-facing surface of the ridge. The first and second creases can include a plurality of perforations or a solid tear line, which allows the user to enlarge the lid's spout opening by pinching or pushing the inward-facing surface between the perforations.

In another aspect, a lid for a container (e.g., bowl, cup, take out container, food storage container, etc.) is contemplated. The lid comprises a basin defined by a ridge that at least partially surrounds a valley in a non-circular path. As used herein, a "non-circular" path or shape is defined as a shape or path having at least one portion that is non-circular, even though another portion of the shape or path may be circular. With respect to the shape or path of the ridge, it should be noted that the shape or path of the ridge is defined with respect to a top view of a lid herein. The basin has a drinking portion and an aroma portion. The drinking portion typically encompasses the area where the user drinks from the lid and the adjacent area (e.g., the bottom of ridge, the two ridges extending from the bottom, and the area within) while the aroma portion typically encompasses the area above the drinking portion (e.g., the two ridges that taper to the top of basin and the area within). It should be appreciated that the aroma portion is typically a distal region beyond the drinking portion, which allows aroma from a beverage and/or food product exiting the basin within the ridge (or inward-facing wall) perimeter to enter a user's nose A first tear line is typically disposed on the drinking portion and a second tear line disposed on the aroma portion. In contemplated embodiments, at least one of the first tear line and the second tear line extends proximally along an intersection of an inward-facing wall of the ridge and the valley. Thus, a user can use the lid to sip a beverage and/or rupture the lid using tear lines to consume the contents within an attached container using utensils.

In another aspect, a lid for a container is contemplated. The lid comprises a ridge having an inward-facing wall and an outward-facing wall that form a rounded apex. A first opening is at least partially defined by the ridge and extends from a drinking portion to an aroma portion. As used herein, an opening that is "at least partially defined by the ridge" means that at least a portion of the ridge, typically the inward-facing wall, is part of at least a portion of the perimeter of the opening. As used herein, an opening that is "defined by the ridge" means that at least a portion of the ridge forms the entire perimeter of the opening. At least a portion of the inward-facing wall in the drinking portion is substantially flat or concave between the rounded apex to the first opening. It should be appreciated that the ridge structure provides an anti-splash function by deflecting any liquid and/or food product into the container when the container is bumped.

In yet another aspect, a method of enlarging an opening on a lid is disclosed. The lid comprises a basin defined by a ridge that at least partially surrounds a valley. The basin has a drinking portion and an aroma portion. A first tear line and a third tear line are disposed in the drinking portion. A second tear line and a fourth tear line are disposed in the aroma portion. The lid comprises an opening disposed on the valley in the drinking portion. The various tear lines at least partially extend along a perimeter of the valley. The method of enlarging comprises a step of pulling the valley near the opening in an upward motion to rupture the first tear line and the third tear line in the drinking portion to partially remove the valley. It is contemplated that the valley can be completely removed to further enlarge the opening by pulling the valley in an upward motion to rupture the second tear line and the fourth tear line. Thus, users can comfortably gain access to the contents within an attached container without the need to remove the lid.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

FIG. 1 is a perspective view of one embodiment of a lid that has a basin, the lid coupled with a container.

FIG. 2 is a perspective view of the lid and container of FIG. 1 in a separated configuration.

FIG. 3 is a top view of the lid of FIG. 1.

FIG. 4 is another top view of the lid of FIG. 1.

FIG. 5A is a side view of the lid of FIG. 1.

FIG. 7A is a top view of the lid of FIG. 1 showing two portions of outward-facing wall.

FIG. 7B is a cross-sectional view on line 1-1 of FIG. 7A.

FIG. 7C is a cross-sectional view on line 2-2 of FIG. 7B.

FIG. 7D is a cross-sectional view on line 3-3 of FIG. 7C.

FIGS. 17A-B are perspective views of another embodiment of a lid with a basin.

FIG. 18A-B are perspective views of another embodiment of a lid with a basin

FIGS. 23A-B are perspective views of another embodiment of a lid with a basin.

FIG. 24 is a top view of another embodiment of a lid with a basin, wherein the basin valley is textured.

FIG. 25 is a top view of another embodiment of a lid with a textured basin valley.

FIGS. 26A-26D are perspective views of an embodiment of a lid having various tear lines.

FIG. 30 is a perspective view of an embodiment of a lid having a tear line and an incision.

FIG. 31 is a perspective view of an embodiment of a lid having a ridge that partially surrounds the valley.

FIG. 32 is a perspective view of an embodiment of a lid having a ridge as a splash guard that surrounds an opening.

FIGS. 43A-43L are various views of an embodiment of a lid having a ridge with a widened ridge portion.

DETAILED DESCRIPTION

Figure 5B:
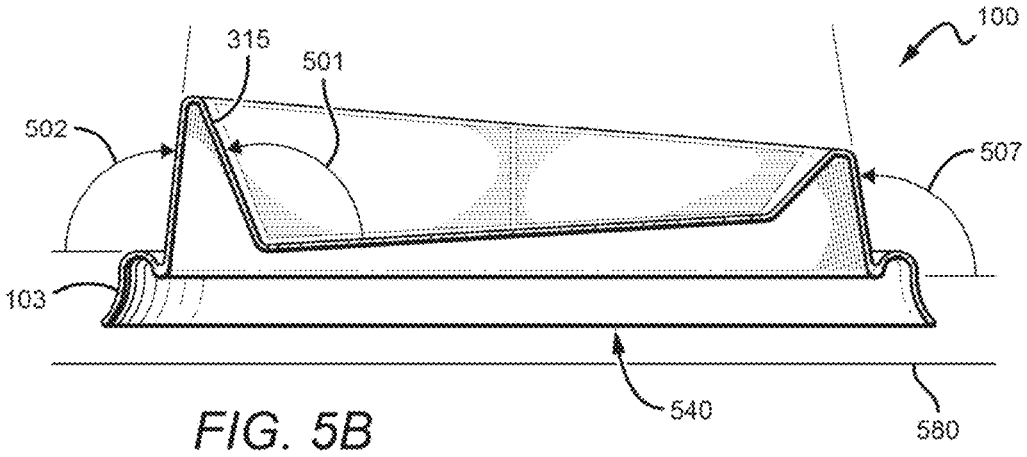
FIG. 5B is a side cross-sectional view of the lid of FIG. 1.

One should appreciate that the lids described herein provide many advantageous technical effects such as channeling and concentrating aroma of a beverage towards a user's nose to enhance aroma of a beverage as well as providing lids comprising tear lines that allow users to both consume a liquid beverage and to remove at least a portion of the lid using the tear lines to consume a solid food product without the need to completely remove the lid. Additionally, an enhanced olfactory experience can be provided by an opening on the lid that is larger than traditional lids while reducing the risk of splashing or spilling due to the ridge disposed on the lid.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

FIG. 1 shows a lid 100 coupled with a container 101. Lid 100 and container 101 are oriented in a resting position (e.g., container 101 is substantially vertical, as if resting on a horizontal plane such as a table surface).

Lid 100 is removably coupled with container 101. FIG. 2 shows lid 100 and container 101 separated from one another. Container 101 has a lumen 102 defined by a side wall 105 and a bottom. Lumen 102 can be used to store a beverage such as water, juice, soda, tea, coffee, and hot cocoa. Container 101 also has an opening 106 defined by a rim 104 from which a user can drink the beverage. Lid 100 has an outer rim 103 that has a slightly larger diameter than rim 104 of container 101, thus allowing lid 100 to removably couple with container 101 (e.g., outer rim 103 press-fits over rim 104). When coupled with container 101, lid 100 advantageously reduces the size of the opening of container 101 to contain a liquid and prevent spilling.

In other embodiments, lid 100 and container 101 can be removably coupled using threaded engagements, snap fittings, male-female engagements, or any other fastener suitable for sealing a liquid within lumen 102. In yet other embodiments, lid 100 and container 101 can be permanently coupled. For example, lid 100 and container 101 could be manufactured as one integral structure and a liquid could be placed inside lumen 102 prior to completion of the manufacturing process.

Lid 100 and container 101 can be made of any material suitable for containing a liquid (e.g., the material is substantially impermeable to the liquid) and/or solid contents (e.g., hot solid food, cold food, soup containing solids food particles). Lid 100 and/or container 101 can also be made of a material that helps insulate the temperature of the beverage from the temperature of the surrounding environment. The material may also be configured and/or chosen to withstand sudden temperature changes and have relatively low manufacturing costs (e.g., raw materials are inexpensive; material can be used in low cost manufacturing processes). Lid 100 and/or container 101 could also include a thermochromic material to indicate the temperature of the beverage or peizochromic material around edges of lid to indicate a proper seal with the beverage cup. In addition, lid 100 and/or container 101 could be made of a biodegradable material to reduce negative environmental impact when disposed. Lid 100 could also be made of a disposable or non-disposable material. As used herein, "non-disposable material" means a material that is configured for withstand many uses. In some embodiments, a non-disposable material could still comprise a material that is environmentally friendly and/or biodegradable. Contemplated materials include, but are not limited to, high-density polyethylene (HDPE), polystyrene, polypropylene (PP), polyethylene terephthalate (PET), silicone material, bio-plastics, fiber-based materials, metal alloys, ceramics, composites, and any combination thereof.

FIG. 3 shows a close-up top view of lid 100. FIG. 4 shows another close-up top view of lid 100. Lid 100 has a basin 310 (e.g., concavity) comprising a valley (also referred to as a base) surrounded by a ridge 311 (e.g., an elevated wall). The ridge 311 can be of constant height, or of varying heights. Moreover, ridge 311 has an outward-facing wall 312 (also referred to as outer surface) and an inward-facing wall 313 (also referred to as inner surface). Outward-facing wall 312 raises above outer rim 103 and is sufficiently large to display a graphic (e.g., a symbol, logo, drawing, text, etc.). Portions of outward-facing wall 312 are sloped at about 70 degrees with respect to a horizontal plane, making it visible by others. Inward-facing wall 313 slopes down from the top 314 of ridge 311 in a concave manner and joins with the valley of basin 310. The exact boundary between inward-facing wall 313 and the valley of basin 310 may not be readily apparent since inward-facing wall 313 slopes down gradually into the valley.

Basin 310 has an opening 401 (e.g., slot, slit, spout, etc.) disposed on the surface of the valley. Opening 401 is slightly concave and matches the contour of ridge 311 at the drinking portion of lid 100. In other embodiments, opening 401 could be substantially planar. Opening 401 is sized, dimensioned, and positioned to provide an outlet for dispensing the liquid. In alternative embodiments, opening 401 can comprise numerous shapes other than slits, such as a circular opening (see e.g., opening 2101 in FIG. 21), triangular openings (see e.g., openings 2020 in FIG. 20), rectangular openings, and so forth. In addition, it should be appreciated that lid 100 can have multiple openings to dispense the liquid as shown in the some of the examples below. The size, dimension, shape, and placement of opening 401 is especially configured to control the flow rate of the liquid and provide a variety of safeguards for consumers. For example, opening 401 reduces hazardous (i) splashing of the beverage onto the consumer, and (ii) burning of the consumer drinking a hot beverage. Opening 401 is also located close to the intersection of inward-facing wall 313 and basin 310, so as to reduce and/or eliminate the volume of non-dispensable liquid within the beverage container.

In some embodiments, opening 401 is located at an optimal distance from the proximal ridge (or from the wall of the container) so as to prevent a specific volume of the beverage from being dispensed. In this manner, the lid prevents unwanted coffee grinds or sediment such as from tea from being dispensed.

Basin 310 also has second opening 402 that is sized, dimensioned, and positioned so as to allow air flow while avoiding liquid flow when dispensing liquid from opening 401. Second opening 402 helps to maintain atmospheric pressure within lumen 102 when the liquid is dispensed. However, it is contemplated that other means can be used to help maintain atmospheric pressure, such that second opening 402 is not needed (e.g., larger openings for outlet dispensing).

FIG. 3 shows various dimensions of lid 100. Basin 310 has a length consisting of a first length 301 and a second length 302. The aroma portion comprises first length 301 (i.e., the portion that is distal to the user's mouth) and the drinking portion comprises second length 302 (i.e., the portion that is proximal to the user's mouth and near the user's nose). It should be noted that the drinking portion and aroma portion include the area of basin 310 within each of their respective lengths, which includes the valley of basin 310, inward-facing wall 313, outward-facing wall 312, opening 401, and opening 402 in each of first length 301 or second length 302 accordingly. The valley of basin 310 and/or inward-facing wall 313 at the drinking portion is configured to allow liquid to flow across a sipping area 315 when the liquid is dispensed from opening 401 (e.g., when the lid is tilted/angled with respect to a horizontal plane). While sipping area 315 is substantially planar (see FIG. 5B), sipping area 315 could also be slightly curved (e.g., concavity) to allow for temporary pooling of the beverage. Sipping area 315 advantageously allows at least a portion of the liquid to cool, aerate, and evaporate. Sipping area 315 also allows the user to sip the beverage, which allows better control over the flow of a hot beverage to prevent burns.

Opening 401 has a width 306 of approximately 0.6 inches (approximately 1.524 centimeters) and an opening height 308 of approximately 0.045 inches (approximately 0.1143 centimeter). The surface area of opening 401 is about 0.027 inches$^2$ (0.1742 cm$^2$). This particular size, shape, and position of opening 401 allows for better control of the delivery of an average cup of coffee. More specifically, the size, shape, and position of opening 401 provide an optimal flow rate for beverages having similar viscosity and surface tension as coffee. If opening 401 is substantially larger, the flow rate can be too fast and the user may be burned (coffee is generally served at a temperature of between 155 degrees Fahrenheit (68.33 degree Celsius) and 175 degrees Fahrenheit (79.44 degree Celsius)). However, if opening 401 is substantially smaller, the surface tension of coffee can cause the coffee to build up at opening 401, which may eventually burst and cause an unexpected flow of hot coffee.

Those of ordinary skill in the art will appreciate that alternative sizes, shapes, and positions for opening 401 could be used while still providing an acceptable flow rate and controlled flow (e.g., no vacuum or surface tension build up). For example, other sizes and dimensions that still result in a surface area of approximately 0.027 inches$^2$ may still eliminate the surface tension build-up while providing an acceptable flow rate for hot beverages. Unfortunately, conventional lids that place the spout opening at the bottom of a valley and away from the user's lips (e.g., GB 2473041 and GB 2473042) typically have a spout opening that is either too large or too small for hot beverages. When the opening is too large, the user would either have to wait until the hot beverage has cooled before taking a drink or else risk being burned. When the opening is too small, surface tension of the beverage creates build-up and trapping of the liquid at the opening; a sudden break in the surface tension leads to an unexpected rush of hot beverage, potentially causing burn injuries. Neither approach is acceptable since the user must compromise safety (e.g., being burned) or taste (e.g., drinking lukewarm coffee).

The exact size, shape, and position of opening 401 can be varied according to any number of factors, such as the beverage (e.g., juice, coffee, hot chocolate, tea, wine, water, soda, ice cream shake, soup), beverage temperature (e.g., hot or cold), other beverage characteristics (e.g., viscosity, surface tension, presence or absence of whip cream or solids) and user environment (e.g., sitting, walking, driving). In some embodiments, opening 401 can be adjustable (see, e.g., lid 200 in FIG. 10, lid 2600 in FIG. 26A, lid 2800 in FIG. 28A, etc.) to meet a user's particular preferences or application.

Lid 100 also has a second opening 402. Second opening 402 can have a second opening diameter 407 of approximately 0.1406 inches (approximately 0.3571 centimeters).

The specific values for dimensions as described herein are not meant to restrict the scope of the subject matter presented unless otherwise specified in the claims.

Figure 9:
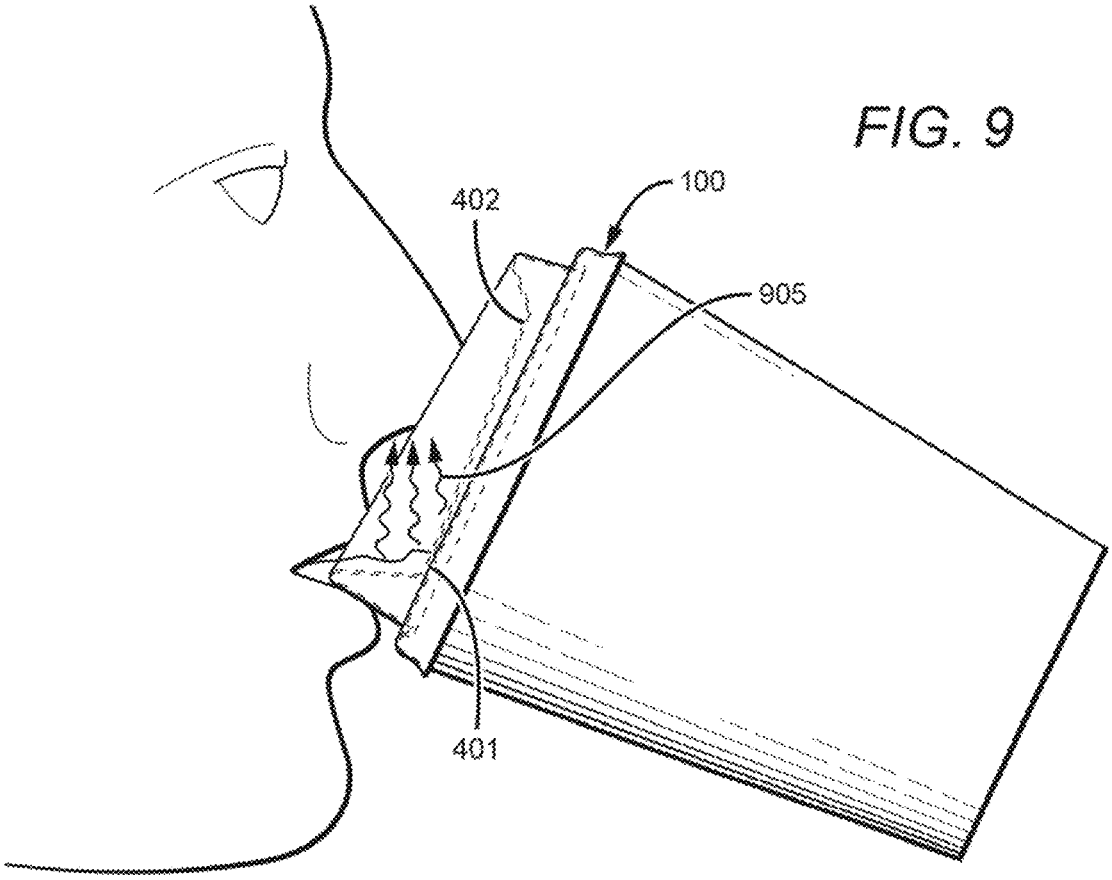
FIG. 9 is a side view of a user showing a liquid flow from the lid from FIG. 1 coupled to the container.

Basin 310 is also configured to channel and concentrate vapor rising from the liquid in the sipping portion to aroma portion. This is accomplished within first length 301, by shaping basin 310 such that its width becomes narrower moving from one end of its length (i.e., the drinking portion) to the other end of its length (i.e., the aroma portion). FIG. 3 shows a top view of lid 100, and best illustrates how the width of basin 310 changes along length 307 (wherein the width is the dimension between two opposing ridges). Drinking portion of lid 100 has a first width 304, which is much larger than second width 305 of aroma portion. Basin 310 is sized and dimensioned such that user's nose is closely located near the aroma portion when the user takes a drink from lid 100 as shown in FIG. 9. In this manner, lid 100 enhances the user's olfactory experience when drinking a liquid.

One advantage of lid 100 is the prevention of burning a user's upper lip. The drinking portion comprises ridge 311 of basin 310 that includes two sidewalls that meet at angles 480 and 481, as shown in FIG. 4. Angles 480 and 481 are approximately 135 degrees. However in other embodiments, angles 480 and 481 can be between 30 and 160 degrees, preferably between 80 and 160 degrees, and more preferably between 90 and 145 degrees. While angles 480 and 481 are identical in FIG. 4, it is contemplated that angles 480 and 481 can be different. Width 306 and angles 480 and 481 protect the user's upper lip by supporting (e.g., pushing) the upper lip off of ridge 311, such that the upper lip is away from the direct flow of the hot beverage. Width 306 and angles 480 and 481 also create a comfortable and secure feeling that allows the user to drink a hot beverage with confidence that the beverage will not spill or burn the user.

FIG. 4 shows other exemplary dimensions of lid 100 that allow users to identify a drinking portion on lid 100 without having to look at lid 100. This advantage is partially due to the shape of the features disposed on lid 100. The ridge can have an overall dimension 404*a* measured from its uppermost point in the aroma portion to its lower-most point in the drinking portion as shown in FIG. 4 of approximately 2¾ inches (approximately 6.985 centimeters), but in other embodiments overall dimension 404*a* can have a length between 2 to 4 inches (5.08 to 10.16 centimeters), and more typically between 2¼ to 3⅓ inches (5.715 to 8.467 centimeters). The ridge of lid 100 can also have an overall dimension 404*b* that is measured from the left-most point to the right-most point of the ridge as shown in FIG. 4 of about 2⅛ inches (about 5.398 centimeters), but in other embodiments overall dimension 404*b* can have a length between 1 to 3 inches (2.54 to 7.62 centimeters), and more typically between 1½ to 2½ inches (3.81 to 6.35 centimeters). Overall dimension 404*a* and overall dimension 404*b* are sized to maintain any excess liquid or splashing from the lid while not being oversized so as to make sipping using the lid uncomfortable.

It should be appreciated that although angles 480, 481 of drinking portion reduces the risk of a spill or burn by maintaining the upper lip of the user away from the direct flow of the hot beverage, drinking portion can also have a drinking portion dimension 404*c* to maintain the upper lip of the user in a safe location. Drinking portion dimension 404*c* can have a length measured from one portion of the ridge where two sidewalls meet to form angle 480 to another portion of the ridge where two sidewalls meet to form angle 481 as shown in FIG. 4 of about 1 inch (about 2.54 centimeters), but in other embodiments drinking portion dimension 404*c* can be a length between ¼ to 3 inches (0.635 to 7.62 centimeter), and more typically ½ to 2 inches (1.27 to 5.08 centimeters).

Other exemplary dimensions of lid 100 include a top portion dimension 404*d* and a drinking portion dimension 404*e*. Top portion dimension 404*d* can have a length measured as shown in FIG. 4 of about ⅜ inch (about 0.9525 centimeter), but in other embodiments top portion dimension 404*d* can be between ⅛ to 1½ inches (0.3175 to 3.81 centimeter). Similarly, drinking portion dimension 404*e* can have a length measured from the lowest point of the ridge near drinking portion to a point where two portions of ridge intersect as shown in FIG. 4 of about 1⅜ inch (about 3.492 centimeters), but in other embodiments the length can range between ½ to 3 inches (1.27 to 7.62 centimeters), and more typically between 1 to 2 inches (2.54 to 5.08 centimeters).

FIG. 5A shows a side perspective view of lid 100 with exemplary dimensions to provide a better illustration and comprising dotted lines to show the internal structure of lid 100. FIG. 5B shows a cross-section of the side view of lid 100 taken along line 1-1 from FIG. 4. As stated above, these dimensions are not meant to restrict the scope of the subject matter presented unless specified in the claims. In some embodiments, lid 100 can have a drinking portion lid height 503*a* with a height measured from the bottom surface of lid 100 to the top surface of the ridge near drinking portion as shown in FIG. 5A of approximately 15/16 inches (2.381 centimeters), but in other embodiments drinking portion lid height can be ⅓ to 3 inches (0.8467 to 7.62 centimeter), and more typically ½ to 1½ inches (1.27 to 3.81 centimeters). It should be appreciated that drinking portion lid height 503*a* is designed to prevent any splashing of liquid being consumed, and furthermore, drinking portion lid height 503*a* has a height greater than an aroma portion lid height 503*b* so as to allow a user to identify the drinking portion from the aroma portion. Other dimensions similar to drinking portion lid height 503*a* include height 503*c* and height 503*d*. For example, height 503*c* can have a height measured from the bottom surface of lid 100 to the bottom of the valley near the drinking portion as shown in FIG. 5A of ¼ inch (0.635 centimeter), but in other embodiments height 503*c* can be between ⅛ to 2 inches (0.3175 to 5.08 centimeter), and more typically between ⅙ to 1 inch (0.4233 to 2.54 centimeter). In another example, height 503*d* can have a height measured from the bottom of the basin near the drinking portion to the top of the ridge. Contemplated heights for height 503*d* include 1 1/16 inch (1.746 centimeters), and in other embodiments a height between ¼ to 2 inches (0.635 to 5.08 centimeter), and more typically between ½ to 1½ inches (1.27 to 3.81 centimeters).

Lid 100 also has aroma portion lid height 503*b* having a height measured from a bottom surface of lid 100 to the top surface of a ridge in the aroma portion as shown in FIG. 5A of about ⅞ inch (about 2.222 centimeters). However, in other embodiments, lid 100 can have aroma portion lid height 503*b* with a height between ⅛ to 3 inches (0.3175 to 7.62 centimeter), and more typically between ½ to 1½ inches (1.27 to 3.81 centimeters). Other dimensions similar to aroma portion lid height 503*b* include height 503*e* and height 503*f*. For example, height 503*e* can have a height measured from the bottom of the basin near the aroma portion to the top of the ridge of about ⅜ inch (about 0.9525 centimeter), but in other embodiments height 503*e* includes a height between 1/10 to 2 inches (0.254 to 5.08 centimeter), and more typically a height between ⅛ to 1 inch (0.3175 to 2.54 centimeter). Height 503*f* can have a height measured from bottom surface of lid 100 to the bottom of the basin near the aroma portion of about ½ inch (about 1.27 centimeters), but in other embodiments height 503*f* can be a height between ⅛ to 3 inches (0.3175 to 7.62 centimeter), and more typically ¼ to 1½ inches (0.635 to 3.81 centimeter).

As shown in FIGS. 5A and 5B, the height of lid 100 tapers going from drinking portion lid height 503*a* to 503*b*. Nevertheless, it is contemplated that the height of lid 100 can be constant (i.e., the lid height does not taper) in alternative embodiments. The tapering design of lid 100 can help a user to locate the drinking portion of lid 100 without looking at lid 100. For example, when the user is driving the user can feel the height increase of 503*a* with his or her lips, allowing the user to keep eye contact on the road.

As illustrated by the cross-sectional side view in FIG. 5B, the elevation of the valley of basin 310 is lower at the drinking portion and higher at the aroma portion with respect to a horizontal plane 580, which allows fluid in the valley of basin 310 to flow back into the lumen 102 of container 101 when in the resting position (e.g., when coupled with container 101 and placed on horizontal plane 580). While the valley of basin 310 has a constant slope, in alternative embodiments, the valley of basin 310 could have a non-constant slope (e.g., it could be concave), and could also be non-planar or could include impressions (e.g., mounds, bumps, textures, etc).

In addition, FIG. 5B shows how the elevation of the valley of basin 310 is always higher than the elevation of outer rim 103. However, it is contemplated that other embodiments of lid 100 can have a basin valley that is located at the same elevation as the outer rim or at a lower elevation than the outer rim. Alternations to the elevation of the basin valley and the height profile of lid 100 can be done for various reasons, such as aesthetics and convenience of design. As discussed above, outer rim 103 is configured to couple a container. Thus, it is contemplated that outer rim 103 defines a third opening 540 having a size and dimension to receive a container to couple lid 100 to the container.

It should be noted that lid 100 has various slopes that can benefit the user and/or the manufacturers. FIG. 5B also shows a first angle 502, which is the angle between outward-facing wall 312 of ridge 311 (near the drinking portion) and a horizontal surface. In some embodiments, first angle 502 is between 90 and 135 degrees. First angle 502 is optimized to provide a comfortable drinking angle when container 101 is tilted by a user for drinking a liquid (e.g., see FIG. 9). By providing such angle in this embodiment, the outward-facing wall 312 of ridge 311 is viewable to consumers and on lookers, which makes this space valuable for advertisements and/or messages.

Lid 100 also has a drinking portion dimension 504, which is the distance from opening 401 to outward-facing wall 312 of ridge 311. Drinking portion dimension 504 defines a capture area that is sized and dimensioned to capture a small amount of liquid and/or liquid constituents (e.g., coffee grinds, contaminants from backwash drinkers, etc.). The capture area defined by drinking portion dimension 504 can be used to prevent dispensing of unwanted portions of a beverage. In some embodiments, drinking portion dimension 504 can be approximately 0.4 inches (approximately 1.016 centimeters). In alternative embodiments, drinking portion dimension 504 can be smaller or larger, depending on the desired size of the capture area. In yet other embodiments, the capture area can completely eliminated by being filled in.

FIG. 5B also shows angle 501, which is the angle between the inward-facing wall 313 of ridge 311 and the valley of basin 310 at the drinking portion side of the lid 100. Angle 501 is about 90 degrees. However, in other embodiments, angle 501 could be significantly less than or greater than 90 degrees. For example, angle 501 can be between 30 and 160 degrees, and more preferably between 50 and 120 degrees.

Angle 501 and first angle 502 could vary depending on numerous factors such as user preference and the particular application (e.g., tea, coffee, hot chocolate, juice, child, adult, etc). Angle 501 and first angle 502 could also vary along the circumference of ridge 311 (e.g., different portions of the ridge could have different angles).

FIG. 5B shows a second angle 507, which is the angle between the outward-facing wall 312 of the ridge 311 (near the aroma portion) with respect to a horizontal surface. It is contemplated that second angle 507 is between 100 and 130 degrees. By providing such angle in this embodiment, the outward facing surface of the ridge is viewable to consumers and on lookers, which makes this space valuable for advertisements and/or messages.

Figure 6A:
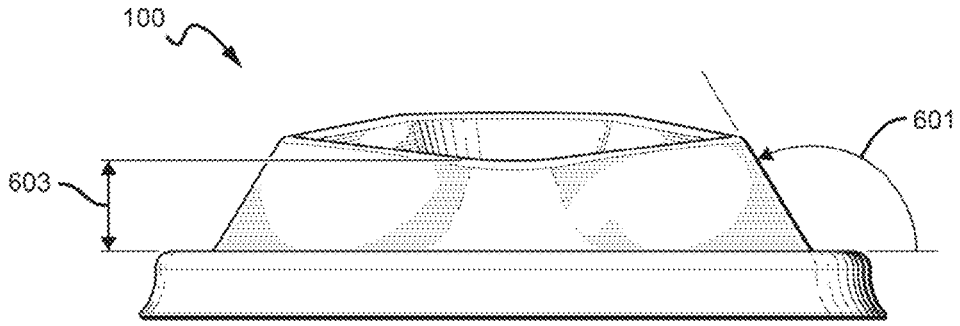
FIG. 6A is a back side view of the lid of FIG. 1.

FIG. 6A shows a back side view of lid 100 showing the aroma portion of the lid toward the front, and the drinking portion of lid 100 toward the back. FIG. 6A also shows a third angle 601, which is the angle between the outward-facing wall 312 of ridge 311 and a horizontal surface of the lid 100. Third angle 601 is about 135 degrees and provides a visible viewing angle for advertising text and logos (e.g., see FIG. 8B). The height of lid 100 (e.g., drinking portion lid height 503*a* and aroma portion lid height 503*b*) and third angle 601 together provide a visible advertising surface that can be simultaneously viewed by both the user (even when drinking from 100) and on lookers. In alternative embodiments, third angle 601 of lid 100 can be changed (e.g., 125 degrees, 150 degrees, etc.) to meet the user's preference. For example, in other embodiments, third angle 601 can be between 60 and 160 degrees, and more preferably between 90 and 145 degrees. Lid 100 can have a height 603 near aroma portion that that has a height measured from top surface of the outer rim to the top surface of the ridge near the aroma portion as shown in FIG. 6A of about 7/16 inch (about 1.111 centimeters). In other embodiments, height 603 can have a height between ⅛ to 3 inches (0.3175 to 7.62 centimeter), and more typically a height between ½ to 1½ inches (1.27 to 3.81 centimeters).

Figure 6B:
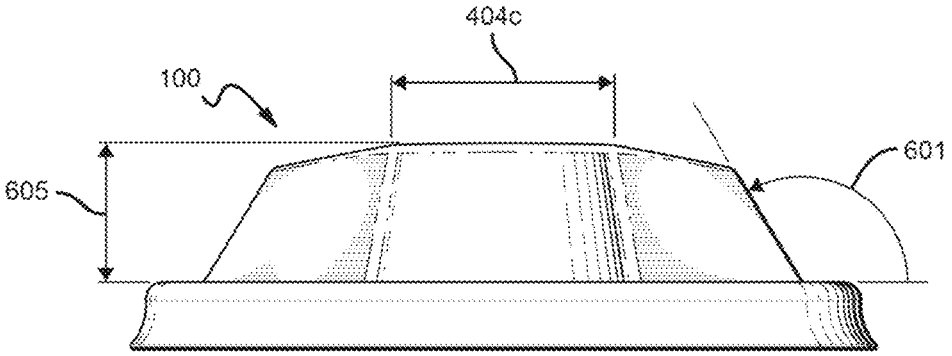
FIG. 6B is a front side view of the lid of FIG. 1.

FIG. 6B shows a front side view of lid 100 showing drinking portion dimension 404*c* of the drinking portion of lid 100. As discussed above, drinking portion dimension 404*c* can be a length between ½ to 2 inches (1.27 to 5.08 centimeters). Lid 100 can have a height 605 near drinking portion having a height measured from the top of the outer rim to the top surface of the ridge near drinking portion as shown in FIG. 6B of about 1 1/16 inches (about 1.746 centimeters). Other contemplated heights for height 605 are between 1/16 to 3 inches (0.1588 to 7.62 centimeter) and more typically ½ to 1½ inches (1.27 to 3.81 centimeters).

FIG. 7A shows a top view of lid 100 having a drinking portion outward-facing wall 702 and an aroma portion outward-facing wall 704. It is contemplated that drinking portion outward-facing wall 702 and aroma portion outward-facing wall 704 comprise different angles with respect to a horizontal plane. It should be appreciated that the angle difference between drinking portion outward-facing wall 702 and aroma portion outward-facing wall 704 allows users to quickly identify the drinking portion from the aroma portion. However, in other embodiments, drinking portion outward-facing wall 702 and aroma portion outward-facing wall 704 can comprise the same angle with respect to a horizontal surface on lid 100.

FIG. 7B shows a cross-sectional view of lid 100 across line 1-1 in the drinking portion as shown in FIG. 7A. It is contemplated that the angle of drinking portion outward-facing wall 702 is about 110 degrees with respect to a horizontal plane. However, in other embodiments, such angle can be between 30 to 160 degrees, and more preferably between 60 to 140 degrees. It should be appreciated that drinking portion outward-facing wall 702 can comprise the same angle or various angles, such that the slope of drinking portion outward-facing wall 702 can increase or decrease across its length.

It should be noted that ridge 311 has various characteristics that improve on traditional lids. For example, as noted above, a user can use the shape (e.g., pentagonal shape, etc.) of ridge 311 to identify a drinking portion on lid 100 without the need to look at lid 100. It is also contemplated that ridge 311 can function as a guard to reduce splashing. As shown in FIG. 7B, drinking portion outward-facing wall 702 and inward-facing wall 313 of ridge 311 form a rounded apex 722, and at least one of inward-facing wall 313, outward-facing wall 702, and rounded apex 722 can deflect liquid back into an attached container as shown in flow path 708. It is contemplated that rounded apex 722 can have a width 724 between 1/32 to ¼ inch (0.07938 to 0.635 centimeter) and more typically between 1/16 and ⅛ inch (0.1588 and 0.3175 centimeter) at or near the drinking portion. It is also contemplated that rounded apex 722 can have a slightly larger width 726 at or near the aroma portion. Drinking portion outward-facing wall 702 and inward-facing wall 313 can create a wave that returns liquid into the attached container. Thus, it should be noted that drinking portion outward-facing wall 702 and inward-facing wall 313 can be helpful to reduce spills and splashes when a user is moving, such as when a user is walking back to his seat at a sporting event with a drink, or when a user is in a moving vehicle (e.g., car, airplane).

FIG. 7C shows a cross-sectional view of lid 100 across the aroma portion. It is contemplated that the aroma portion comprises an angle between aroma portion outward-facing wall 704 and a horizontal plane that is about 135 degrees. However, in other embodiments, the angle can between 30 to 160 degrees, and more preferably between 60 to 140 degrees. Similar to drinking portion outward-facing wall 702, it should be appreciated that aroma portion outward-facing wall 704 can comprise the same angle or various angles, such that the slope of aroma portion outward-facing wall 704 increases or decreases across its length.

As shown in FIG. 7C, aroma portion outward-facing wall 704 and inward-facing wall 313 of ridge 311 form rounded apex 722. Aroma portion outward-facing wall 704 and inward-facing wall 313 forming rounded apex 722 can reduce spilling or splashing by deflecting liquid that contacts the bottom of lid 100 back into the attached container as shown in exemplary flow path 720. While inward-facing wall 313 and drinking portion outward-facing wall 702 and aroma portion outward-facing wall 704 form ridge 311 having rounded apex 722, it is contemplated that the apex can have other shapes (e.g., triangular, rectangular, etc.) suitable to deflect liquid from bottom of lid 100 and reduce spilling and splashing. It is contemplated that the size of rounded apex 722 is different between the drinking portion and the aroma portion.

FIG. 7D shows a cross-sectional view of lid 100 showing various dimensions of the bottom surface of lid 100. It is contemplated that lid 100 has an underside drinking portion length 710 with a length measured from opening 401 to the inside surface of outward-facing wall near the drinking portion as shown in FIG. 7D whereby contemplated lengths include a length between ⅛ to 2 inches (0.3175 to 5.08 centimeter), and more typically, between ¼ to 1 inch (0.635 to 2.54 centimeter).

It should be appreciated that the underside of lid 100 comprises features that improve the functionality of lid 100. For example, lid 100 comprises an underside gap 712, which is the area between opening 401 and the inside surface of the outward-facing wall. Underside gap 712 can reduce the risk of liquid immediately exiting through opening 401 to splash onto user when user drinks from a cup of liquid having lid 100. In other words, some of the liquid from a cup collects in underside gap 712 while another part of the liquid exits via opening 401 when a cup of liquid having lid 100 is tilted. Additionally, underside gap 712 can also reduce spilling or splashing by creating a wave that returns liquid back into the container as described in FIGS. 7B and 7C.

Underside gap comprises angle 714 that has an angle of about 30 degrees. However, angle 714 can range between 5 and 80 degrees, and more typically between 10 and 50 degrees. It should be appreciated that angle 714 helps control the speed of the flow exiting opening 401 when a user is drinking from a cup using lid 100 by increasing or decreasing the slope of the inward-facing wall in the sipping area.

The underside of lid 100 also comprises an aroma underside length 716 having a length measured from second opening 402 to an inside surface of outward-facing wall near the aroma portion as shown in FIG. 7D whereby contemplated lengths include a length between ¼ to 2 inches (0.635 to 5.08 centimeter), and more typically, between ½ to 1 inch (1.27 to 2.54 centimeters). Furthermore, the underside of lid 100 near aroma portion can have angle 718 of about 40 degrees. However, angle 718 can range between 5 and 80 degrees, and more typically between 20 and 60 degrees.

Figure 8A:
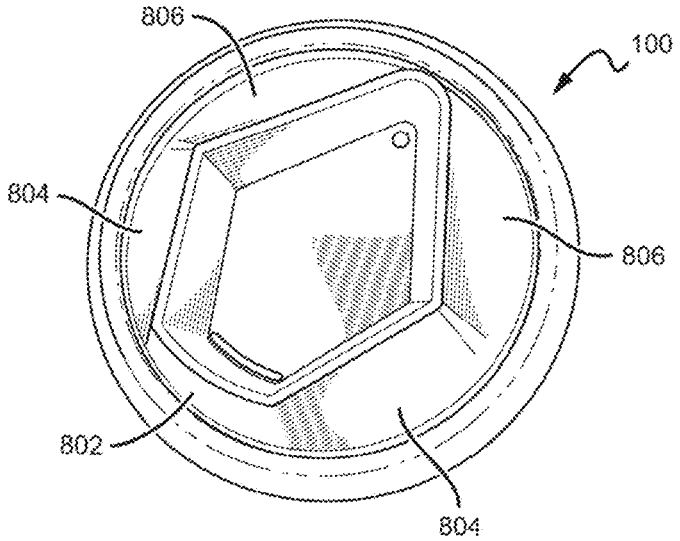
FIG. 8A is a top perspective view of the lid of FIG. 1.
Figure 8B:
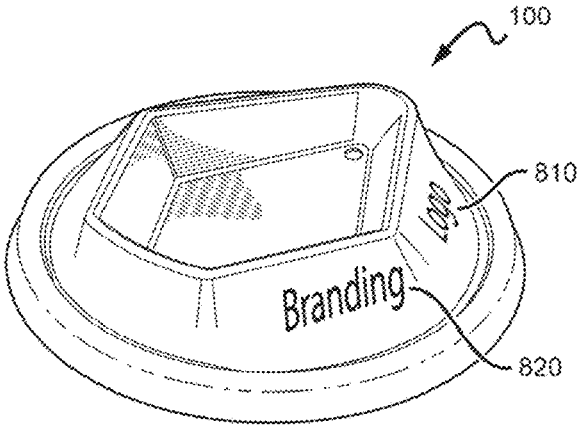
FIG. 8B is a top perspective view of the lid of FIG. 1 with a branding logo.
Figure 8C:
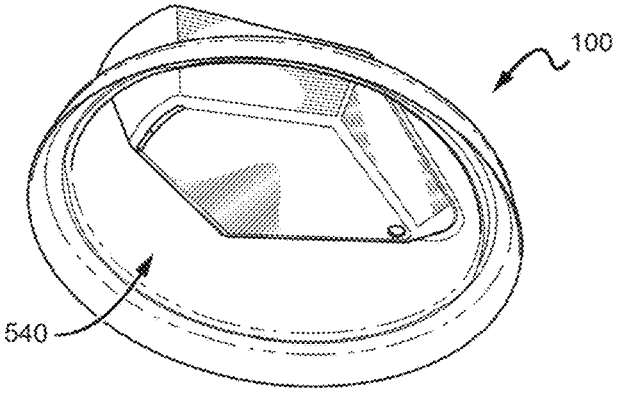
FIG. 8C is a bottom perspective view of lid of FIG. 1.

FIGS. 8A-8C shows various perspective views of lid 100 from various angles. FIG. 8A shows a top perspective view of lid 100 having various portions of outward-facing wall. For example, lid 100 can have a sipping portion outward-facing wall 802, a drinking portion outward-facing wall 804, and an aroma portion outward-facing wall 806. As discussed above, sipping portion outward-facing wall 802, drinking portion outward-facing wall 804, and aroma portion outward-facing wall 806 can have different angles to allow a user to quickly identify the drinking portion. However, it is also contemplated that the angles of sipping portion outward-facing wall 802, drinking portion outward-facing wall 804, and aroma portion outward-facing wall 806 are the same or at least one is different from the others.

FIG. 8B shows a side perspective view of lid 100, with optional logo 810 and optional branding 820. Those of ordinary skill in the art will appreciate that information other than logos and branding can be included on the outward facing surface of ridge 311. For example, the outward facing surface could include words, labels, warnings, slogans, website address, pictures, colors, matrix barcodes, Quick Response (BQ) codes, and radiofrequency identification (RFID) tags. The outward-facing surface of ridge 311 is angled such that the surface is easily visible to both the user of the lid and to those nearby.

FIG. 8C shows the underside of lid 100 having third opening 540. Third opening 840 is defined by outer rim 103 of lid 100. It is contemplated that third opening 540 is sized and dimensioned to receive a container to couple lid 100 to a container. Furthermore, it should be noted that the underside features of lid 100 allow for lid 100 to be stackable with other identical lids, thus optimizing space when storing multiple lids. Stackability provides numerous advantageous that are readily appreciated by those of ordinary skill in the art. However, in alternative embodiments, lid 100 need not be stackable. Stackability should not be construed to limit the inventive concepts unless specifically references in the claims.

FIG. 9 shows a side view of a user drinking liquid from lid 100. FIG. 9 also shows a liquid flow profile for lid 100. In addition, FIG. 9 shows the user's nose and mouth relative to lid 100. The user's mouth is close to opening 401 and the user's nose is close to second opening 402. As the liquid flows from opening 401 and across sipping area 315, the liquid aerates. Vapor 905 rises and is concentrated at the user's nose due to the shape of basin 310, thus enhancing the user's olfactory experience. The effect is further augmented as the user exhales through the nose, which causes the liquid to further aerate and circulates the pleasing aroma of the liquid upward to the user's nose.

Figure 10:
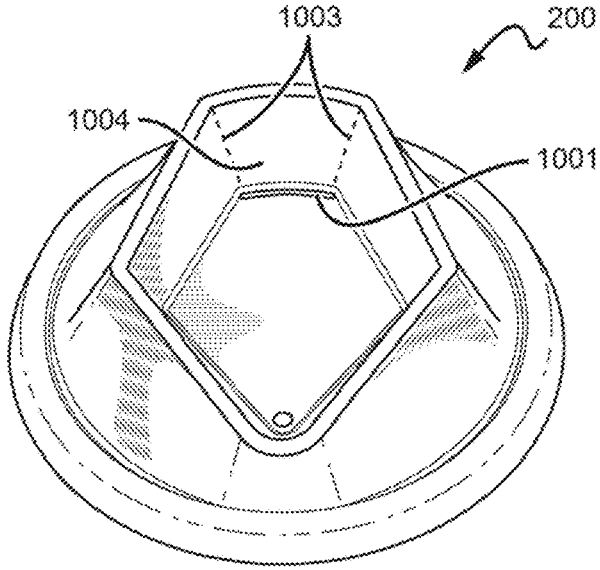
FIGS. 10-16 are perspective views of lids with basins and perforations for enlarging openings on the lid.

FIG. 10 shows another embodiment of a lid 200 with perforations 1003. When a user desires to enlarge opening 1001 to increase the flow of the liquid, the user can press down between perforations 1003 to simply widen the opening, and/or alternatively, the user can partially or completely remove a portion of the inward-facing wall 1004 of the drinking portion of lid 200. The user can control how much opening 1001 is enlarged by gradually pinching inward-facing wall 1004 and the outward facing wall with the thumb and index fingers. While lid 200 has perforations 1003, it is contemplated that various other tear lines can be used including a tear line comprising at least one of an incision, an indentation, and a solid tear line.

Figure 11:
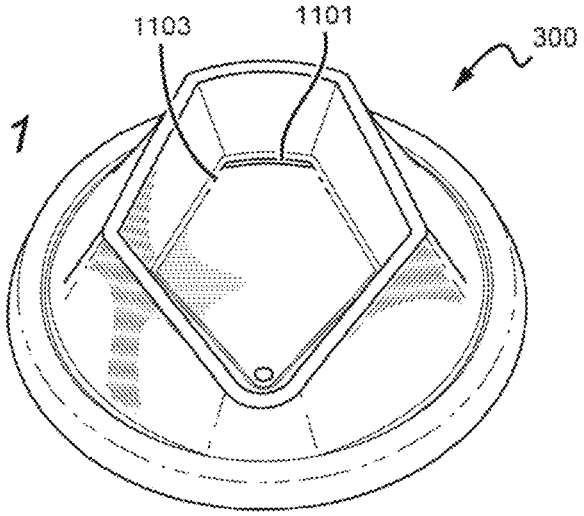

FIG. 11 shows another embodiment of a lid 300 with perforations 1103. When a user desires to enlarge opening 1101 to increase the flow of the liquid, the user can press down the valley in between perforations 1103 to simply widen the opening. In addition, the user can partially or completely remove a portion of the valley of the drinking portion of lid 300. While lid 300 has perforations 1103, it is contemplated that various other tear lines can be used including a tear line comprising at least one of an incision, a cut, an indentation, and a solid tear line.

Figure 12:
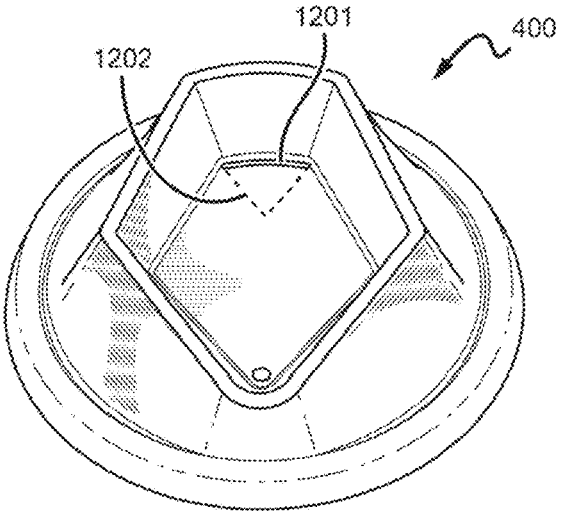
Figure 13:
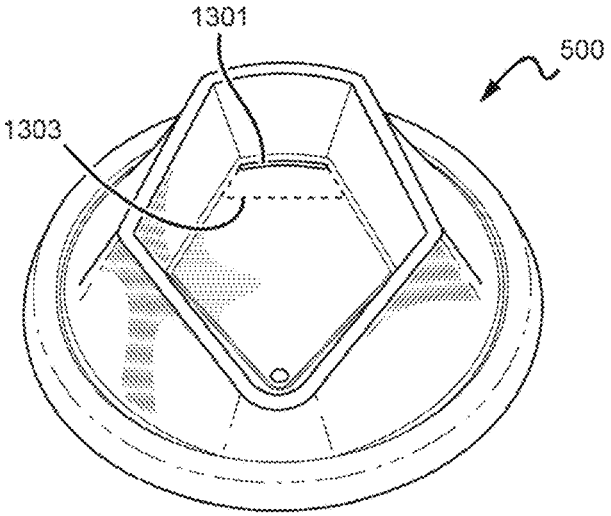

FIG. 12 shows another embodiment of a lid 400 and FIG. 13 shows another embodiment of a lid 500. In FIG. 12, perforations 1202 and opening 1201 are coupled to make a triangle shape, and are configured to make an enlarged opening when the user presses down a portion of valley surrounded by the opening 1201 and perforations 1202. The portions of the valley surrounded by the opening and perforation can be detached from the rest of the valley when they are pressed down. In FIG. 13, perforations 1303 and opening 1301 are coupled to make a trapezoid shape, and are configured to make an enlarged opening when the user presses down a portion of basin surrounded by the opening 1301 and perforations 1303. While perforations are used for lids 400 and 500, it should be appreciated that other tear lines are contemplated such as a tear line comprising at least one of an incision, an indentation, and a solid tear line.

Figure 14:
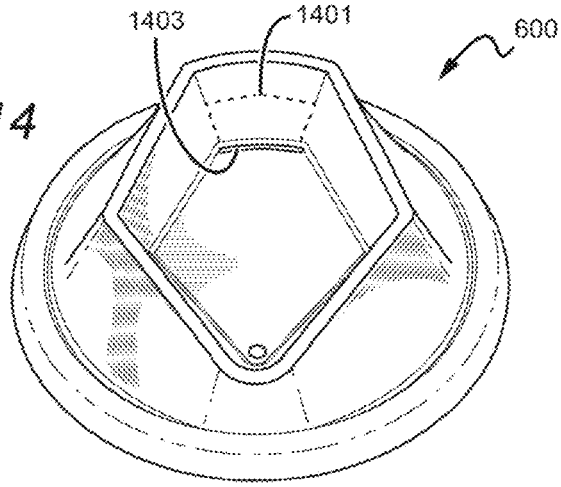

FIG. 14 shows another embodiment of a lid 600 with perforations 1401 on the inward facing wall of the drinking portion of lid 600. In this embodiment, perforations 1401 and opening 1403 are coupled to make a pentagonal shape, and are configured to make an enlarged opening when the user pinches the inward and outward facing walls of the perforated ridge. It is contemplated that many other suitable shapes can be formed using perforations 1401, such as a circular shape, a triangular shape, and a rectangular shape. While lid 600 has perforations 1401, it is contemplated that various other tear lines can be used including a tear line comprising at least one of an incision, an indentation, and a solid tear line.

Figure 15:
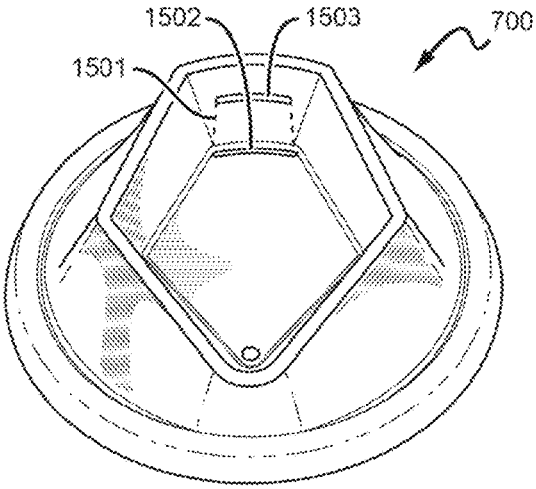

FIG. 15 shows another embodiment of a lid 700 with perforations 1501 on the inward facing wall of the drinking portion of lid 700. The perforations 1501 are coupled to an opening 1503 and an opening 1502 on the inward facing wall, and the user can enlarge the opening by pinching the outward and inward facing walls of the ridge. While lid 700 has perforations 1501, it is contemplated that various other tear lines can be used including a tear line comprising at least one of an incision, a cut, an indentation, and a solid tear line.

Figure 16:
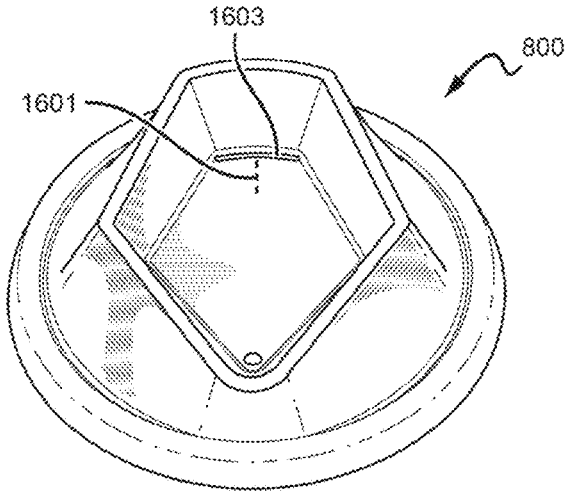

FIG. 16 shows another embodiment of a lid 800 with perforations 1601 on the valley. This embodiment enables a user to enlarge the opening 1603 in a triangular shape by pressing down perforations 1601. While lid 800 has perforations 1601, it is contemplated that various other tear lines can be used including a tear line comprising at least one of an incision, an indentation, and a solid tear line.

FIGS. 17A and 17B show various views of a lid 900. Lid 900 is similar to lid 100 except that it has a third circular opening 901 on the inward facing wall of the drinking portion of the lid in addition to a first opening 902 and a second opening 903. Distance 904 from the valley of the basin to the third circular opening 901 is approximately between 0.118 inches (0.2997 centimeters) to 0.394 inches (1.001 centimeters). The diameter of the third circular opening 901 is approximately 0.098 inches (approximately 0.2489 centimeter). When lid 100 is tilted and used for drinking a liquid (e.g., see FIG. 9), liquid flows out of third circular opening 901 and first opening 902. The liquid flowing from third circular opening 901 can act as a speed bump to slow down the liquid flowing from first opening 902. The exact size, shape, and position of third circular opening 901 can be adjusted, depending on the viscosity of the liquid and the situation (e.g., hot beverage, cold beverage, drinking while in motion, drinking while stationary, etc.)

FIG. 18A is another embodiment of a lid 1000. Lid 1000 also has a diamond shaped opening 1805 and a diamond shaped opening 1802 that allows a more controlled flow of the liquid to the user's mouth. More specifically, the liquid that exits at diamond shaped opening 1802 helps to control the flow of the liquid coming from opening 1803 by slowing down the liquid coming from opening 1803. Diamond shaped opening 1802 also helps to prevent the sudden rush of liquid caused by a break in a vacuumed seal or by an unexpected tilt or jolt of container 101 (e.g., such as when passing over a bump on the road while driving). Diamond shaped opening 1802 is located at a position of one third of the height of inward-facing wall from the valley of basin 1806 where opening 1803 is located. Other shapes are also contemplated for diamond shaped opening 1802, such as a triangle, a circle, a rectangle, and a square.

FIG. 18B shows a top view of lid 1000 with various dimensions labeled to provide a better illustration. Specific dimensions are not meant to restrict the scope of the subject matter presented unless otherwise specified in the claims. In some embodiments, opening 1803 can have an opening width 1814 of approximately 0.6 inches (approximately 1.524 centimeters) and an opening height 1810 of approximately 0.045 inches (approximately 0.1143 centimeter). The size and shape of opening 1803 allows delivery of the beverage with control for the user by reducing the chances of splattering. As discussed above, lid 1000 also has a diamond shaped opening 1805. Diamond shaped opening 1805 can have a width 1812 of approximately 0.05 inches (approximately 0.127 centimeter) and a height 1811 of approximately 0.19 inches (approximately 0.4826 centimeter).

Figure 19A:
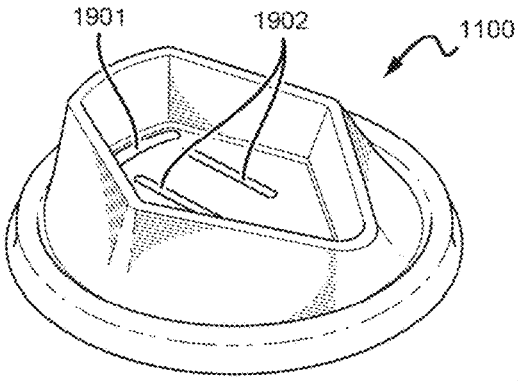
FIGS. 19A-B are perspective views of another embodiment of a lid with a basin.
Figure 19B:
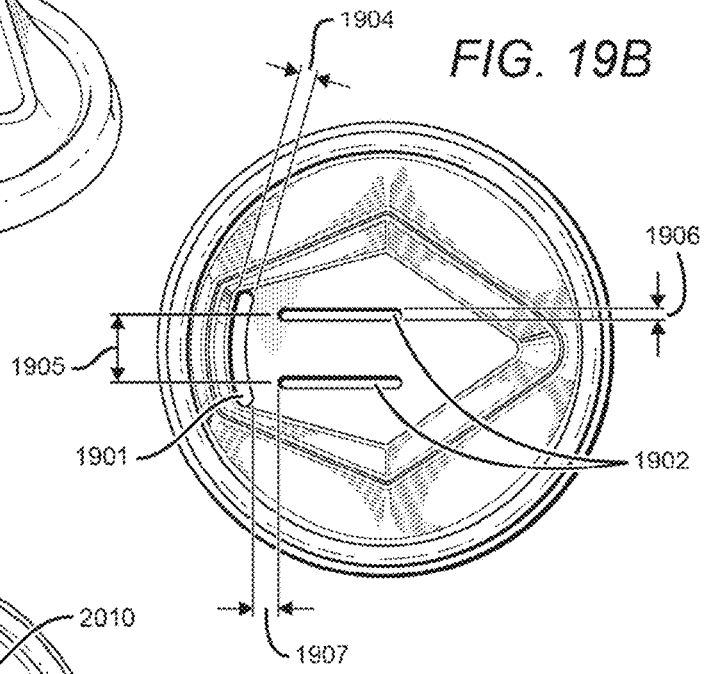

FIGS. 19A and 19B show another embodiment of a lid 1100, which has a third and a fourth slit openings 1902, which are parallel with each other, on the basin in addition to an opening 1901. Slit openings 1902 have a width 1906. Preferably, two additional slit openings 1902 are positioned lengthwise from the drinking portion to the aroma portion of the lid 1100. Yet, it is contemplated that the two slit openings can be placed at any angle relative to the length between the aroma portion and the drinking portion of lid 1100.

FIG. 19B shows a top view of lid 1100 with various dimensions labeled to provide a better illustration. In this embodiment, opening 1901 has a depth 1904 of approximately 0.045 inches (approximately 0.1143 centimeters). The size and shape of opening 1901 allows delivery of the beverage with control for the user by reducing the chances of splattering. Lid 1100 has slit openings 1902 on the basin. In this embodiment, two additional slit openings have an opening width, measured longitudinally from the drinking portion of the lid to the aroma portion of the lid, of approximately between 0.50 inches (1.27 centimeters) and 0.75 inches (1.905 centimeters). Width 1906 of at least one of the two additional openings is approximately 0.125 inches (approximately 0.3175 centimeters). The distance 1905 between two additional slit openings is approximately 0.50 inches (approximately 1.27 centimeters), and the distance 1907 between the first opening to at least one of the two additional slit openings is approximately 0.25 inches (approximately 0.635 centimeters). The slit openings 1902 help to enhance the user's olfactory experience, especially while the user gently blows down on opening 1901.

Figure 20A:
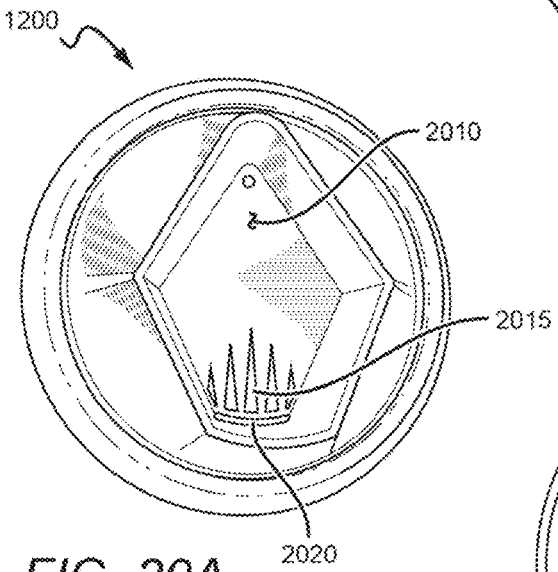
FIGS. 20A-B are perspective views of another embodiment of a lid with a basin.
Figure 20B:
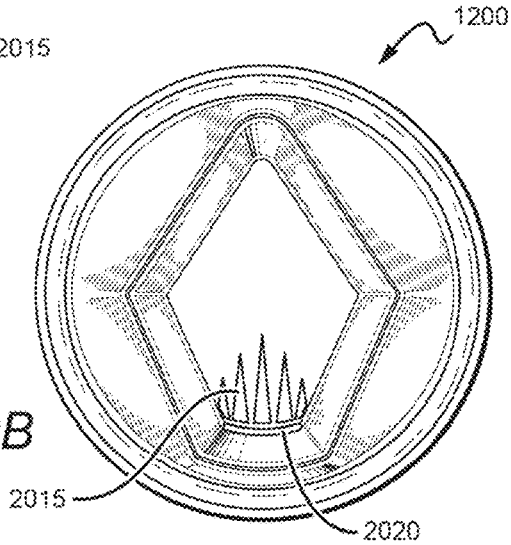

FIGS. 20A and 20B show perspective and top views, respectively, of a lid 1200. Lid 1200 has a basin 2010, which has a plurality of openings 2015 in addition to opening 2020. In this embodiment, the openings 2015 are triangular, where the triangle in the center has a larger dimension than other triangles located laterally. Openings 2015 are located juxtaposed to the opening 2020 so as to increase the size of opening for dispensing liquid and to increase aroma.

Figure 21A:
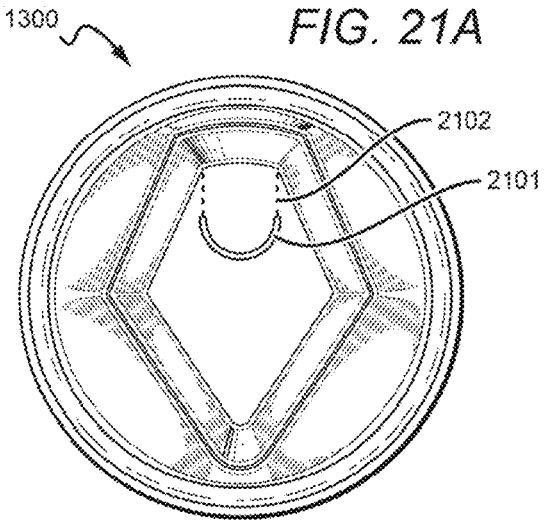
FIGS. 21A-B are perspective views of another embodiment of a lid with a basin.
Figure 21B:
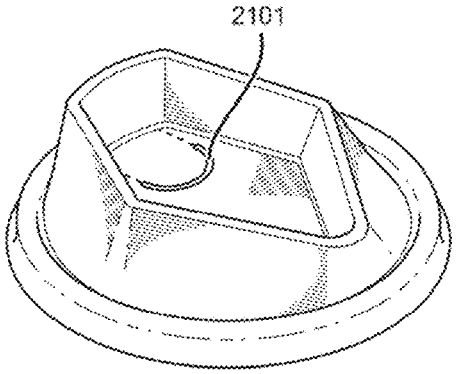

FIGS. 21A and 21B show another embodiment of a lid 1300. Lid 1300 has a ridge and/or opening 2101 on the basin valley, which can be pulled or pushed down to make a larger opening on the basin for dispensing liquid. Ridge and/or opening 2101 is coupled to perforations 2102 so that when ridge and/or opening 2101 is pulled or pushed down, a portion of basin surrounded by the ridge and perforations 2102 can be detached from the basin. The ridge is concave, however, in alternative embodiments the ridge could be linear, half-round, half-rectangular, or any other shape suitable to pinch, pull, or push down a portion of basin valley.

Figure 22A:
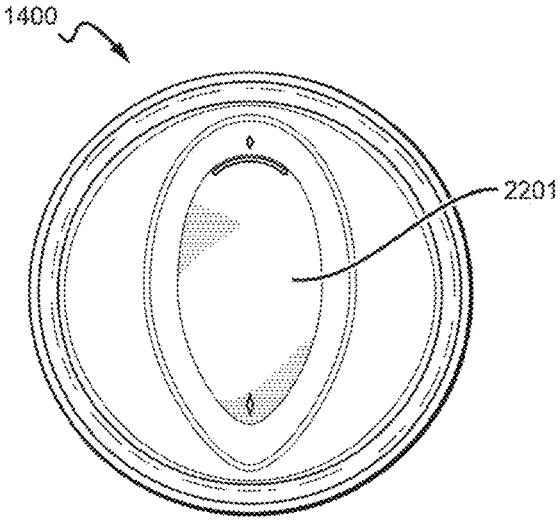
FIGS. 22A-B are perspective views of another embodiment of a lid with a basin.
Figure 22B:
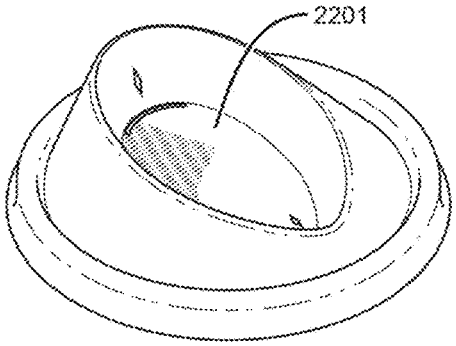

FIGS. 22A and 22B show a top view and a perspective view of another embodiment of a lid 1400, which has an egg-shaped basin 2201.

FIGS. 23A and 23B show a top view and a perspective view of another embodiment of a lid 1500. The lid 1500 has a triangular-shaped basin 2301 with a rounded side and a rounded corner.

FIGS. 24 and 25 show lid 2400 and lid 2500, respectively. Lid 2400 has a textured basin valley 2401 comprising a plurality of impressions (e.g., mounds, bumps, etc.) placed in a staggered/angled pattern. Lid 2500 has a textured basin valley 2501 comprising a plurality of circular ridges. The textured basin valleys help to retain a wet coating after wetted by the beverage, thus enhancing the olfactory experience even more.

It should be appreciated that the lids disclosed herein can include tear lines. As briefly discussed above, the tear lines can allow a user to enlarge the opening on the lid to increase the flow of the liquid from the cup. Additionally, or alternatively, the user can partially or completely remove the valley from the lid to provide a larger area for the user to access the inside of the cup. This is especially useful when a user has a lid attached to a container (e.g., bowl, cup, take out container, food storage container, etc.) having a beverage and/or a solid food product (e.g., a soup, noodles) where the valley can be at least partially removed so that utensils can be used to consume the products within the attached container without having to completely remove the lid.

FIG. 26A shows a lid 2600 having a basin 2601 defined by a ridge 2603 that at least partially surrounds a valley 2605 in a non-circular path (e.g., a pentagonal shape). Basin 2601 has a drinking portion and an aroma portion. The drinking portion comprises the area of basin 2601 that is near an opening 2607 on valley 2605, which includes ridge 2603 in that area. Typically, the drinking portion comprises the area of basin 2601 (including valley 2605) from ridge 2603 near opening 2607 to the center of basin 2601 (i.e., the lower half of basin 2601). However, in other typical embodiments, the drinking portion comprises the area of basin 2601 (including valley 2605) from ridge 2603 near opening 2607 to a top end of a first tear line 2609 (i.e., the end of first tear line 2609 that is furthest from opening 2607). As described above, the drinking portion can also comprise the area of the basin within a second length as described in FIG. 3.

The aroma portion can be the remaining area of basin 2601 besides the drinking portion. In other contemplated embodiments the aroma portion can comprise the area of basin 2601 between the center and the top end of ridge 2603 (i.e., the upper half of basin 2601). As described above, the aroma portion can also comprises the area of basin within first length as described in FIG. 3.

Lid 2600 comprises first tear line 2609 disposed on the drinking portion and a second tear line 2611 disposed on the aroma portion. At least one of first tear line 2609 and second tear line 2611 extends proximally along an intersection of an inward-facing wall 2613 of the ridge 2603 and valley 2605. It should be appreciated that proximally is defined as a distance of less than ¼ inch (0.635 centimeter), and more typically, less than ⅛ inch (0.3175 centimeters). In some embodiments, first tear line 2609 and second tear line 2611 extend along the intersection of inward-facing wall 2613 and valley 2605.

Valley 2605 comprises opening 2607 in the drinking portion. As described above, inward-facing wall 2613 adjacent to opening 2607 (i.e., the sipping area) can be concave (in a direction from tear fifth line 2619 to sixth tear line 2621) to help channel the flow of liquid for drinking. FIG. 26A shows valley 2605 and ridge 2603 that are non-circular, such that valley 2605 has a pentagonal shape that is surrounded by ridge 2603 also having a pentagonal-shaped path. Not only is ridge 2603 non-circular, but the outward facing surfaces and the inward facing surfaces of ridge 2603 are also non-circular. It should be noted that a non-circular path is the shape formed by ridge 2603 on lid 2600 using a top view perspective. For example, FIG. 26A shows that ridge 2603 forms a pentagonal shape from a top view perspective.

Other suitable non-circular shapes for valley 2605 and non-circular paths of ridge 2603 include a triangular shape, a trapezoidal shape, an oval shape, and a hexagonal shape, to name a few. However, in other embodiments, at least one of valley 2605 and ridge 2603 can be circular. It should be appreciated that the non-circular shape aids in identifying the drinking portion from the aroma portion without the need to look at the lid.

Opening 2607 is typically sized and dimensioned to allow a user to drink from a beverage in a container attached to lid 2600. However, in some circumstances, it may be desirable to enlarge opening 2607 to consume a beverage and/or food product in the container. Thus, opening 2607 can be enlarged when first tear line 2609 is ruptured. It is contemplated that first tear line 2609 can extend to opening 2607 at one end.

In contemplated embodiments, a third tear line 2615 can be disposed in the drinking portion. For example, first tear line 2609 and third tear line 2615 can extend to opening 2607 to allow a user to enlarge opening 2607, such that the flow of liquid from the container is increased and the user has an enlarged area to access the inside of the container without the need to remove the lid. However, in other embodiments, it is contemplated that only first tear line 2609 or third tear line 2615 extends to opening 2607, or that neither first tear line 2609 nor third tear line 2615 extends to opening 2607.

First tear line 2609 and third tear line 2615 typically extend from opening 2607 or an area adjacent to opening 2607 to a distance (e.g., ¼ inch (0.635 centimeter), ⅛ inch (0.3175 centimeter)) before the intersection where ridge 2603 forms a crease on inward-facing wall between the aroma portion and the drinking portion (i.e., the point where ridge 2603 begins to taper inward in aroma portion). It should be appreciated that by extending first tear line 2609 and third tear line 2615 up to a distance from the point where ridge 2603 forms the crease, the risk of a rupture deviating from the tear lines onto inward-facing wall 2613 is substantially reduced. The same principle applies to second tear line 2611 and a fourth tear line 2617 in the aroma portion with respect to extending up to a distance from the point where ridge 2603 forms a crease between the drinking portion and the aroma portion.

Third tear line 2615 can extend proximally along an intersection of inward-facing wall 2613 and valley 2605. However, in other embodiments, third tear line 2615 can extend along the intersection of inward-facing wall 2613 and valley 2605. Although not shown in FIG. 26A, it is contemplated that first tear line 2609 and third tear line 2615 can connect to form a single tear line.

Lid 2600 can also include a fourth tear line 2617 in the aroma portion. Fourth tear line 2617 can extend proximally along the intersection of inward-facing wall 2613 and valley 2605 as shown in FIG. 26A. For example, fourth tear line 2617 can extend along the intersection of inward-facing wall 2613 and valley 2605. Second tear line 2611 and fourth tear line 2617 can extend proximally along the intersection of inward-facing wall 2613 and valley 2605, such that a user can remove the upper half of valley 2605 when the second tear line 2611 and fourth tear line 2617 are ruptured. It is contemplated that at least one of second tear line 2611 and fourth tear line 2617 can extend to connect second tear line 2611 and fourth tear line 2617 and form a single tear line.

Lid 2600 can further comprise a fifth tear line 2619 disposed on inward-facing wall 2613 in the drinking portion. However, in other contemplated embodiments, fifth tear line 2619 can be disposed in the aroma portion. While fifth tear line 2619 is shown on inward-facing wall 2613, fifth tear line 2619 can also be disposed on an outward-facing wall 2639 of ridge 2603 in either the drinking portion or the aroma portion. For example, fifth tear line 2619 can extend from inward-facing wall 2613 to the outward-facing wall 2639 to allow the user to tear a portion of ridge 2603.

Fifth tear line 2619 can extend from opening 2607 to allow a user to enlarge opening 2607 and increase a flow of liquid from a container attached to lid 2600. Additionally, or alternatively, at least one of first tear line 2609 and fifth tear line 2619 can extend to connect first tear line 2609 and fifth tear line 2619 and form a single tear line. Thus, a user can enlarge opening 2607 by at least one of pulling valley 2605 near opening 2607 in an upward motion to rupture first tear line 2609 and third tear line 2615, and pinching an area of inward-facing wall 2613 and outward-facing wall 2639 to rupture fifth tear line 2619.

Lid 2600 can have a sixth tear line 2621 disposed on inward-facing wall 2613. Similar to fifth tear line 2619, sixth tear line 2621 can also be disposed on the outward-facing wall 2639 of ridge 2603. It is also contemplated that sixth tear line 2621 can extend to opening 2607 to allow a user to enlarge opening 2607 and increase a flow of liquid. Additionally, or alternatively, at least one of third tear line 2615 and sixth tear line 2621 can extend to connect third tear line 2615 and sixth tear line 2621 to form a single tear line.

It should be noted that many suitable structures are contemplated for the tear lines discussed in the various embodiments, including a perforation, an incision, a cut, an indentation, and a solid tear line. A perforation or plurality of perforations comprises holes or a row of holes punched in lid 2600 that allows a user to rupture the lid along the plurality of perforations. An incision comprises a slit through lid 2600 having solid end points so that a user can rupture at least one of the solid end points to enlarge an opening. An indentation comprises a notch on lid 2600 that does not penetrate through the surface of lid 2600 but creates a weak point so that a user can rupture lid 2600 along the indentation. A solid tear line comprises a material property (e.g., weaker material than surrounding area, thinner cross-section than surrounding area, etc.) that creates a weak point on lid 2600 so that a user can rupture lid 2600 along the solid tear line.

Lid 2600 can be designed to incorporate the many features described in the other embodiments above. For example, lid 2600 can comprise ridge 2603 having an outward-facing wall 2639 with (i) a first section near the drinking portion that intersects a horizontal plane at a first angle, and (ii) a second section near the aroma portion that intersects the horizontal plane at a second angle, and wherein the first angle and second angle are different as shown in FIG. 5B. Such embodiment can further comprise a third section of the outward-facing wall 2639 that intersects a horizontal plane at a third angle, wherein two of at least the first, second, and third angle are different.

While FIG. 26A shows lid 2600 having first tear line 2609, second tear line 2611, third tear line 2615, fourth tear line 2617, fifth tear line 2619, and sixth tear line 2621, it should be appreciated that contemplated lids can have more or less tear lines. For example, it is contemplated that lid 2600 can consists of only first tear line 2609 and third tear line 2615. In another example, it is contemplated that lid 2600 can consists of only second tear line 2611 and fourth tear line 2617. In yet another example, first tear line 2609, second tear line 2611, third tear line 2615, and fourth tear line 2617 can extend proximally along the intersection of inward-facing wall 2613 and valley 2605, such that first tear line 2609, second tear line 2611, third tear line 2615, and fourth tear line 2617 at least partially extend along a perimeter of valley 2605 to allow a user to completely remove valley 2605 via the tear lines.

As discussed above, opening 2607 can be enlarged using the various tear lines on lid 2600. A user can pull in an upward motion on opening 2607 to rupture first tear line 2609 and third tear line 2615 as shown in FIG. 26B. It should be appreciated that second tear line 2611 and fourth tear line 2617 (underneath valley 2605) remain intact, such that valley 2605 is partially removed to enlarge opening 2607. Enlarged opening 2607 in FIG. 26B provides a larger area for a user to access the items within the container. For example, lid 2600 can be attached to a bowl whereby the enlarged area of opening 2607 allows a user to access the food product within the bowl using utensils. Furthermore, the enlarged area of opening 2607 can allow hot beverages/food to cool to a comfortable temperature by allowing hot vapors to escape.

Valley 2605 comprises a flexible material so that valley 2605 can be folded over onto the aroma portion. In other embodiments, valley 2605 can comprise a rigid material. It is contemplated that valley 2605 is sized and dimensioned to fold over and remain in the aroma portion due to a friction fit between the perimeter of valley 2605 and inward-facing wall 2613 near aroma portion as shown in FIG. 26B. However, in other embodiments, it is contemplated that valley 2605 in the drinking portion can be folded over and coupled onto valley 2605 in the aroma portion so that valley 2605 is maintained in a folded configuration. It should be appreciated that maintaining valley 2605 in a folded configuration allows users to access the food products in the container coupled to lid 2600 via opening 2607 without the need to fold valley 2605 onto the aroma portion each time to enlarge opening 2607.

As shown in FIG. 26B, fifth tear line 2619 and sixth tear line 2621 can remain intact when rupturing first tear line 2609 and third tear line 2615. However, it is contemplated that a user can rupture fifth tear line 2619 and sixth tear line 2621 by pinching an area of inward-facing wall 2613 and outward-facing wall 2639 of ridge 2603 to enlarge opening 2607. Once opening 2607 is enlarged by rupturing fifth tear line 2619 and sixth tear line 2621, it may be easier to pull valley 2605 in an upward motion to rupture first tear line 2609 and third tear line 2615 to further enlarge opening 2607. Additionally, by rupturing fifth tear line 2619 and sixth tear line 2621, a user can now consume entrapped beverage and/or food product in underside gap of ridge 2603 (see, e.g., 712 in FIG. 7D).

Although opening 2607 has been enlarged in FIG. 26B, it is contemplated that opening 2607 can be further enlarged so as to remove valley 2605 from lid 2600. Once first tear line 2609 and third tear line 2615 have been ruptured, valley 2605 can be further pulled in an upward motion to rupture second tear line 2611 and fourth tear line 2617 and remove valley 2605 as shown in FIG. 26C. Opening 2607 in FIG. 26C is now enlarged to encompass the area where valley 2605 was disposed. It should be appreciated that opening 2607 in FIG. 26C is now enlarged to provide a greater area for a user to access the contents in a container attached to lid 2600. Additionally, hot beverages/food can be cooled to a comfortable temperature by allowing the hot vapors escape through opening 2607. While opening 2607 has been enlarged using tear lines discuss above, it is contemplated that lid 2600 can be manufactured having a portion of the valley removed or having the valley completely removed as shown in some of the embodiments below.

It should be appreciated that lid 2600 as shown in FIG. 26C can additionally function as a splash guard. Lid 2600 comprises ridge 2603 having inward-facing wall 2613 and outward-facing wall 2639 that extend in an upward direction from the base of lid 2600. Ridge 2603 typically extends above the upper rim of a container when lid 2600 couples the container. Moreover, inward-facing wall 2613 and outward-facing wall 2639 form a rounded apex that reduces splashing as explained in FIG. 7B. Thus, the risk of splashing food/liquid from an attached container is substantially reduced by ridge 2603 even though opening 2607 is substantially enlarged.

Figure 26D:
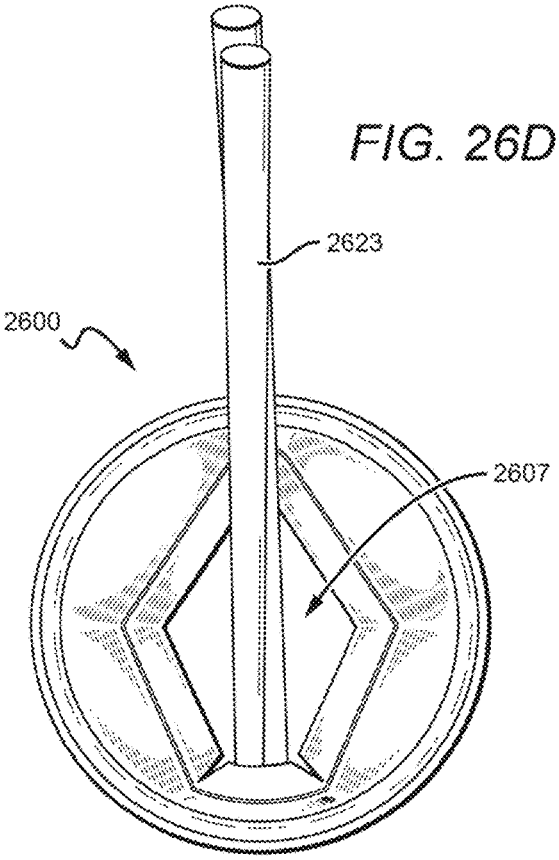

It is contemplated that valley 2605 is sized and dimensioned to allow a user to access contents within a container (e.g., bowl, cup, take out container, food storage container, etc.) coupled to lid 2600 using utensils 2623 without the need to completely remove lid 2600 as shown in FIG. 26D. A user can drink liquid within a container coupled to lid 2600 through opening 2607 as shown in FIG. 26A. Opening 2607 can then be enlarged to accommodate the viscosity of the liquid in the container and/or allow user to consume solid food items that are larger than opening 2607 in FIG. 26A by at least one of (i) rupturing either first tear line 2609 and third tear line 2615 as shown in FIG. 26B, and (ii) rupturing fifth tear line 2619 and sixth tear line 2621. Additionally, or alternatively, valley 2605 can be completely removed as shown in FIG. 26C, and utensils 2623 can be used to consume the contents within the container attached to lid 2600. Suitable utensils 2623 include chopsticks, a spoon, a fork, a knife, a straw, and other devices used to consume food and beverages.

Figure 27:
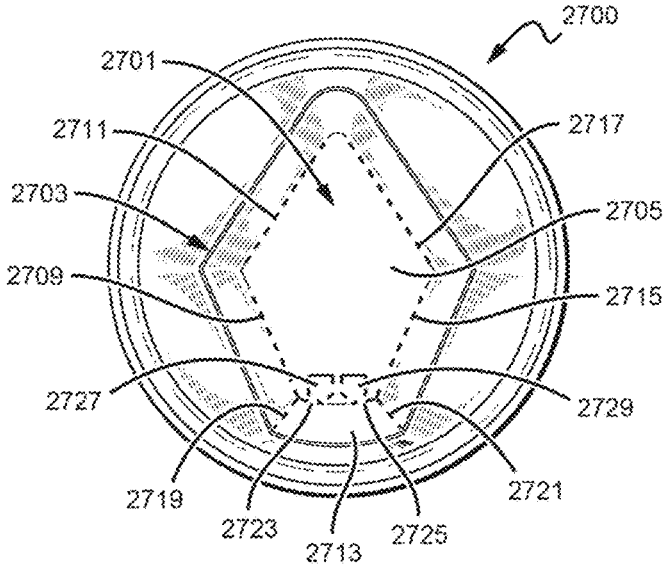
FIG. 27 is a perspective view of an embodiment of a lid having tear lines and flaps.

FIG. 27 shows an embodiment of a lid 2700 have a plurality of tear lines. Similar to the lid of FIG. 26A, lid 2700 has a basin 2701 defined by a ridge 2703 that at least partially surrounds a valley 2705 in a non-circular path.

Basin 2701 comprises a drinking portion and an aroma portion. A first tear line 2709 is disposed on the drinking portion and a second tear line 2711 is disposed on the aroma portion. FIG. 27 shows that first tear line 2709 and second tear line 2711 are disposed proximally along an intersection of an inward-facing wall 2613 of ridge 2703 and valley 2605. However, it is contemplated that one of first tear line 2709 and second tear line 2711 are disposed proximally along an intersection of an inward-facing wall 2613 of ridge 2703 and valley 2605.

Lid 2700 can also comprise a third tear line 2715 disposed in the drinking portion and a fourth tear line 2717 disposed on the aroma portion. Additionally, or alternatively, lid 2700 can further comprise a fifth tear line 2719 and a sixth tear line 2721 disposed on inward-facing wall 2613. It should be appreciated that the same features described in the tear lines of the other embodiments can be incorporated herein.

Unlike some of the lids described above, lid 2700 does not have an opening in the drinking portion. However, an opening can be created in the drinking portion to allow a user to drink a liquid from a container coupled to lid 2700. Drinking portion further comprises a seventh tear line 2723 and an eighth tear line 2725 that extend proximally along an intersection of inward-facing wall 2713 and valley 2705.

Seventh tear line 2723 can connect first tear line 2709 and fifth tear line 2719 to form a continuous tear line along valley 2705 and inward-facing wall 2713. Similarly, eighth tear line 2725 can connect third tear line 2715 and sixth tear line 2721 to form a continuous tear line along valley 2705 and inward-facing wall 2713. Thus, one can pinch an area of inward-facing wall 2713 and an outward-facing wall in the drinking portion to rupture fifth tear line 2719, sixth tear line 2721, seventh tear line 2723, and eighth tear line 2725 to create an opening. Valley 2705 can be partially or completely removed from lid 2700 in the same manner as described in the embodiments above.

Lid 2700 can further comprise a first flap 2727 and a second flap 2729 disposed on valley 2705 in the drinking portion. First flap 2727 and second flap 2729 comprise tear lines around a portion of the perimeter, such that another portion of the perimeter without tear lines acts as a hinge. At least one of first flap 2727 and second flap 2729 can be sized and dimensioned to receive a utensil. For example, first flap 2727 and second flap 2729 can be sized and dimensioned to receive a chopstick, such that chopsticks are held by lid 2700 before a user uses them to consume food within an attached container. However, in other embodiments, it is contemplated that a single flap can be used in place of first flap 2727 and second flap 2729. Additionally, or alternatively, lid 2700 can have an opening in the drinking portion that is sized and dimensioned to receive a utensil.

Figure 28A:
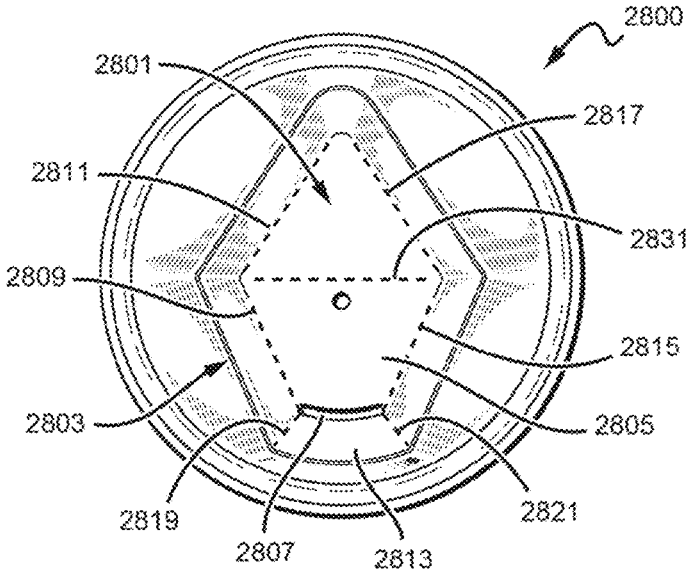
FIGS. 28A-28F are perspective view of an embodiment of a lid having various tear lines, including a valley tear line.

FIG. 28A shows another embodiment of a lid 2800 having tear lines. Lid 2800 comprises a basin 2801 defined by a ridge 2803 that at least partially surrounds a valley 2805, wherein the basin has a drinking portion and an aroma portion. A first tear line 2809 is disposed on the drinking portion and a second tear line 2811 is disposed on the aroma portion. As shown in FIG. 28A, first tear line 2809 and second tear line 2811 can extend along an intersection of an inward-facing wall 2813 and valley 2805. However, in other embodiments, at least one of first tear line 2809 and second tear line 2811 can extend proximally to the intersection of inward-facing wall 2813 and valley 2805.

Similar to some of the other embodiments described above, lid 2800 can have a third tear line 2815 in the drinking portion and a fourth tear line 2817 in the aroma portion. It is contemplated that at least one of third tear line 2815 and fourth tear line 2817 is disposed proximally to an intersection of inward-facing wall 2813 and valley 2805. Additionally, or alternatively, lid 2800 can further comprise a fifth tear line 2819 and a sixth tear line 2821 disposed on inward-facing wall 2813 in the drinking portion. It should be appreciated that the same features described in the tear lines of the other embodiments can be incorporated herein. Thus, first tear line 2809, second tear line 2811, third tear line 2815, fourth tear line 2817, fifth tear line 2819, and sixth tear line 2821 can be designed and used as discussed above to enlarge an opening 2807 on valley 2805 in the drinking portion.

Lid 2800 further comprises a valley tear line 2831 disposed on valley 2805 between first tear line 2809 and second tear line 2811. In contemplated embodiments, valley tear line 2831 extends proximally along the center of valley 2805. However, it is contemplated that valley tear line 2831 can be disposed in other areas of valley 2805, such as in the drinking portion, aroma portion, or proximal to opening 2807. Valley tear line 2831 does not typically connect with any one of first tear line 2809, second tear line 2811, third tear line 2815 and fourth tear line 2817 as shown in FIG. 28A. In other embodiments, valley tear line 2831 can connect with at least one of first tear line 2809, second tear line 2811, third tear line 2815 and fourth tear line 2817. It should be noted that although valley tear line 2831 does not connect with other tear lines on valley 2805, it is contemplated that valley tear line 2831 is sized and dimensioned to allow a user to remove at least one of the top half and bottom half of valley 2805.

Figure 28B:
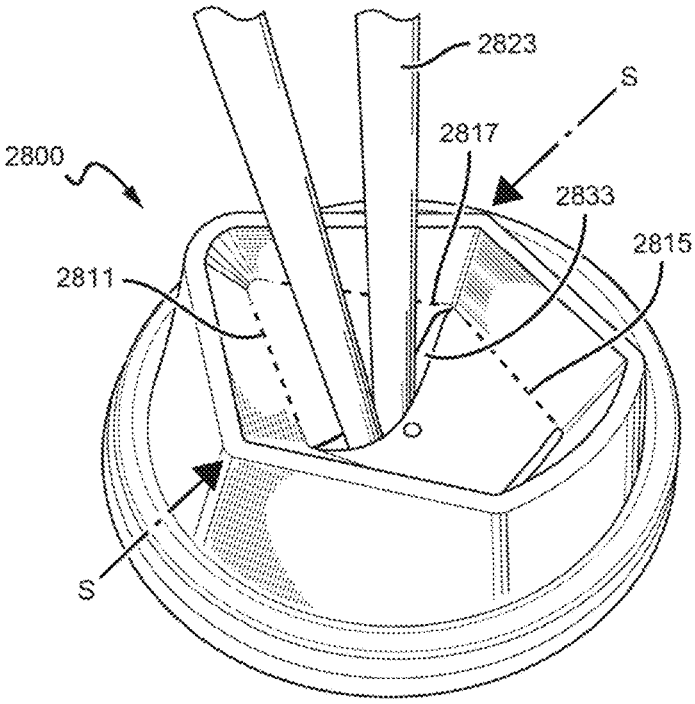

Valley tear line 2831 can comprise various suitable structures as described above. For example, valley tear line 2831 can comprise at least one of a plurality of perforations, an incision, an indentation, and a solid tear line. Regardless of the particular structure, it is contemplated that valley tear line 2831 can be at least be partially ruptured to create a valley opening 2833 as shown in FIG. 28B. One suitable manner of rupturing valley tear line 2831 is to pinch a first area of an outward-facing wall and a second area of the outward-facing wall that is opposite of the first area as designated by the two opposing dotted lines S. Once valley tear line 2831 is ruptured, then valley opening 2833 can be used to maintain utensils 2823. Furthermore, valley opening 2833 can be used to vent hot vapors to cool hot beverage/food within an attached container.

Figure 28C:
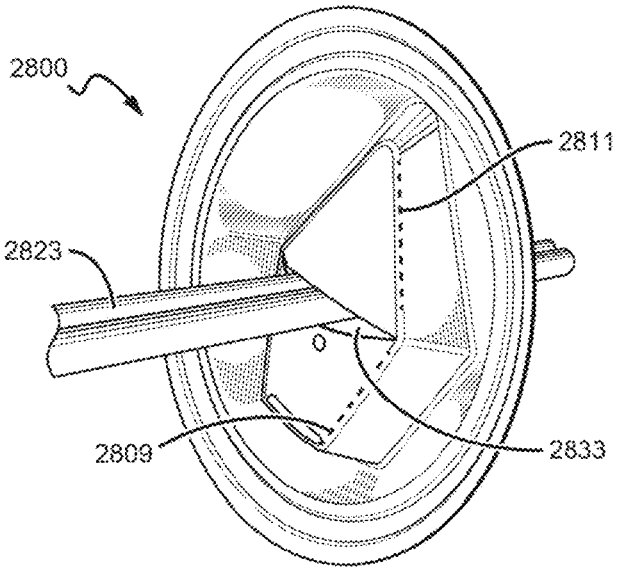
Figure 28D:
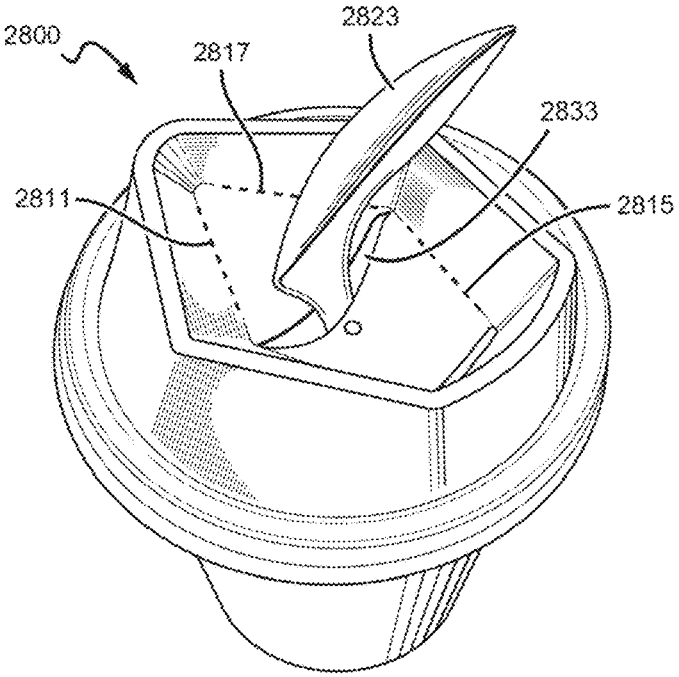

FIG. 28C shows a bottom perspective view of lid 2800 having utensils 2823 disposed within valley opening 2833. As shown in FIG. 28C, first tear line 2809 and second tear line 2811 can remain intact. While utensils 2823 are shown as chopsticks in FIG. 28C, it is contemplated that other utensils that can be used include a spoon (as shown in FIG. 28D), a straw, a fork, a knife, and any other device used to consume a food or beverage.

Valley tear line 2831 allows a user to at least partially remove valley 2805 in a number of different ways. For example, valley 2805 can be at least partially removed to enlarge opening 2807 by pulling valley 2805 near opening 2807 in an upward motion to rupture first tear line 2809 and third tear line 2815. Valley 2805 can be completely removed by pulling valley 2805 further in an upward motion to rupture second tear line 2811 and fourth tear line 2817 as described in the embodiments above (see, e.g., FIGS. 26A-C).

Figure 28E:
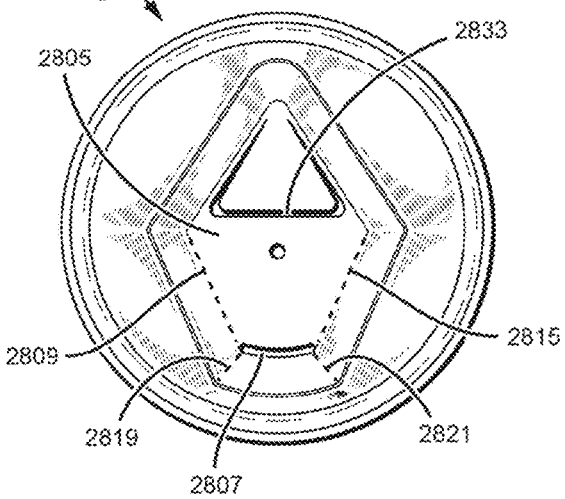

In another example, valley 2805 can be removed in portions using valley tear line 2831. A user can pinch portions of the outward-facing wall as described above to rupture valley tear line 2831. It is also contemplated that a user can push down on the surface of valley 2805 in either the drinking portion or the aroma portion to rupture valley tear line 2831 and create valley opening 2833. The user can then pull valley 2805 in an upward motion or push valley 2805 in a downward motion in either the drinking portion or aroma portion to at least partially rupture first tear line 2809 and third tear line 2815 or second tear line 2811 and fourth tear line 2817, respectively. FIG. 28E shows valley at least partially removed in the aroma portion where valley tear line 2831 is ruptured, and second tear line 2811 and fourth tear line 2817 are partially ruptured. It should be appreciated that valley opening 2833 is enlarged in FIG. 28E, which can allow hot vapors to escape of a hot beverage and/or food product. Additionally, or alternatively, valley opening 2833, when enlarged, can be used to access the contents within an attached container using utensils.

Figure 28F:
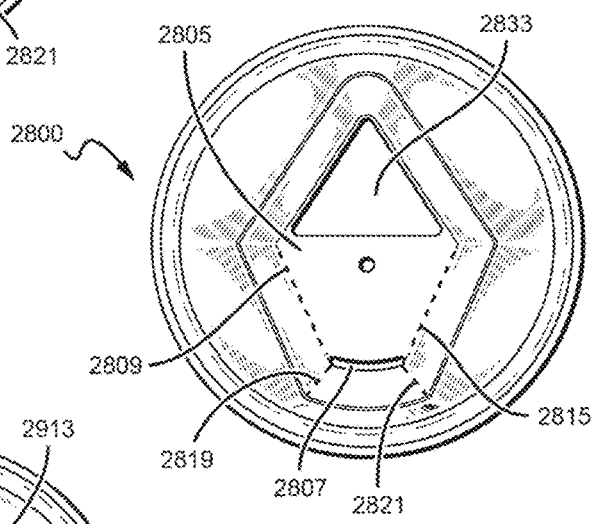

Valley 2805 that is partially removed in the aroma portion as shown in FIG. 28E can be left as a flap. This prevents a beverage and/or food product from within an attached container to lid 2800 from splashing out of valley opening 2833. However, in other embodiments, it may be desirable to completely remove a portion of valley as shown in FIG. 28F. In FIG. 28F, valley opening 2833 is unobstructed from valley 2805 in aroma portion since that portion of valley 2805 has been removed. Thus, a user can access the contents of an attached container using utensils and can enjoy an enhanced olfactory experience when sipping on the contents from the attached container via opening 2807 due to enlarged valley opening 2833 in FIG. 28F.

It should be appreciated that the entire valley can be removed from lid 2800 in FIG. 28F. A user can pull valley 2805 remaining on lid 2800 in an upward motion or push valley 2805 in a downward motion to rupture first tear line 2809 and third tear line 2815. The user can pull on valley 2805 from either the side adjacent to valley opening 2833 or the side adjacent to opening 2807.

Furthermore, it is contemplated that a user can remove valley 2805 in the drinking portion by rupturing first tear line 2809, third tear line 2815, and valley tear line 2831, and leave valley 2805 disposed in the aroma portion intact. In such embodiment, the user can remove the entire valley by pulling in an upward motion or pushing downward on valley 2805 that remains in the aroma portion. A user can further enlarge opening 2807 by pinching a portion of the outward-facing wall and the inward-facing wall in the drinking portion to rupture fifth tear line 2819 and sixth tear line 2821. In embodiments that do not have opening 2807, it is contemplated that valley tear line 2831 can be pulled in an upward motion to rupture first tear line 2809 and third tear line 2815, and can be further pulled to rupture fifth tear line 2819 and sixth tear line 2821. In such embodiments, it is contemplated that a tear line can be disposed on the apex of ridge 2803, such that the portion of valley 2805 and inward-facing wall 2813 partially removed by rupturing valley tear line 2831, first tear line 2809, third tear line 2815, fifth tear line 2819, and sixth tear line 2821 can be completely removed by rupturing the tear line on the apex of ridge 2803 to create an enlarged opening in the drinking portion.

Figure 29:
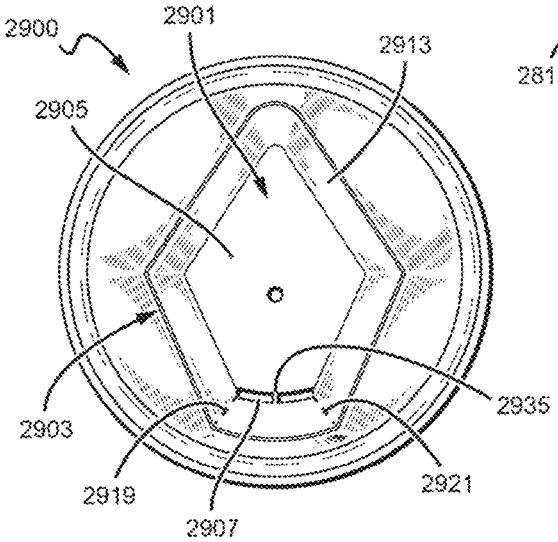
FIG. 29 is a perspective view of an embodiment of a lid having tear lines and a connector.

FIG. 29 shows an embodiment of a lid 2900 having various tear lines. Similar to the other lids described above, lid 2900 has a basin 2901 defined by a ridge 2903 that surrounds a valley 2905, wherein the basin has a drinking portion and an aroma portion. Lid 2900 has an opening 2907 disposed in the drinking portion, and a first tear line 2919 and a second tear line 2921 disposed on an inward-facing wall 2913. While lid 2900 has less tear lines than some of the embodiments described above, it is contemplated that lid 2900 can comprise additional tear lines as described in those embodiments (see, e.g., FIGS. 26A, 27, 28A).

Lid 2900 can further include a connector 2935 disposed in opening 2907 and coupled to inward-facing wall 2913 and valley 2905. Connector 2935 can reduce the risk of accidently enlarging opening 2907 by providing a structure that connects inward-facing wall 2913 and valley 2905. Additionally, connector 2935 is configured to generate a pop sound and/or snap which alerts the user that opening 2907 is enlarged. For example, a user can pinch an area of inward-facing wall 2913 and an area of outward-facing wall near drinking portion to snap connector 2935 and rupture first tear line 2919 and second tear line 2921, and enlarge opening 2907. It should be appreciated that connector 2935 can be incorporated in the other lid embodiments described (see, e.g., FIGS. 26A, 27, 28A) herein to generate a pop sound and/or snap when the first tear line and the third tear line in the drinking portion are ruptured and/or when the fifth tear line and sixth tear line on the inward-facing wall are ruptured.

FIG. 30 shows an embodiment of a lid 3000 having a first tear line 3009. Lid 3000 has a basin 3001 that is defined by a ridge 3003 that at least partially surrounds a valley 3005 in a non-circular path. Basin 3001 has a drinking portion and an aroma portion. First tear line 3009 is disposed in the drinking portion and extends along an intersection of an inward-facing wall 3013 and valley 3005. A second tear line 3019 and a third tear line 3021 are disposed on inward-facing wall 3013. Second tear line 3019 extends away from a first end 3022 of first tear line 3009 and third tear line 3021 extends away from a second end 3024 of first tear line 3009. While each of second tear line 3019 and third tear line 3021 extend away from an end of first tear line 3009, it is contemplated that at least one of second tear line 3019 and third tear line 3021 extend at some point between first end 3022 and second end 3024 of first tear line 3009.

Unlike many of the other lids described above, lid 3000 does not have an opening in the drinking portion. However, it is contemplated that an opening can be created by rupturing first tear line 3009, second tear line 3019, and third tear line 3021. For example, a user can pinch an area of inward-facing wall 3013 and an area of outward-facing wall in drinking portion to rupture first tear line 3009, second tear line 3019, and third tear line 3021 to thereby create the opening. Although some embodiments described herein have a tear line or an opening disposed in the drinking portion to allow a user to consumer a beverage and/or food product, it is contemplated that in other embodiments there is no tear line or opening disposed in the drinking portion (i.e., there is no first tear line 3009 or opening 2807). In such embodiments, a user can simply rupture other tear lines disposed on the lid to allow a beverage and/or food product to be consumed by the user.

It is contemplated that lid 3000 can comprise additional tear lines as discussed in the other embodiments herein (see, e.g., FIGS. 26A, 27 and 28A). For example, it is contemplated that lid 3000 can comprise tear lines disposed proximally to an intersection of inward-facing wall 3013 and valley 3005 in the drinking portion and/or the aroma portion. In one example, lid 3000 can comprise tear lines disposed proximally to an intersection of inward-facing wall 3013 and valley 3005, and extend along at least 90% of the perimeter of valley 3005. In addition, it is contemplated that lid 3000 comprises a valley tear line disposed on the valley.

Lid 3000 can further comprise an incision 3037 on valley 3005. Incision 3037 is contemplated to be disposed on the valley 3005 in the drinking portion or the aroma portion or in both the drinking and the aroma portion. It should be appreciated that incision 3037 allows users to insert a straw to drink a cold beverage. Incision 3037 comprises a slit on valley 3005 to allow a utensil (e.g., straw, chopstick, etc.) to penetrate lid 3000. While incision 3037 is described in lid 3000, it is contemplated that incision 3037 can be incorporated in any of the embodiments described herein (see, e.g., FIGS. 26A, 27 and 28A). Additionally, or alternatively, lid 3000 can comprise an opening in the aroma portion that functions as a vent hole.

Lid 3000 further comprises an indicator 3038 that provides a visual indicator that assists users to properly align lid 3000 onto a container to reduce leaking when drinking portion is aligned with the seam of a container. However, it is also contemplated that indicator 3038 can be a tactile indicator. Indicator 3038 can be used to guide users to align with the seam of a container to the back of lid 3000 in the aroma portion and reduce the risk of leaking when drinking from container. It is also contemplated that indicator 3038 can be positioned on at least one of inward-facing wall 3013 and the outward-facing wall to allow a user to indicate the area of lid 3000 without having to look at lid 3000. For example, indicator 3038 can be located in the aroma portion as shown in FIG. 30, such that a user can feel indicator 3038 to know the position of the aroma portion and properly drink from the drinking portion.

FIG. 31 shows a top perspective view of lid 3100 having a ridge 3101 that partially surrounds a basin 3103. Basin 3103 comprises a valley 3105, and ridge 3101 partially surrounds the valley. While most of the embodiments described above show a ridge completely surrounding the valley, it is contemplated that a ridge that partially surrounds the valley as shown in FIG. 31 is suitable for such embodiments. FIG. 31 shows that ridge 3101 does not completely surround valley 3105 in the aroma portion of lid 3100. However, it is contemplated that ridge 3101 does not surround other portions of lid 3100, such as the drinking portion or another section of the aroma portion. While ridge 3101 appears to end abruptly in the aroma portion, it is contemplated that ridge 3101 can gradually taper to an end.

As discussed above, lids are contemplated that have various tear lines to enlarge an opening for consuming beverage or solid food from a container. However, in other embodiments, it is contemplated that the lid can be produced/manufactured (and sold) without at least a portion of the valley, and even without the entire valley as shown in FIG. 32. Lid 3200 comprises a ridge 3203 that defines a first opening 3207. While first opening 3207 is larger than many of the embodiments described above, it should be noted that an enhanced olfactory experience and a reduced risk of splashing is achieved due to the structural features provided by ridge 3203.

Lid 3200 is a partial cover on a container as compared to many of the embodiments described above because lid 3200 lacks a valley. Nonetheless, it is contemplated that lids can be produced/manufactured (and sold) as partial covers or more complete covers (e.g., FIG. 26A having valley 2605) for containers. Lid 3200 typically has an outer rim 3241 that can press-fit over a rim of a container (e.g., bowl, cup, take out container, food storage container, etc.). In other embodiments, lid 3200 can be removably coupled to a container using other suitable means, such as male-female engagements, threaded connectors, or lid 3200 and the container can also be formed as a single integral structure.

Lid 3200 can function as a splash guard and heat retention element. Lid 3200 has a ridge 3203 having an inward-facing wall 3213 and an outward-facing wall 3239 that form a rounded apex as shown in FIGS. 7B-7C. Inward-facing wall 3213 and outward-facing wall 3239 are angled so as to facilitate a deflection of any liquid back into the container (see, e.g., FIGS. 7B-7C). For example, lid 3200 can be coupled to a beverage container having liquid whereby liquid is deflected back by inward-facing wall 3213 and outward-facing wall 3239 into the container when the user and/or the container are bumped (see, e.g., 708 and 720 of FIGS. 7B-7C). In addition, the lid 3200 can be very beneficial to a user while they are engaged in light activity such as walking. When consuming a hot beverage and/or food product (e.g., soup, tea, coffee, etc.), lid 3200 can retain heat longer than an ordinary open container because of heat is retained in the underside gap of ridge 3203 (see, e.g., 708 and 720 of FIGS. 7B-7C).

In some embodiments, inward-facing wall 3213 and outward-facing wall 3239 meet at an angle between 5 and 80 degrees, and more typically between 10 and 50 degrees as shown in FIG. 7D. While inward-facing wall 3213 and outward-facing wall 3239 have an angle that deflect beverage and/or food product into the container, it is contemplated that outward-facing wall 3239 has an angle sufficient for viewing advertising text and logos as shown in FIG. 8B.

Lid 3200 comprises first opening 3207 that is defined by ridge 3203 and extends from a drinking portion to an aroma portion. As discussed above, the drinking portion typically encompasses the area where the user drinks from the lid and the adjacent area (e.g., the bottom of ridge from a top view, the two ridges extending from the bottom, and the area within) while the aroma portion typically encompasses the area above the drinking portion (e.g., the two ridges that taper to the top of lid from a top view and the area within). First opening 3207 can have a pentagonal shape defined by ridge 3203 having a pentagonal shape. It should be appreciated that the pentagonal shape of ridge enhancing the olfactory experience of a user by concentrating and channeling the aroma of the beverage and/or food product directly to the user's nose.

Additionally, ridge 3203 having a pentagonal shape helps block outside air from interfering with the aroma coming from the beverage and/or food product. In other embodiments, ridge 3203 can have a circular shape (e.g., egg-shaped as shown in FIGS. 22A and 22B) or other suitable non-circular shapes (e.g., triangular as shown in FIGS. 23A and 23B, pentagonal, hexagonal, etc.) to define first opening 3207. As discussed above, it should be noted that the shape of the ridge is defined using a top view perspective. For example, as can be seen in FIG. 32, ridge 3203 forms a pentagonal shape from a top view perspective.

Outer rim 3241 defines a second opening (see, e.g., 540 in FIGS. 5B and 8C) on the bottom of lid 3200 that couples to a container. It is contemplated that first opening 3207 has an area of at least 20% of the area of the second opening, and more typically, the area of at least 40% of the area of the second opening. In some embodiments, first opening 3207 has an area of at least 60% of the area of the second opening. Thus, it is contemplated that first opening 3207 can accommodate the nose of the user while the user is consuming the beverage and/or food product to channel the aroma to the nasal area of the user. Moreover, it should be appreciated that the size of first opening 3207 allows a user to refill the beverage without the need to remove lid 3200 from the container.

It is contemplated that inward-facing wall 3213 can extend towards the second opening, and provide a uniform distance between the second opening and inward-facing wall 3213. However, inward-facing wall 3213 can also have a first portion and a second portion that extend toward the second opening, and the first portion extends closer to the second opening than the second portion. Thus, variable extensions of inward-facing wall 3213 toward the second opening can provide a lid where the surface area created by the additional extension in the first portion of inward-facing wall 3213 to second opening can provide further protection from splashes. In other words, inward-facing wall 3213 extends downward (i.e., towards the second opening) to a greater depth in the first portion, which provides additional wall area to deflect liquid and/or food product back into the container to improve splash resistance. In typical embodiments with variable extensions toward the second opening, it is contemplated that the first portion of inward-facing wall 3213 is in the aroma portion and the second portion of inward-facing wall 3213 is in the drinking portion. It should be appreciated that any of the lid embodiments described herein can incorporate variable extensions of the inward-facing wall to a second opening defined by the outer rim of the lid in order to further reduce the risk of spilling.

Lid 3200 comprises at least a portion of inward-facing wall 3213 in the drinking portion that is substantially flat between the rounded apex to first opening 3207 (see, e.g., 315 in FIG. 5B). It is contemplated that having a substantially flat region on inward-facing wall 3213 can provide an area for a user to sip a beverage and/or food product from an attached container when the container is tilted. For example, inward-facing wall 3213 can comprise a sipping area 3215 that has a substantially flat cross section or slightly concave cross section to provide better control of the flow of the beverage and/or food product.

As discussed above, ridge 3203 can further comprise a first portion of inward-facing wall 3213 that intersects (i) a second portion at a first angle and (ii) a third portion at a second angle, and wherein the first and second angles are between 90 and 145 degrees to form a controlled and contained sipping area as shown in FIG. 4. In addition, sipping area 3215 can be concave in the direction going from the second portion to the third portion, while being substantially flat (or even slightly concave) in a direction going from the rounded apex to first opening 3207. In this manner, sipping area 3215 is configured (e.g., sized/dimensioned/shaped) to pool liquid and guide/channel liquid from the container to the user's mouth when the user places his/her lips at the rounded apex and tilts the container.

In addition to sipping area 3215 providing better control, the rounded apex of ridge 3203 in the drinking portion has a width that is sized and dimensioned to facilitate drinking. For example, the rounded apex in the drinking portion can be between 1/32 and 1/4 inch (0.07938 and 0.635 centimeter), and more typically between 1/16 and 1/8 inch (0.1588 and 0.3175 centimeter) as discussed in FIG. 7D. In this manner, the rounded apex is sized and dimensioned to serve as a suitable drinking edge. It should be appreciated that many of the features described in the other embodiments (e.g., tear lines, slits, indicators, etc.) can be implemented in lid 3200.

Ridge 3203 has a double wall structure with inward-facing wall 3213 and outward-facing wall 3239 that surround and define first opening 3207. In other embodiments, ridge 3203 can partially defines first opening 3207. For example, ridge 3203 can partially define first opening 3207, such that ridge 3203 can comprise at least 20% of the perimeter of first opening 3207, and more typically, ridge 3203 can comprise at least 45% of the perimeter of first opening 3207. In such embodiments, ridge 3203 can only be present in the drinking portion or in the aroma portion. However, it is also contemplated that ridge 3203 can partially define first opening 3207 whereby ridge can comprise at least 60% of the perimeter of first opening 3207, and even at least 80% of the perimeter of first opening 3207 to thereby maintain the effectiveness of anti-splashing without the need to have ridge 3203 completely define first opening 3207.

Furthermore, it is contemplated that a dimension of first opening 3207 measured from the aroma portion to the drinking portion can vary (see, e.g., 404*a* of FIG. 4). For example, it is contemplated that ridge 3203 can have an overall dimension measured from its upper-most point in the aroma portion to its lower-most point in the drinking portion (see, e.g., 404*a* of FIG. 4) between 2 to 4 inches (5.08 to 10.16 centimeters), and more typically between 2¼ to 3⅓ inches (5.715 to 8.467 centimeters).

Figure 33:
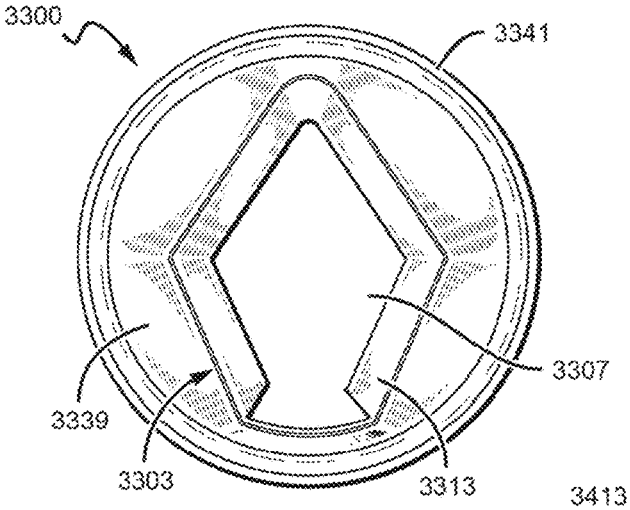
FIG. 33 is a perspective view of an embodiment of a lid having a ridge as a splash guard that surrounds an opening whereby the inward-facing wall partially surrounds the opening.

In yet further embodiments, a lid 3300 can have a ridge 3303 whereby inward-facing wall 3313 partially surrounds opening 3307 as shown in FIG. 33. Many of the features of lid 3300 are similar to lid 3200, but inward-facing wall 3313 does not completely surround opening 3307 in the drinking portion. In other words, the drinking portion of lid 3300 has an outward facing wall 3339 and a drinking edge (e.g., apex of ridge 3303 having a rounded edge) but does not have a sipping area (such as sipping area 3215 as shown in FIG. 32). Absence of sipping area 3215 allows a user to consume beverage and/or food product that would typically be entrapped in the underside gap of ridge 3303 (see, e.g., 712 in FIG. 7D). It should be contemplated that ridge 3303 can have a single wall. Lid 3300 can be coupled to a container using outer rim 3341 or using any of the other means discussed above.

Figure 34:
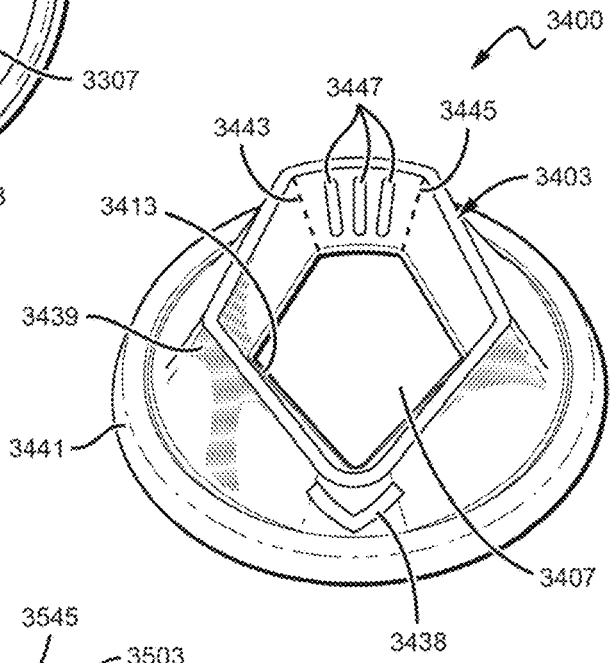
FIG. 34 is a perspective view of an embodiment of a lid having a ridge as a splash guard having slits and tear lines.

The various lids disclosed herein can function as splash guards even though the lid opening is larger than most typical lids for containers. To compensate the larger opening from which more splashing or spilling can occur, a ridge is used to deflect any beverage and/or food product into the container to thereby minimize spilling/splashing and allow a larger opening to be used. As discussed above, it may be favorable to consume beverage and/or food product that can be entrapped in the underside gap of the lid. As shown in FIG. 34, a lid 3400 can have a first tear line 3443 and a second tear line 3445 disposed on an inward-facing wall 3413 of a ridge 3403 that can be ruptured to consume beverage and/or food product in the underside gap. Lid 3400 comprises ridge 3403 inward-facing wall 3413 and an outward-facing wall 3439 that can deflect beverage and/or food product into the container, and can additionally retain heat as described in FIG. 32.

First tear line 3443 and second tear line 3445 typically extend away from first opening 3407. The tear lines can be many suitable structures as described above. To rupture first tear line 3443 and second tear line 3445, a user can pinch together a portion of inward-facing wall 3413 and outward-facing wall 3439 between first tear line 3443 and second tear line 3445. Once ruptured, a user can consume any beverage and/or food product that was entrapped in the underside gap of ridge 3403 to reduce waste.

When consuming food products with solid materials (e.g., ice, noodles, solid food products, etc.), it is contemplated that lid 3400 comprises a slit or a plurality of slits 3447 on inward-facing wall 3413. Slits 3447 provide an additional path for liquid to flow from an attached container. Thus, a user does not have to tilt a container as much to consume a beverage and/or food product because the beverage and/or food product can flow through slits 3447.

Slits 3447 are typically disposed on inward-facing wall 3413 in the drinking portion and between first tear line 3443 and second tear line 3445. Slits 3447 can extend away (i.e., in a vertical direction) from first opening 3407 as shown in FIG. 34. In other embodiments, slits 3447 can extend in a horizontal direction along inward-facing wall 3413.

It should be appreciated that slits 3447 can act as a strainer or a buffer holding ice from an iced beverage while allowing the liquid to flow to the user. If the user desires to consume the ice, then first tear line 3443 and second tear line 3445 can be ruptured to allow ice to flow to the user.

Lid 3400 can further comprise an indicator 3438 that can allow user to determine the position of the drinking portion without having to look at lid 3400. It is contemplated that indicator 3438 can also be used to align the drinking portion away from a seam on a container to prevent leaking. As shown in FIG. 34, indicator 3438 is disposed on outward-facing wall 3439 in a position opposite of the drinking portion to allow a user to align indicator 3438 with a seam on a container to reduce leaking. However, in other contemplated embodiments, indicator 3438 can be disposed on at least one of the inward-facing wall and outward-facing wall 3439 in other areas of the aroma portion and even in areas of the drinking portion. Indicator 3438 can be a visual and tactile indicator. In some embodiments, indicator 3438 can be a phosphorescent material to allow users to visually locate indicator 3438 in dim light. For example, indicator 3438 with phosphorescent material can be disposed on outward-facing wall 3439 in the drinking portion to highlight ridge 3515 that can be used for consuming a beverage. It is contemplated that more than one indicator can be disposed on lid 3400 to allow users to align lid 3400 onto a container properly. It should be appreciated that a multiple indicator system can have individual indicators that each provides different aligning functions or a group of indicators that serve a single alignment function.

Lid 3400 has an outer rim 3441 that defines a second opening (see, e.g., 540 in FIGS. 5B and 8C) on the bottom of lid 3400. Much like the outer rim of FIG. 32, it is contemplated that first opening 3407 has an area that is at least 20% of the area of the second opening, and more typically, an area that is at least 40% of the area of the second opening. In some embodiments, first opening 3407 has an area that is at least 60% of the area of the second opening. Furthermore, inward-facing wall 3413 can have variable extensions towards the second opening, and provide greater surface area in some portions (e.g., first portion vs. second portion as discussed in FIG. 32) than in others to further prevent spilling.

Figure 35:
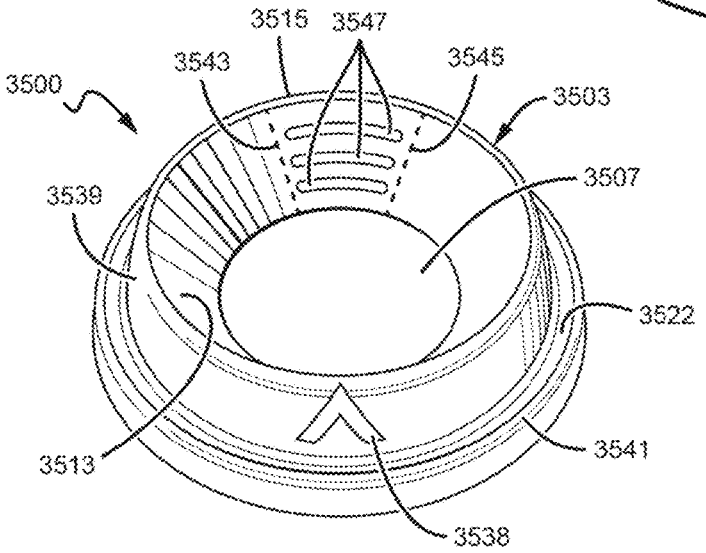
FIG. 35 is a perspective view of an embodiment of a lid having a circular ridge.

Most of the embodiments discussed above have related to lids having ridges with non-circular shapes (e.g., pentagonal, triangular). However, it should be appreciated that a lid 3500 with a ridge 3503 having a circular shape is also contemplated as shown in FIG. 35. Lid 3500 has an opening 3507 that is defined by ridge 3503 having an inward-facing wall 3513 and an outward-facing wall 3539 to provide anti-splashing and heat retention as described above. Lid 3500 has a sipping area 3515 that is substantially flat to provide better control over the flow of the beverage and/or food product.

Lid 3500 can further comprise a first tear line 3543 and a second tear line 3545 disposed on inward-facing wall 3513. First tear line 3543 and second tear line 3545 can be ruptured by pinching a portion of inward-facing wall 3513 and outward-facing wall 3539 between first tear line 3543 and second tear line 3545. Thus, beverage and/or food products entrapped in the underside gap of ridge 3503 can be consumed by rupturing first tear line 3543 and second tear line 3545.

Lid 3500 can couple various containers using an outer rim 3541 that is circumferentially disposed about ridge 3503. It is contemplated that outer rim 3541 is radially offset from ridge 3503 as opposed to being an extension of ridge 3503. In other words, outer rim 3541 can surround ridge 3503, such that an outer valley 3522 can be disposed between outer rim 3541 and ridge 3503 as shown in FIG. 35. It should be appreciated that outer rim 3541 and opening 3507 can be non-concentric. As a result, outer valley 3522 can be larger in some areas than in others. In other embodiments, other coupling means can be used to couple lid 3500 to a container as described above. In addition, lid 3500 can comprise an indicator 3538 that can provide the user an indication of the position of sipping area 3515 without the need to look at lid 3500.

Lid 3500 has an outer rim 3541 that defines a second opening (see, e.g., 540 in FIGS. 5B and 8C) on the bottom of lid 3500. Much like the outer rim of FIG. 32, it is contemplated that first opening 3507 has an area that is at least 20% of the area of the second opening, and more typically, an area that is at least 40% of the area of the second opening. In some embodiments, first opening 3507 has an area that is at least 60% of the area of the second opening. Furthermore, inward-facing wall 3513 can have variable extensions towards the second opening, and provide greater surface area in some portions (e.g., first portion vs. second portion as discussed in FIG. 32) than in others to further prevent spilling.

Figure 36:
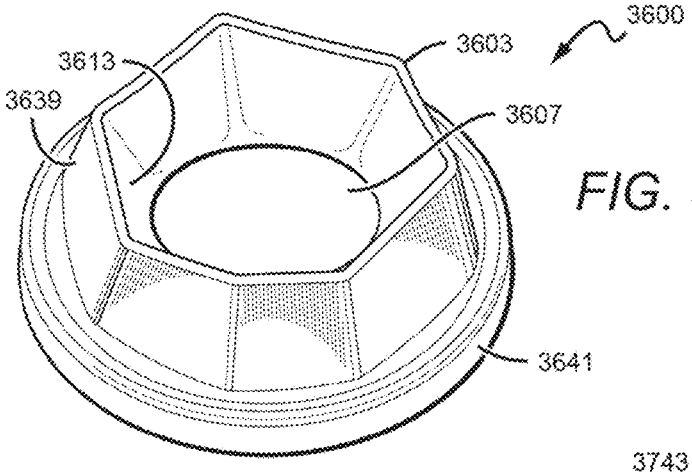
FIG. 36 is a perspective view of an embodiment of a lid having a hexagonal-shaped ridge.

As discussed above, lid embodiments can have ridges of various shapes. While most of lids have been pentagonal shape, other shapes for the ridge are contemplated. Suitable shapes for the ridge include egg-shaped, triangle-shaped, circular-shaped, oval-shaped, and non-circular shapes. As noted above, the ridge shape is defined by the shape that the ridge forms when viewed from a top perspective. FIG. 36 shows a lid 3600 having a ridge 3603 that forms a hexagonal shape. Ridge 3603 has an inward-facing wall 3613 and an outward-facing wall 3639 that form a rounded apex. It should be appreciated that ridge 3603 is a double-walled structure (having inward-facing wall 3613 and outward-facing wall 3639) that prevents spills by deflecting any beverage and/or food product back into an attached container.

Lid 3600 also has a first opening 3607 that is at least 20% of a second opening (see, e.g., 540 in FIGS. 5B and 8C) formed by an outer rim 3641. In other contemplated embodiments, first opening 3607 is at least 40% of the second opening formed by outer rim 3641, and, in yet other embodiments, first opening 3607 is at least 60% of the second opening formed by outer rim 3641. Although first opening 3607 is larger than typical opening disposed on traditional lids, spills are significantly reduced because of the ability of ridge 3603 to deflect any beverage and/or food product back into the container. While not shown in FIG. 36, it should be appreciated that lid 3600 can further include tear lines on inward-facing wall 3613 and/or slits as described in some of the embodiments above.

Figure 37:
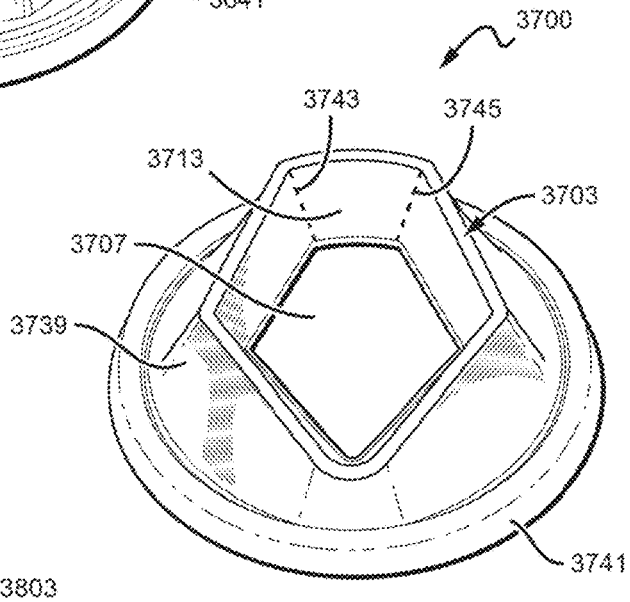
FIG. 37 is a perspective view of an embodiment of a lid having a ridge as a splash guard and tear lines along an inward-facing wall.

FIG. 37 shows a lid 3700 having a ridge 3703 with an inward-facing wall 3713 and an outward-facing wall 3739. It should be appreciated that ridge 3703 is a structure that promotes deflection of beverage and/or food product into an attached container to reduce spilling. Inward-facing wall 3713 comprises a first tear line 3743 and a second tear line 3745 in the drinking portion. First tear line 3743 and second tear line 3745 can be ruptured to provide access to any beverage and/or food product that is trapped between inward-facing wall 3713 and outward-facing wall 3739, especially in the region proximal to first tear line 3743 and second tear line 3745. Lid 3700 has a first opening 3707 that is defined by ridge 3703. As described above, first opening 3707 can be at least 20%, at least 40%, or at least 60% of a second opening defined by an outer rim 3741.

Figure 38A:
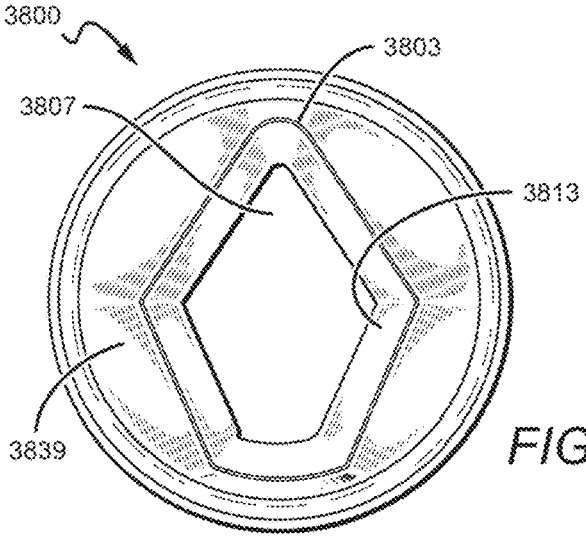
FIGS. 38A-38B are perspective views of an embodiment of a lid having a ridge as a splash guard and an extended inward-facing wall.

FIG. 38A is another embodiment of a lid 3800 having a ridge 3803 that defines a first opening 3807. Ridge 3803 has an inward-facing wall 3813 and an outward-facing wall 3839 that form a rounded apex. As discussed above, ridge 3803 is a structure that reduces spilling of beverages and/or food products from a container by deflecting such beverages and/or food products back into the container using at least one of inward-facing wall 3813 and outward-facing wall 3839.

Figure 38B:
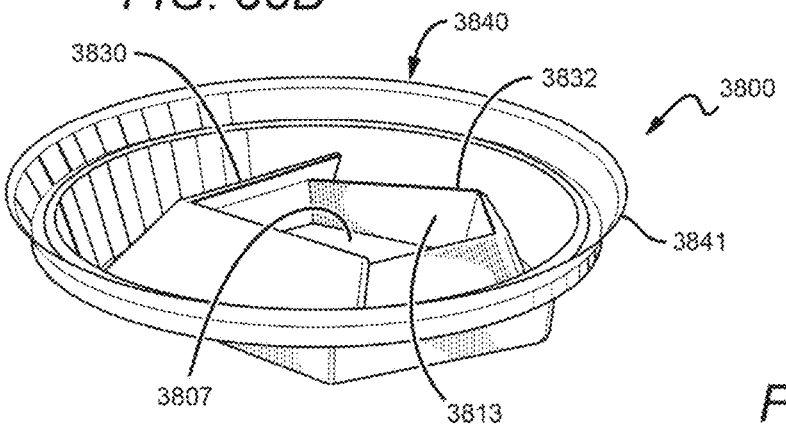

Inward-facing wall 3813 can extend towards a second opening 3840 at different lengths as discussed above. For a better view of such feature, FIG. 38B shows a bottom perspective view of lid 3800. Inward-facing wall 3813 can have a first portion 3830 and a second portion 3832 that extend towards second opening 3840. In this embodiment, first portion 3830 of inward-facing wall 3813 extends closer to second opening 3840 than second portion 3832. In other words, when viewed from a bottom perspective view, inward-facing wall 3813 in the first portion 3830 extends in an upward direction greater than inward-facing wall 3813 in the second portion 3832. Although inward-facing wall 3813 extends towards second opening 3840, inward-facing wall 3813 does not extend above second opening 3840 in lid 3800 as shown in FIG. 38B. However, it is contemplated that at least one of first portion 3830 and second portion 3832 of inward-facing wall 3813 extends above second opening 3840 when lid 3800 is viewed from a bottom perspective.

There are many suitable structures for the extension of inward-facing wall 3813 in first portion 3830 and second portion 3832. For example, inward-facing wall 3813 can sized and dimensioned to extend in first portion 3830 and second portion 3832 (i.e., inward-facing wall 3813 has a length equal to the extension needed in the respective portions). In another example, inward-facing wall 3813 can have an extended piece that couples inward-facing wall 3813 to extend closer to second opening 3840 and/or extend beyond second opening 3840 when lid 3800 is viewed from a bottom perspective.

Figure 39A:
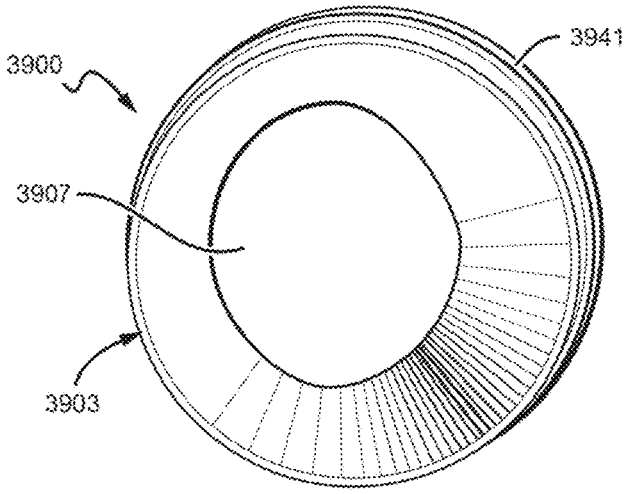
FIGS. 39A-39B are a top view and perspective view of an embodiment of a lid having a first opening and a second opening that are non-concentric.
Figure 39B:
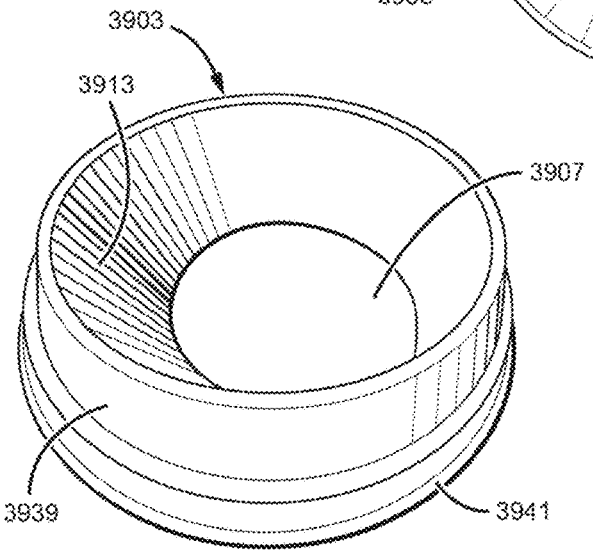

FIG. 39A shows a top view of a lid 3900 having ridge 3903 that defines a first opening 3907. Ridge 3903 has an inward-facing wall 3913 and an outward-facing wall 3939 that form a rounded apex as shown in FIG. 39B. It should be appreciated that ridge 3903 is a double-walled structure (having inward-facing wall 3913 and outward-facing wall 3939) that prevents spills by deflecting any beverage and/or food product back into an attached container.

Lid 3900 also has a first opening 3907 that is at least 20% of a second opening (see, e.g., 540 in FIGS. 5B and 8C) formed by an outer rim 3941. In other contemplated embodiments, first opening 3907 is at least 40% of the second opening formed by outer rim 3941, and, in yet other embodiments, first opening 3907 is at least 60% of the second opening formed by outer rim 3941. It should be noted that first opening 3907 and the second opening formed by outer rim 3941 are non-concentric. Furthermore, although first opening 3907 is larger than a typical opening disposed on traditional lids, spills are significantly reduced because of the ability of ridge 3903 to deflect any beverage and/or food product back into the container. While not shown in FIG. 39, it should be appreciated that lid 3900 can further include tear lines on inward-facing wall 3913 and/or slits as described in some of the embodiments above.

Figure 40:
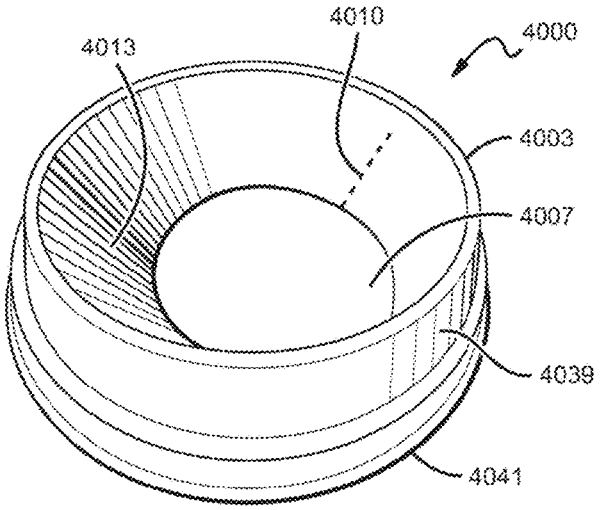
FIG. 40 is a perspective view of an embodiment of a lid having a ridge as a splash guard and a single tear line.

FIG. 40, for example, shows a lid 4000 that is identical to lid 3900 except for a tear line 4010 disposed inward-facing wall 4013. Tear line 4010 extends from first opening 4007 up towards the top of ridge 4003 (i.e., the edge where outward-facing wall 4039 meets with inward-facing wall 4013). Tear line 4010 can be used to enlarge first opening 4007 by pinching outward-facing wall 4039 and inward-facing wall 4013 at or near tear line 4010. It is further contemplated that tear line 4010 could extend all the way to the ridge. Lid further comprises an outer rim 4041 that defines a second opening (see, e.g., 540 in FIGS. 5B and 8C) on the bottom of lid 4000. Much like the outer rim of FIG. 32, it is contemplated that first opening 4007 has an area that is at least 20% of the area of the second opening, and more typically, an area that is at least 40% of the area of the second opening.

Figure 41:
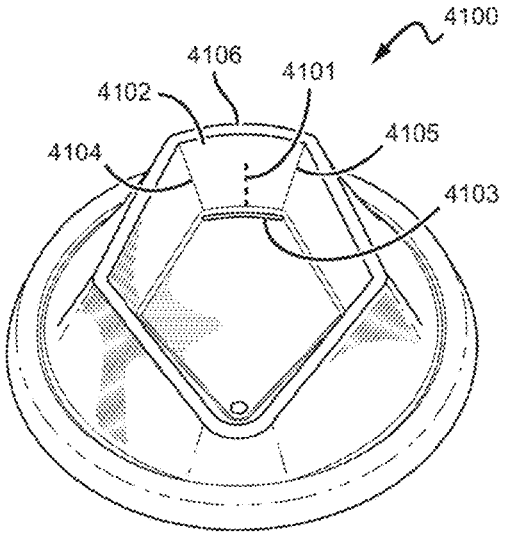
FIG. 41 is a perspective view of an embodiment of a lid having a single tear line.

FIG. 41 shows another embodiment of a lid 4100. Lid 4100 is substantially identical to lid 800 in FIG. 8 except that lid 4100 has a tear line 4101 on an inward-facing wall 4102. Tear line 4101 is disposed between a first crease 4104 and a second crease 4105, and extends from an opening 4103 up towards the top of ridge 4106. A user can enlarge opening 4103 by either pressing inwardly on inward-facing wall 4102 or by pinching inward-facing wall 4102 with the outward-facing wall. Tear line 4101 extends upward from the center of opening 4103 and is in the middle of first crease 4104 and second crease 4105. However, in alternative embodiments, tear line 4101 could be off-center relative to opening 4103 and/or relative to first crease 4104 and second crease 4105. It is also contemplated that tear line 4101 could extend all the way to the top of ridge 4106.

Figure 42:
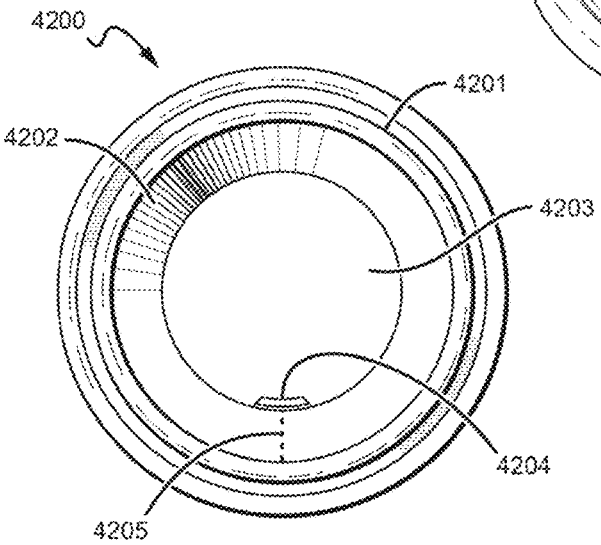
FIG. 42 is a top view of an embodiment of a lid having a circular-shaped ridge and a single tear line.

FIG. 42 shows a lid 4200. Lid 4200 is substantially similar to lid 3500 in FIG. 35 in that it has a circular ridge comprising a circular inward-facing wall 4202 that converges with a circular outward-facing wall 4201. Lid 4200 is different than lid 3500 in that it has a valley 4203 with an opening 4204 and a tear line 4205 extending upward from opening 4204. Tear line 4205 can be used to enlarge opening 4204 by pressing on tear line 4205 or by pinching inward-facing wall 4202 and outward-facing wall 4201 together at or near tear line 4205. In one aspect of alternative embodiments, tear line 4205 could extend all the way to the edge (i.e., top of the ridge where outward-facing wall 4201 and inward-facing wall 4202 converge to form an apex).

As discussed above, many of the lid embodiments have a ridge that at least partially surrounds a valley or an opening. The ridge generally has a rounded apex in a sipping portion for a user to use when drinking from a cup coupled to the lid. Typically, the rounded apex in the sipping portion of the ridge has a smaller width than the apex in aroma portion of the ridge as shown in FIGS. 5B and 7D. However, it is contemplated that in other embodiments, a top surface of the ridge in the sipping portion can have a greater width than the apex or top of the ridge in the aroma portion and/or in other areas of the drinking portion. For example, FIG. 43A shows a lid 4300 having a ridge 4303 with a widened ridge portion 4310 proximal to a sipping area 4315.

Ridge 4303 comprises an inward-facing wall 4313 and an outward-facing wall 4312. It should be appreciated that ridge 4303 in widened ridge portion 4310 provides additional structural support for ridge 4303 to support a user's lip when using lid 4300. Additionally, or alternatively, ridge 4303 in widened ridge portion 4310 can comprise a concave surface in sipping area 4315 on inward-facing wall 4313 to thereby provide better liquid distribution across inward-facing wall 4313 when a user is consuming a beverage using lid 4300. In some embodiments, ridge 4303 in widened ridge portion 4310 can extend away from a valley 4305 at an angle that promotes a more controlled flow of a beverage (i.e., prevents sudden bursts of liquid).

Lid 4300 comprises a basin 4301 defined by a ridge 4303 that surrounds valley 4305. However, it is contemplated that ridge 4303 can partially define valley 4305. Basin 4301 comprises a drinking portion and an aroma portion. The drinking portion can comprise the area of basin 4301 (including valley 4305) from ridge 4303 near opening 4309 to the center of basin 4301 (i.e., the lower half of basin 4301 when viewed from a top view and oriented as shown in FIG. 43A). The aroma portion can be the remaining area of basin 4301 besides the drinking portion (i.e., the top half of basin 4301 when viewed from a top view and oriented as shown in FIG. 43A). In other contemplated embodiments, the drinking portion can comprise the area of the basin within a second length as described in FIG. 3, and the aroma portion can comprises the area of basin within a first length as described in FIG. 3.

As discussed above, ridge 4303 can comprise inward-facing wall 4313 and outward-facing wall 4312. Typically, each of inward-facing wall 4313 and outward-facing wall 4312 extend to a top surface 4322 of ridge 4303. As shown from the top view in FIG. 43A, top surface 4322 can have various widths whereby a first width of top surface 4322 at a first portion of ridge 4303 (e.g., widened ridge portion 4310) is larger than a second width of top surface 4322 at a second portion of ridge 4303 (e.g., aroma portion and drinking portion outside of widened ridge portion 4310). This difference can also be observed in FIG. 43B whereby top surface 4322 at widened ridge portion 4310 is wider than top surface 4322 at any other location along ridge 4303.

Figure 43C:
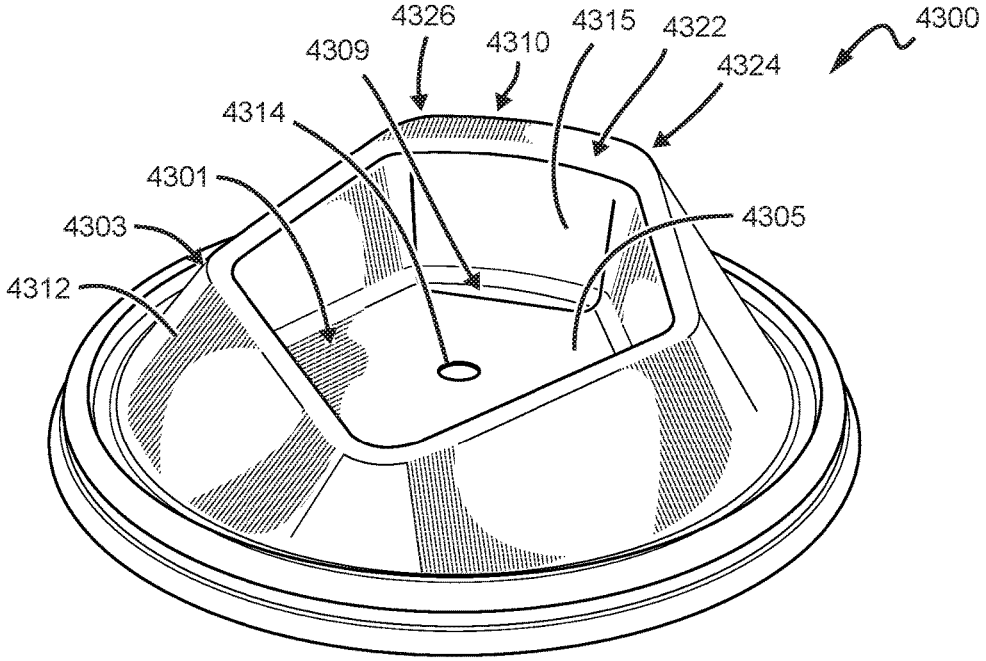

Valley 4305 comprises an aperture 4314 disposed on the center of valley 4305. However, it is contemplated that aperture 4314 can be disposed on other areas of valley 4305 or other portions of lid 4300 (e.g., inward-facing wall 4313, outward-facing wall 4312, etc.). Valley 4305 further comprises opening 4309 that allows a beverage to flow from within a container onto sipping area 4315 on inward-facing wall 4313 for a user to consume. Opening 4309 typically has (i) a first portion that extends on valley 4305 near and/or on inward-facing wall 4313, (ii) a second portion that extends near and/or on a first crease 4324 on inward-facing wall 4313, and (iii) a third portion that extends near and/or on a second crease 4326 on inward-facing wall 4313 to thereby form a "U"-shaped opening as shown in FIG. 43C. It is contemplated that opening 4309 can be disposed on other areas of valley 4305 and inward-facing wall 4313. Alternatively, it is contemplated that opening 4309 can extend only within valley 4305 or inward-facing wall 4313.

It is contemplated that the second portion and third portion of opening 4309 are substantially perpendicular (e.g., between 80 and 100 degrees) to the first portion of opening 4309 as shown in FIG. 43C. Alternatively, the angle formed by the first portion and at least one of the second portion and the third portion can be between 60 and 120 degrees. The second portion and the third portion of opening 4309 can extend near and/or on first crease 4324 and second crease 4326 toward top surface 4322. Typically, the second portion and the third portion extend within ¼ inch (0.635 centimeter) from first crease 4324 and second crease 4326, and more typically, within ⅛ inch (0.3175 centimeter) from first crease 4324 and second crease 4326. In some embodiments, the second portion and the third portion of opening 4309 can extend along first crease 4324 and second crease 4326. The second portion and the third portion of opening 4309 can extend toward top surface 4322 at a position below top surface 4322, or onto top surface 4322 and even onto outward-facing wall 4312 in widened ridge portion 4310 if desired.

Figure 43D:
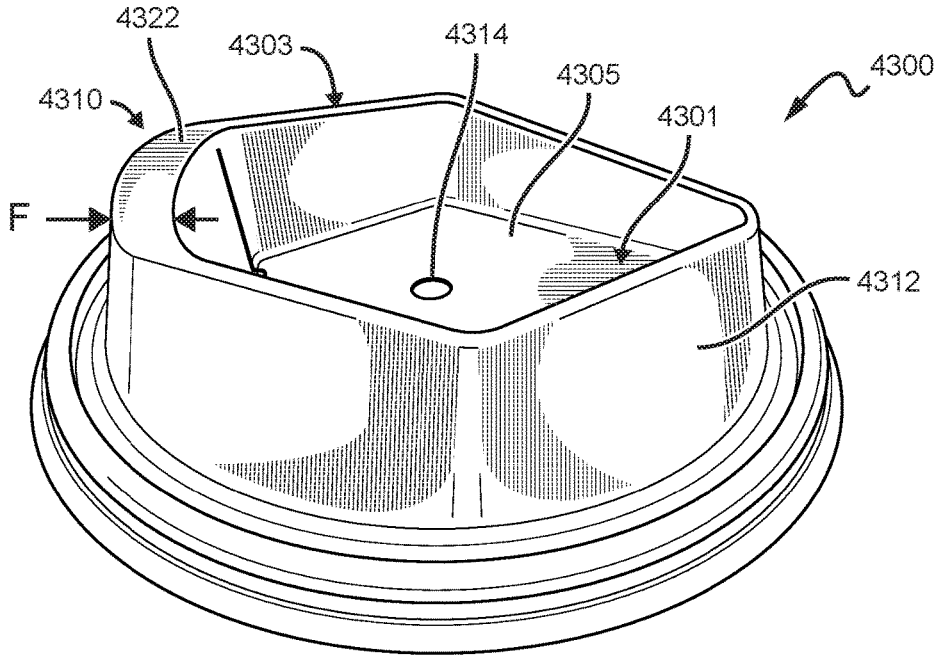

Opening 4309 can be enlarged to increase the flow of the beverage by applying a force on inward-facing wall 4313 in widened ridge portion 4310 or by pinching together a first area on inward-facing wall 4313 in widened ridge portion 4310 and a second area on outward-facing wall 4312 in widened ridge portion 4310 as shown by the two dotted lines designated "F" in FIG. 43D. Additionally, or alternatively, opening 4309 can be enlarged by pinching inward-facing wall 4313 and outward-facing wall 4312 between first crease 4324 and second crease 4326 to thereby enlarge opening 4309. For example, opening 4309 can be enlarged by pinching together inward-facing wall 4313 near or at top surface 4322 and outward-facing wall 4312 near or at top surface 4322. It is contemplated that pinching inward-facing wall 4313 and outward-facing wall 4312 between first crease 4324 and second crease 4326 can cause a tear in a portion of at least one of inward-facing wall 4313 and top surface 4322 near or at first crease 4324 and second crease 4326 to thereby extend the second and third portions of opening 4309 to top surface 4322. Additionally, it is contemplated that the width of top surface 4322 in widened ridge portion 4310 can collapse to a decreased width upon enlarging opening 4309 via pinching inward-facing wall 4313 and outward-facing wall 4312.

Ridge 4303 extends above valley 4305 as shown in FIG. 43D. It should be appreciated that ridge 4303 provides a protective enclosure to reduce, or prevent, splashing of liquid that may be resting on valley 4305. It is contemplated that lid 4300 can be provided without valley 4305 to function as a splash guard as discussed above. FIG. 43E provides a cross sectional view of lid 4300. Top surface 4322 in widened ridge portion 4310 can comprise a first width 4316 between ⅛ to ¾ inch (0.3175 to 1.905 centimeter), and more typically between ¼ inch (0.635 centimeter) and ½ inch (1.27 centimeters). Typically, first width 4316 of top surface 4322 at a first portion of ridge 4303 (e.g., widened ridge portion 4310, portion of ridge 4303 near opening 4309, etc.) is larger than a second width 4317 of top surface 4322 at a second portion of ridge 4303 (e.g., portion of ridge 4303 distal from opening 4309, portion of ridge 4303 in aroma portion, etc.). It should be appreciated that first width 4316 of top surface 4322 near sipping area 4315 provides additional structural support for a user's lip.

It is contemplated that the height of lid 4300 can vary at different positions on lid 4300. For example, lid 4300 can comprise a drinking portion lid height 4318 measured from a bottom surface of lid 4300 to top surface 4322 of widened ridge portion 4310 between ½ to 1½ inches (1.27 to 3.81 centimeters), and more typically between ¾ to 1¼ inches (1.905 to 3.175 centimeters). Lid 4300 can further comprise an aroma portion lid height 4320 measured from a bottom surface of lid 4300 to top surface 4322 of ridge 4303 in the aroma portion between ¼ to 1¼ inches (0.635 to 3.175 centimeter), and more typically between ⅝ to ⅞ inch (1.587 to 2.222 centimeters). It is contemplated that the height of lid 4300 can gradually reduce from drinking portion lid height 4318 to aroma portion lid height 4320.

FIG. 43F shows the bottom surface of lid 4300. As shown, there is a gap 4319 on the underside of lid 4300 between inward-facing wall 4313 and outward-facing wall 4312. It is contemplated that gap 4319 can create an anti-splashing effect that deflects liquid as discussed in FIGS. 7B and 7C. Gap 4319 may also provide additional clearance on the underside of lid 4300 to allow enough room to insert a stamping tool for creating opening 4309 and/or additional tear lines. It should be appreciated that opening 4309 can be increased to a first enlarged position to reduce the size of gap 4319, thereby allowing any entrapped liquid between inward-facing wall 4313 and outward-facing wall 4312 at the widened ridge portion 4310 to be dispensed and consumed. Additionally, it is contemplated that opening 4309 can be further enlarged to a second enlarged position to thereby allow more foam in a foam drink to pass through opening 4309 as desired by the user.

Figure 43G:
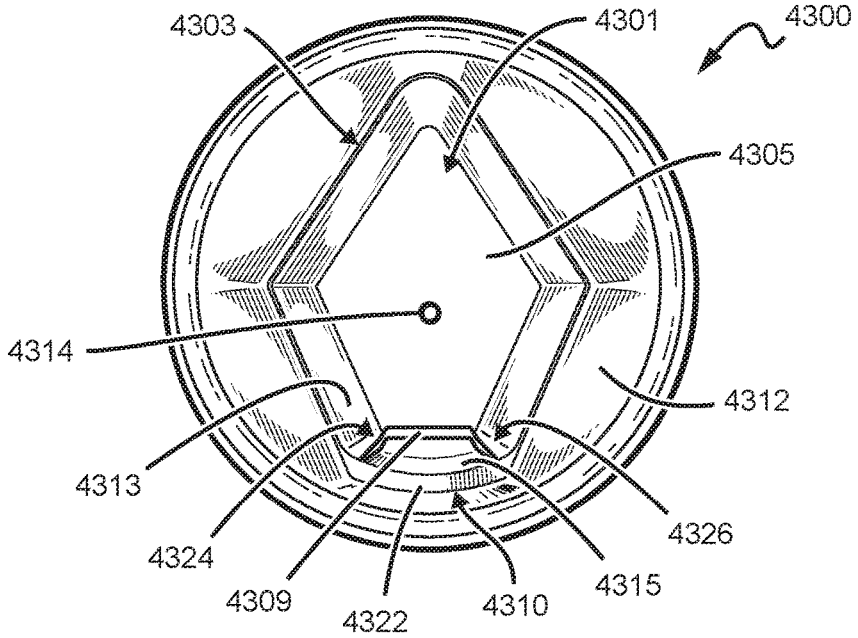

FIG. 43G shows lid 4300 having opening 4309 in a first enlarged position. As described above, opening 4309 can be enlarged by applying a force to a portion of inward-facing wall 4313 near or at widened ridge portion 4310, or by pinching together a portion of inward-facing wall 4313 and a portion of outward-facing wall 4312 typically near or at widened ridge portion 4310. It should be noted that the width of top surface 4322 between first crease 4324 and second crease 4326 remains unchanged although opening 4309 has been enlarged by a pinching force to inward-facing wall 4313 and outward-facing wall 4312. Additionally, or alternatively, it should be appreciated that no tears are created on lid 4300 in order to enlarge opening 4309. Thus, it is contemplated that lid 4300 comprises a material that is flexible yet can be permanently altered in order to enlarge opening 4309.

Figure 43H:
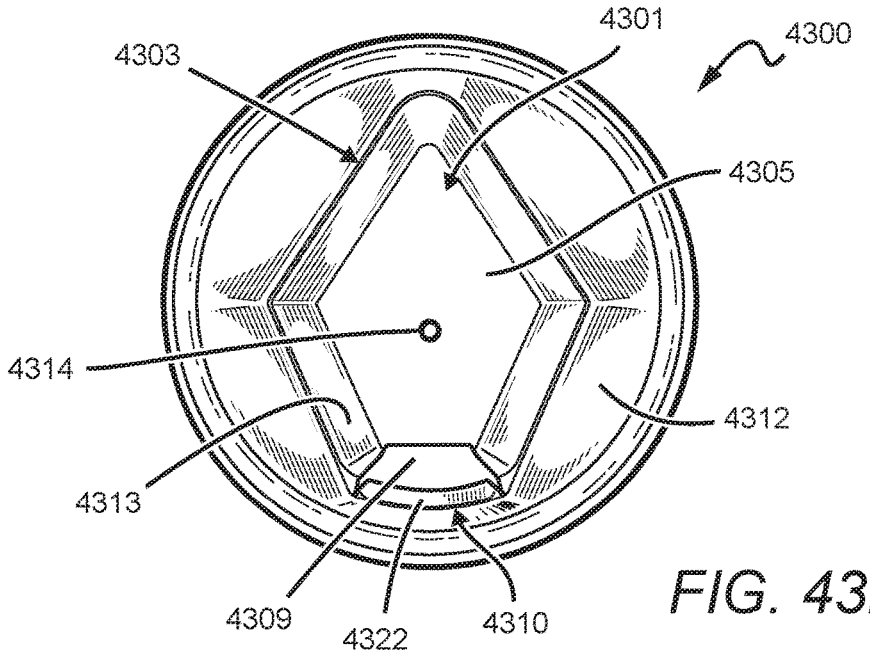

Opening 4309 can be further enlarged to a second enlarged position as shown in FIG. 43H. The second enlarged position is greater than the first enlarged position. The additional enlargement can be accomplished by applying a force to top surface 4322, or by pinching top surface 4322 and outward-facing wall 4312, to create a tear on at least one of inward-facing wall 4313 and top surface 4322. The additional enlargement of opening 4309 can also be accomplished by pinching inward-facing wall 4313 and outward-facing wall 4312 at or near top surface 4322 in widened ridge portion 4310 to create a tear. It is contemplated that opening 4309 can be directly enlarged to the second enlarged position without the need to first enlarge opening 4309 to the first enlarged position.

As shown in FIG. 43H, the tear can extend onto top surface 4322 to decrease the width of top surface 4322 in widened ridge portion 4310 and thereby create an enlarged opening 4309. Typically, the tear runs in a controlled fashion near or at first crease 4324 and second crease 4326 from inward-facing wall 4313 to top surface 4322. It should be appreciated that opening 4309 can be enlarged as shown in FIG. 43H to provide enough area for foam and liquid to exit from a container holding a foam drink.

Figure 43I:
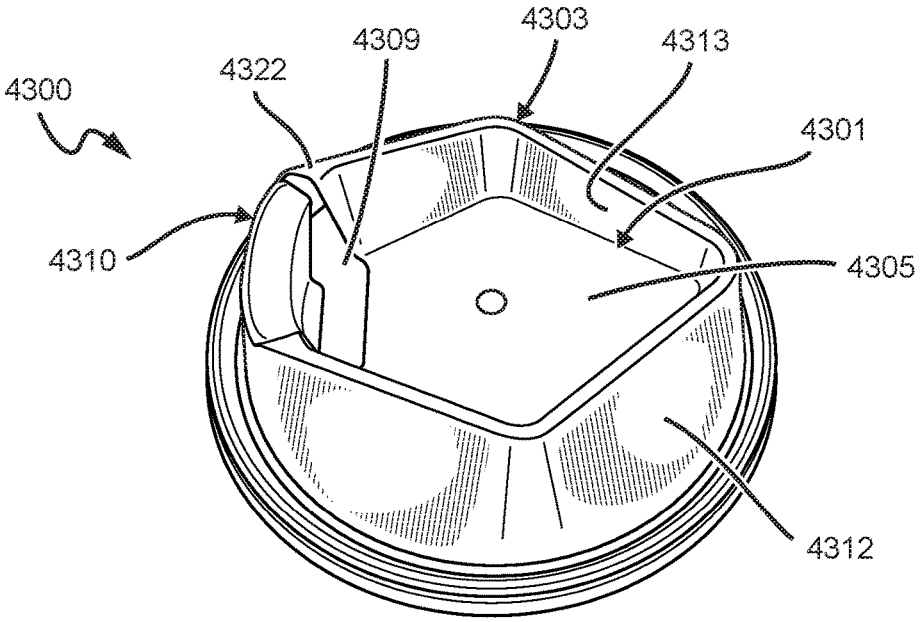
Figure 43J:
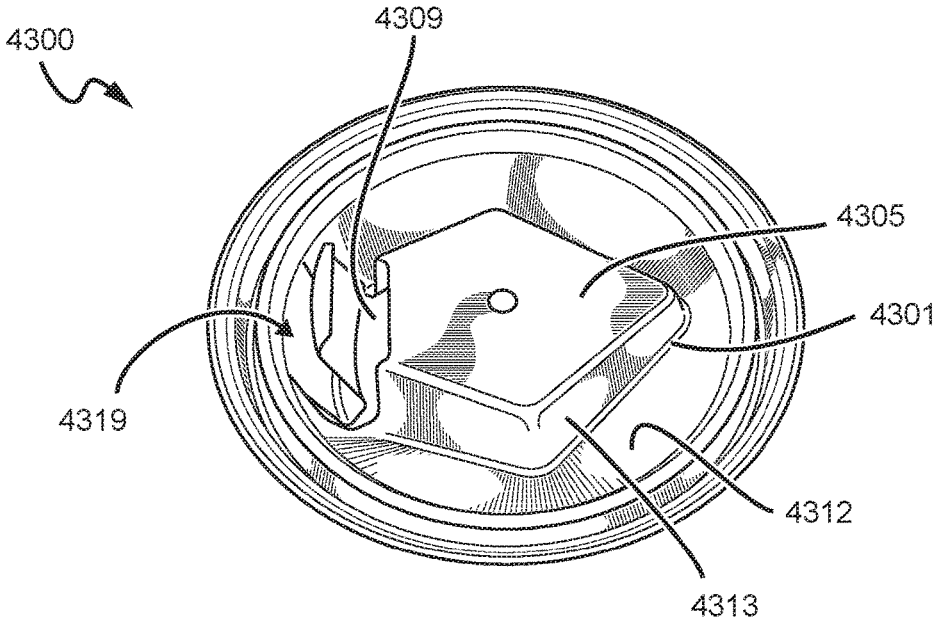

FIG. 43I shows a top perspective view of lid 4300 with an enlarged opening 4309 and FIG. 43J shows a bottom perspective view. The bottom perspective view illustrates how gap 4319 is reduced when opening 4309 is enlarged. Lid 4300 provides an opening 4309 that can be enlarged in stages (e.g., not enlarged to first enlarged position, first enlarged position to second enlarged position, not enlarged to second enlarged position) for different user preferences and uses (e.g., hot vs. cold drinks, foamy vs. smooth drinks, viscous vs. runny drinks, etc.), thereby eliminating the need for a vendor to carry multiple lid types.

Figure 43K:
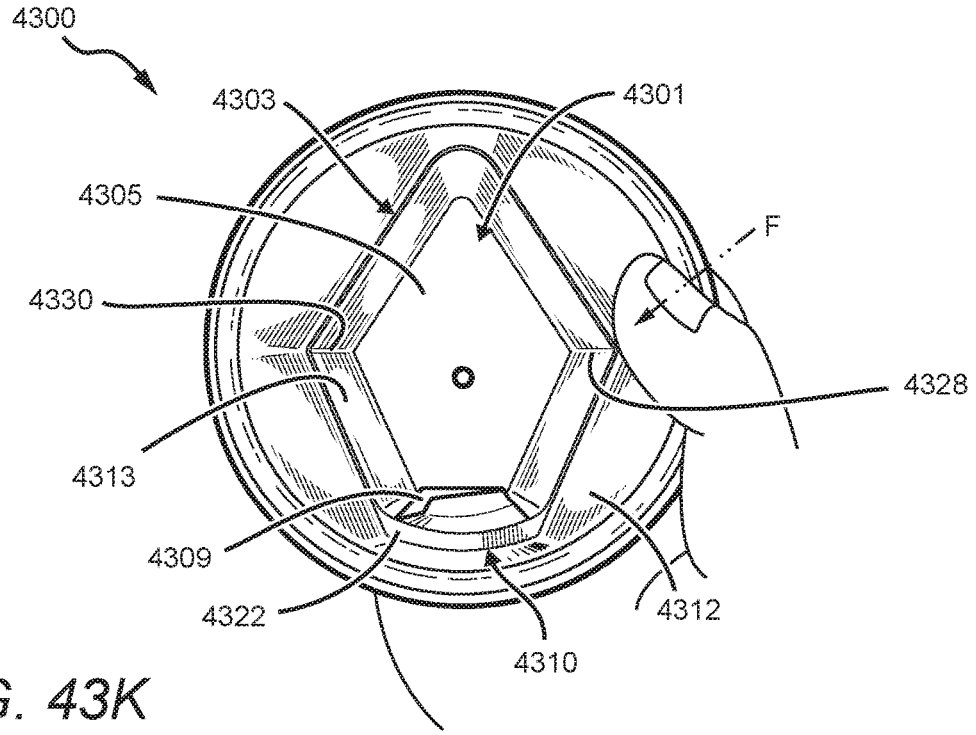

In some circumstances, it may be desirable to enlarge opening 4309 without permanently altering lid 4300 and/or without directly contacting inward-facing wall 4313 near widened ridge portion 4310 as described above. In such instances, a user can apply a force to ridge 4303 near or at a third crease 4328 to temporarily enlarge opening 4309 as shown in FIG. 43K. Once the force is removed, lid 4300 and opening 4309 can return to its original shape as shown in FIG. 43A. An example of a force that temporarily enlarges opening 4309 is shown in FIG. 43K whereby a user pushes down on ridge 4303 at third crease 4328 (e.g., see dotted line designated "F" in FIG. 43K). It is contemplated that valley 4305 is shifted relative to widened ridge portion 4310 as a result of the applied force to enlarge opening 4309.

Alternatively, it is contemplated that a user can apply a force to ridge 4303 near or at a fourth crease 4330 to temporarily enlarge 4309. As discussed above, lid 4300 and opening 4309 can return to its original shape as shown in FIG. 43A when the force is removed. The force applied to fourth crease 4330 can be a produced by a user pushing down on ridge 4303 at fourth crease 4330. Such a force could push valley 4305 in an opposite direction of that shown in FIG. 43K to enlarge opening 4309. Thus, opening 4309 can be enlarged without contacting inward-facing wall 4313 near widened ridge portion 4310 and without permanently altering the structure of lid 4300.

Although opening 4309 can be temporarily enlarged, it should be appreciated that a user can apply a force to ridge 4303 near or at third crease 4328 or fourth crease 4330 that permanently alters the structure of lid 4300. For example, a user can apply a force to ridge 4303 near or at third crease 4328 or fourth crease 4330 that enlarges opening 4309 and leaves opening 4309 in a first enlarged position after the force is removed. This can be beneficial when a user wishes to avoid contact with inward-facing wall 4313 near widened ridge portion 4310, but desires to permanently enlarge opening 4309.

Figure 43L:
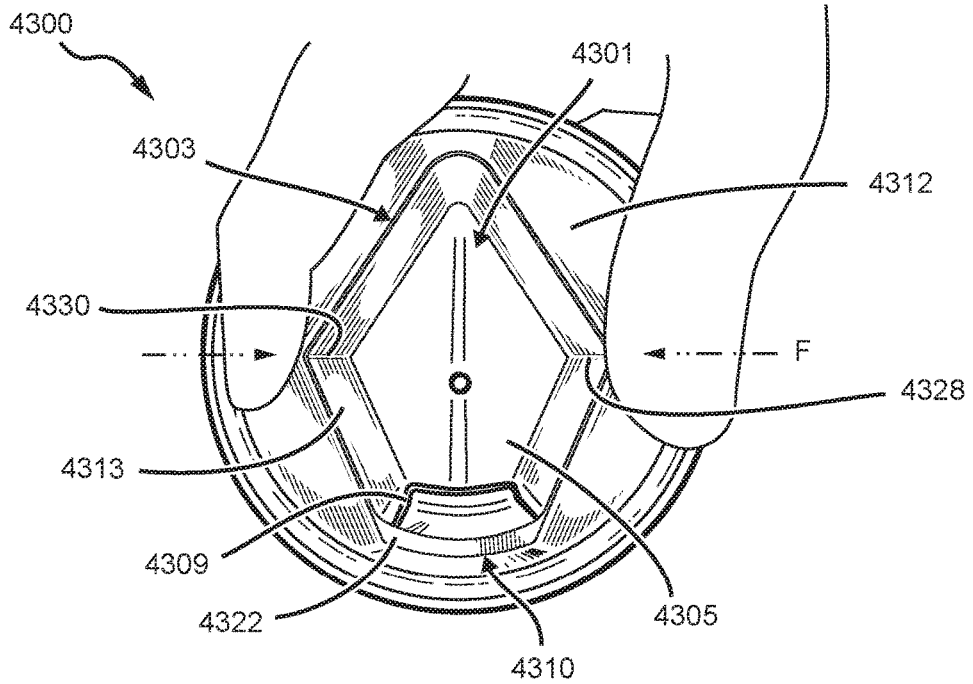

In another aspect, a user can apply a force to ridge 4303 near or at both third crease 4328 and fourth crease 4330 to temporarily enlarge opening 4309 as shown in FIG. 43L. For example, a user can pinch ridge 4303 near or at third crease 4328 and fourth crease 4330 as shown by the two dotted lines designated "F" in FIG. 43L. It is contemplated that valley 4305 partially folds upward while the force is applied to enlarge opening 4309. Once the force is removed, lid 4300 and opening 4309 can return to their original shape as shown in FIG. 43A. However, it is also contemplated that the force applied to ridge 4303 can permanently alter opening 4309, such that opening 4309 returns to a first enlarged position after the force is removed.

It is contemplated that lid 4300 can further comprise at least one tear line disposed on at least one of valley 4305, inward-facing wall 4313, and outward-facing wall 4312. For example, a tear line can be disposed on lid 4300 that can be ruptured to create opening 4309. Additionally, or alternatively, it is contemplated that at least one tear line can be disposed on near or at first crease 4324 and second crease 4326 from inward-facing wall 4313 to top surface 4322 to enlarge opening 4309 to a second enlarged position. In some embodiments, the tear lines can be disposed as described in the embodiments described above. Furthermore, it is contemplated that lid 4300 can be manufactured without valley 4305, such as the splash guard lids in FIGS. 32-40.

It should be appreciated that the various splash guard lids (e.g., lids of FIGS. 32-39B, etc.) can provide benefits in numerous scenarios. For example, the splash guard lids can be a better option in a coffee house for users demanding something less restrictive than a traditional lid for a hot beverage. As discussed above, the splash guard lid will retain heat from any hot beverage and the aroma of coffee will be channeled and concentrated to a user's nose. Furthermore, users may prefer to drink from the splash guard lid because the ridges support the upper lip over a sipping area for controlled flow of the liquid instead of sipping directly from the rim of a container or a traditional lid.

In another example, any of the splash guard lids can be attached to a cup that receives beer. The additional height of the lid provided by the ridge allows extra space for the head of the beer to form when poured. Thus, the splash guard lids can improve the speed in service from a bartender/server. With respect to wine, users can safely aerate the wine by swirling it in a cup with a splash guard lid to increase the aroma of the wine without the risk of spilling while swirling.

Thus, the risk of splashing or spilling drinks on users is greatly reduced by using a splash guard lid. This can be extremely beneficial for businesses where spilling a beverage on a user can lead to consequences. For example, the splash guard lid could be a used on beverage provided by an airline to reduce the risk of spilling onto a customer that can occur during air travel turbulence and reduce the liability of airline companies.

In another aspect, methods of enlarging an opening on a lid are disclosed. The lid comprises a basin defined by a ridge that at least partially surrounds a valley, wherein the basin has a drinking portion and an aroma portion. A first tear line is disposed on the drinking portion and a second tear line disposed on the aroma portion. The lid further comprises a third tear line disposed on the drinking portion and a fourth tear line disposed on the aroma portion. In typical embodiments, the first tear line, the second tear line, the third tear line, and the fourth tear line at least partially extend along a perimeter of the valley. Aside from tear lines, the lid also comprises an opening disposed on the valley in the drinking portion. The method of enlarging the opening on the lid comprises a step of pulling the valley near the opening in an upward motion to rupture the first tear line and the third tear line in the drinking portion. It should be appreciated that the valley is at least partially removed, such that the opening is enlarged.

In further contemplated methods, the valley can be completely removed to enlarge the opening by a step of pulling the valley in the upward motion to tear the second tear line and the fourth tear line in the aroma portion. While pulling the valley in an upward motion is one suitable manner of rupturing the first tear line, second tear line, third tear line, and fourth tear line and other tear lines, it is contemplated that such tear lines can also be ruptured by at least one of pushing down on the surface of valley, piercing the tear lines, pinching portions of the outward-facing wall (e.g., pinching portions of outward-facing wall to rupture the valley tear line), and pinching a portion of the inward-facing wall and the outward-facing wall (e.g., pinching portions of the inward-facing and outward-facing wall to rupture tear lines on inward-facing wall). It is contemplated that the actions that rupture the various tear lines can be accomplished by using a finger or utensils.

The lid can also comprise a fifth tear line and a sixth tear line disposed on an inward-facing wall in the drinking portion. It should be appreciated that the fifth and sixth tear lines provide an additional method of enlarging the opening on the lid. For example, a portion of the inward-facing wall in the drinking portion and a portion of the outward-facing wall in the drinking portion can be pinched together to rupture the fifth and sixth tear lines and enlarge the opening. This pinching step can be done prior to or after the step of pulling the valley near the opening in the upward motion.

The basin of the lid can further comprise a connecter disposed in the opening that couples the inward-facing wall and the valley. The connector prevents the opening from prematurely enlarging by coupling the inward-facing wall and the valley in the opening. Thus, it is contemplated that the connector must be broken in order to enlarge the opening by either pinching together a portion of the inward facing wall and a portion of the outward facing wall or pulling the valley near the opening in an upward motion to break the connector and enlarge the opening. When the connector is broken, a pop sound is generated to alert the user that the opening is enlarged.

In some contemplated methods, the lid has a valley tear line disposed between the first tear line and the second tear line. The valley tear line can be ruptured to create a valley opening on the lid. One suitable manner to rupture the valley tear line is to pinch together two portions on the outward-facing wall. The valley can be removed in segments (e.g., upper half or lower half can be removed). For example, after the valley tear line is ruptured, a user can pull the valley adjacent to the valley opening on the aroma portion side in an upward motion to rupture the second tear line and the fourth tear line, which removes the valley in the aroma portion and leaves the valley in the drinking portion intact. In another example, after the valley tear line is ruptured, a user can pull the valley adjacent to the valley opening on the drinking portion side in an upward motion to rupture the first tear line and the third tear line, which removes the valley in the drinking portion and leaves the valley in the aroma portion intact. One should appreciate that the valley can be completely removed by either pulling in an upward motion or pushing down on the remaining valley to rupture the other tear lines.

Suitable methods of rupturing the valley tear line include at least one of (a) pushing down on the valley tear line with a finger, (b) piercing the valley tear line with a utensil, and (c) pinching the outward-facing wall of the ridge near opposite sides of the valley tear line between thumb and finger. Furthermore, the valley can be pulled in an upward motion near the valley tear line to rupture at least one of (a) the first tear line and the third tear line in the drinking portion, and (b) the second tear line and the fourth tear line in the aroma portion. It should be appreciated that the step of pulling the valley in an upward motion can be performed prior to or after rupturing the valley tear line.

Using the various contemplated methods disclosed herein, it should be noted that a user can conveniently access the contents within an attached container via the enlarged opening. For example, a user can partially remove the valley in the aroma portion, and use utensils, such as chopsticks, to consume food within an attached container. The user can sip liquid from the food within the attached container by tilting the cup to drink from the opening in the drinking portion. If the user requires more area to consume the food within the attached container, then the user can remove the valley completely.

It should be appreciated that the utensils can be stored using the lid. For example, a user can pinch two opposite locations of the outward-facing wall to rupture a valley tear line and create a valley opening. Using the valley opening, a user can insert their utensils to be held in place when not used. When the user is ready to consume the contents within the attached container, then the user pinches the two opposite locations of the outward-facing wall to enlarge the valley opening and pull the utensils from the valley opening. The user can then remove a portion of the valley to provide a greater area to access the contents within the attached container.

In another aspect, a method of refilling a container having a lid is contemplated. The method comprises a step of providing a lid having a ridge with an inward-facing wall and an outward-facing wall that form a rounded apex. The lid has an opening that is at least partially defined by the ridge and extends from a drinking portion to an aroma portion. The lid is coupled to a container that holds a beverage and/or food product. The user consumes at least a portion of the beverage and/or food product by tilting the container with the attached lid via a sipping area. After consuming at least a portion of the beverage and/or food product, the user refills the container via the opening. It is contemplated that unlike traditional lids, the user does not need to remove the lid to refill the contents of the container.

In another aspect, a method of reducing spills from an opening on a container is contemplated. The method comprises providing a lid having (i) a ridge with an inward-facing wall and an outward-facing wall that form a rounded apex, and (ii) a first opening that is at least partially defined by the ridge, and that extends from a drinking portion to an aroma portion. In another step, the lid is placed onto the opening of the container to removably couple the lid onto the container.

In another step, the container is filled with a beverage and/or food product before placing the lid onto the opening of the container. Additionally, or alternatively, the container is filled with a beverage and/or food product after placing the lid onto the opening of the container. In some embodiments, the lid comprises a first tear line and a second tear line disposed on the inward-facing wall as described above. In those embodiments, it is contemplated that an area on the outward-facing wall and the inward-facing wall can be pinched in the drinking portion to rupture a first tear line and a second tear line on the inward-facing wall of the lid. The lid can further comprise a slit disposed on the inward-facing wall in the drinking portion to provide an additional flow path for the beverage and/or food product.

From another method perspective, when a user wishes to imbibe the beverage, the user would place their bottom lip near the edge of ridge at drinking portion. The user would tilt the container allowing the liquids to flow through openings in a controlled manner. The liquids would collect within sipping area. Simultaneously, opening would allow the exchange of air between lumen of container and the surrounding environment, thus preventing a vacuum (e.g., backpressure) from forming (which could disrupt the even flow of the liquids from opening). The user would then be able to sip the liquids at their leisure. Through the aforementioned process, users are able to prevent the sudden and uncontrolled rush of potentially searing hot fluids from hitting their lip and mouth.

The lids described above may provide numerous advantages over prior art lids. Some of those advantages will now be described.

Many of the embodiments give the user greater control over the flow rate of the beverage, which is particularly advantageous for drinking hot coffee or hot tea. In addition, the plastic can be naturally torn upward when pinched forward at the base of the opening in the reservoir. This creates a larger opening for liquid to pass through where the original opening was, increasing the flow. However it will not widen the point at which it comes into contact with the user's mouth. This feature provides a distinct advantage over prior art lids. The tapered narrow lip design at the top of the front of the lid is not affected from the tear so the user's control of sloshing while drinking is still intact. This design feature can be implemented when the user would like to increase flow of beverage in instances when the liquid is not at a temperature above 140 degrees Fahrenheit (60 degree Celsius) or when beverage is of a more viscous nature such as drinks with whipped topping. This increase of flow with the larger opening option may not be recommended while liquid is above 140 degrees Fahrenheit (60 degree Celsius) and uncomfortably hot for the user, since an increased flow can create a heightened chance of burning or discomfort to the user while consuming, especially while on the go.

Under certain circumstances, embodiments that include an opening formed as a slit provide better control of flow rate, meaning the appropriate volume of liquid is being delivered to the user at an appropriate velocity for a given beverage temperature (i.e., a sufficient amount of liquid is being delivered to the user at any given moment and at a comfortable speed). The controlled flow helps to reduce the risk of burning.

Most embodiments can be modified to include small cuts along the interior ridges running up the basin walls from the corners of the opening on the valley such that the opening can be enlarged by pinching the bottom of the opening. This allows the user to adjust the opening size and the flow rate. For example, as a hot beverage cools down, the user may wish to increase the flow rate. Also, if a user is no longer moving, the user may wish to increase the flow rate. Or if the user has finished drinking a liquid portion of the beverage and wants to consume a foamy whipped topping, the user may increase the opening.

Some embodiments give the consumer the option to increase flow without widening the channel of point of entry where liquid enters user's mouth. By simply pinching the drinking spout adjacent to the opening, the plastic will naturally and easily tear up towards the top without affecting the channel or exterior.

Some embodiments could be further enhanced by two simple cuts rising up from the corners of the opening on the valley. The cuts could follow the natural creases of the inward-facing wall. The cuts would not leak any liquid unless pushed open by user, which would control flow and change flow only if desired.

Embodiments that have the increased opening feature also guarantees that the user can get every last drop of the drink. There is no trapped liquid when this option is exercised.

The increased opening feature is also beneficial for someone who is not on the go (e.g., someone sitting at their desk at the office) but would like to keep their beverage covered to keep it warmer longer. Since the user is not in motion, the user can afford to increase the flow by increasing the opening, which will also enhance the olfactory experience.

Many of the embodiments above also provide safety splash and spill advantages. For example, the basin walls act as a splash guard and reduces the chances that the user will be burned when the beverage container is jolted (e.g., user drives over a bump in the road). In addition, if the beverage container is accidentally tipped over, the restricted opening reduces flow rate of the liquid and thus reduces the amount of spilt liquid. Moreover, if the container is shaken, the lid reduces spill and has a sloping basin valley that returns liquid to the container, unlike most conventional lids where the liquid has nowhere to come to rest. With a conventional lid the consumer may be burned by the liquid that pools on the outer surface of the lid, which could have very serious consequences when the consumer is operating a vehicle.

Many embodiments provide an enhanced olfactory experience since the basin valley provides an area for liquid to collect and slowly flow back into the container reservoir at a controlled flow rate. The liquid is given time to aerate and, when the lid is tilted, the basin walls act to channel and concentrate aroma vapors towards the user's nose.

In addition, a large basin valley (e.g., recessed reservoir) allows for a larger vacuum hole (e.g., 0.125 inches (0.3175 centimeters) to 0.1875 inches (0.4762 centimeters)) compared to many prior art lids. This larger vacuum hole ensures a smoother flow from the drink spout up front and helps to guarantee that liquid will not be trapped in the container. In the event some liquid is released from the vacuum hole, it will be safely returned to the container leaving an aromatic coating of liquid behind. The large surface area of the basin valley creates a larger aromatic coating, thus enhancing the consumer's olfactory experience.

In some embodiments the basin has an angular shape. With the unique angular shape the user can quickly identify where the drinking spout is without looking at the container. This is beneficial in situations where visibility is low (e.g., at night or in a dark room) or when the user just needs to keep their eyes on the road while driving in heavy traffic.

In many embodiments, the basin valley does not dip below the outer rim of the cup, which allows the consumer to fill the cup all the way up. Most embodiments are designed to be stackable so that space is conserved when multiple lids are stored and/or transported.

Many embodiments also make it easy for the barista to quickly identify the drinking spout area of the lid so that there will be less of a chance that he/she will come into contact with it and thus limiting the chance of cross contamination.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A lid for a container, comprising:

a ridge comprising an inward-facing wall and an outward-facing wall that meet at a top surface;

an outer rim that at least partially surrounds the ridge, wherein the outer rim is sized and dimensioned to receive the container;

wherein the top surface comprises a first width at a first portion of the ridge and a second width at a second portion of the ridge;

wherein the first width is greater than the second width;

wherein the inward-facing wall at the first portion of the ridge comprises (i) a first crease and a second crease that extend downwardly from the top surface, and (ii) a sipping area disposed between the first crease and the second crease; and an opening disposed proximal to the first portion on the ridge, and wherein at least a portion of the opening is disposed on the inward-facing wall and extends upward towards the top surface; and wherein at least a portion of the ridge is disposed above the opening.

2. The lid of claim 1, wherein the first portion of the ridge and the second portion of the ridge are disposed on opposite halves of the ridge.

3. The lid of claim 1, wherein the opening extends near a portion of the first crease and the second crease.

4. The lid of claim 3, further comprising a valley at least partially surrounded by the ridge, wherein the opening is disposed on the valley and extends along the first crease and the second crease.

5. The lid of claim 4, wherein a first portion of the opening is disposed on the valley, a second portion of the opening is disposed near the first crease, and a third portion of the opening is disposed near the second crease, and wherein the second portion and the third portion are substantially perpendicular to the first portion.

6. The lid of claim 3, wherein the opening extends along the first crease and the second crease to the top surface.

7. The lid of claim 1, further comprising a valley at least partially surrounded by the ridge, wherein the first crease and second crease extend along the inward-facing wall from the valley to the top surface, and wherein the first crease and the second crease extend vertically with respect to the valley.

8. The lid of claim 1, further comprising a valley at least partially surrounded by the ridge.

9. The lid of claim 1, wherein the first width is between ⅛ to ¾ inch.

10. The lid of claim 1, wherein the first width is between ¼ to ½ inch.

11. The lid of claim 1, wherein the first crease extends downwardly from a first portion of the top surface and the second crease extends downwardly from a second portion of the top surface different from the first portion of the top surface.

12. A lid for a container, comprising:

a ridge comprising an inward-facing wall and an outward-facing wall;

a first crease and a second crease disposed on the inward-facing wall;

a valley at least partially surrounded by the ridge;

an opening disposed on (i) the valley, and (ii) the inward-facing wall near the first crease and the second crease;

wherein at least a portion of the opening extends above the valley; and wherein the first crease extends upwardly from the valley to a first end and the second crease extends upwardly from the valley to a second end, and wherein the first end and the second end are disposed on different portions of the lid.

13. The lid of claim 12, wherein the ridge surrounds the valley to form a pentagonal shape.

14. The lid of claim 12, wherein a first portion of the opening is disposed on the valley, a second portion of the opening is disposed near the first crease, and a third portion of the opening is disposed near the second crease, and wherein the second portion and the third portion are substantially perpendicular to the first portion.

15. The lid of claim 12, wherein the inward-facing wall and the outward-facing wall extend to a top surface, and further comprising (i) a first width of the top surface near at least one of the first crease and the second crease, and (ii) a second width of the top surface at a second portion of the ridge, and wherein the first width is greater than the second width.

16. The lid of claim 12, further comprising an aperture disposed on the valley.

17. A lid for a container, comprising:

a ridge comprising an inward-facing wall and an outward-facing wall that meet at a top surface;

an outer rim that at least partially surrounds the ridge, wherein the outer rim is sized and dimensioned to receive the container;

wherein the top surface comprises a first width at a first portion of the ridge and a second width at a second portion of the ridge;

wherein the first width is greater than the second width;

wherein the inward-facing wall at the first portion of the ridge comprises (i) a first crease and a second crease that extend downwardly from different portions of the top surface, and (ii) a sipping area disposed between the first crease and the second crease; and an opening disposed proximal to the first portion on the ridge, wherein at least a portion of the ridge is disposed above the opening.

18. The lid of claim 17, wherein a first portion of the opening is disposed near the first crease, and a second portion of the opening is disposed near the second crease.

19. The lid of claim 17, wherein a first portion of the opening is disposed on the first crease, and a second portion of the opening is disposed on the second crease.

20. The lid of claim 17, wherein the first width is between ⅛ to ¾ inch.

21. The lid of claim 17, wherein the first portion of the ridge and the second portion of the ridge are disposed on opposite halves of the ridge.

22. A lid for a container, comprising:

a ridge comprising an inward-facing wall and an outward-facing wall that meet at a top surface;

a first crease and a second crease disposed on the inward-facing wall;

a valley at least partially surrounded by the ridge;

an opening disposed on (i) the valley, and (ii) the inward-facing wall near the first crease and the second crease; and wherein at least a portion of the opening is disposed on the inward-facing wall and extends upward towards the top surface.

23. The lid of claim 22, wherein a first portion of the opening is disposed on the valley, a second portion of the opening is disposed near the first crease, and a third portion of the opening is disposed near the second crease.

24. The lid of claim 22, wherein the first crease and the second crease extend downwardly from different portions of the top surface.

25. The lid of claim 22, further comprising (i) a first width of the top surface near at least one of the first crease and the second crease, and (ii) a second width of the top surface at a second portion of the ridge, and wherein the first width is greater than the second width.

* * * * *